US009141017B2

(12) United States Patent
Hayashi et al.

(10) Patent No.: US 9,141,017 B2
(45) Date of Patent: Sep. 22, 2015

(54) IMAGE FORMING APPARATUS

(71) Applicant: CANON KABUSHIKI KAISHA, Tokyo (JP)

(72) Inventors: Isao Hayashi, Kawasaki (JP); Masaaki Naoi, Yokosuka (JP); Ichiro Okumura, Abiko (JP); Masaya Kobayashi, Yokohama (JP); Hisae Shimizu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/184,012

(22) Filed: Feb. 19, 2014

(65) Prior Publication Data

US 2014/0233990 A1 Aug. 21, 2014

(30) Foreign Application Priority Data

Feb. 19, 2013 (JP) ..... 2013-029572

(51) Int. Cl.
*G03G 15/01* (2006.01)
*G03G 15/00* (2006.01)

(52) U.S. Cl.
CPC ..... *G03G 15/0189* (2013.01); *G03G 15/5054* (2013.01); *G03G 2215/00054* (2013.01); *G03G 2215/0158* (2013.01)

(58) Field of Classification Search
CPC ..... G03G 2215/0161; G03G 15/0178; G03G 15/0131
USPC ..... 399/301
See application file for complete search history.

(56) References Cited

U.S. PATENT DOCUMENTS 8,676,100 B2 3/2014 Shimizu et al.
2012/0008995 A1 * 1/2012 Shigemura et al. ..... 399/301

FOREIGN PATENT DOCUMENTS

JP 2004-145077 A 5/2004
JP 2009-134264 A 6/2009

OTHER PUBLICATIONS

U.S. Appl. No. 14/184,008, filed Feb. 19, 2014, Seiji Hara Ichiro Okumura.

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

First position information formed on a conveyance body is read by an information detecting portion, and second position information formed on a second image carrier is read by the information detecting portion. Control is made such that a position of an image on the second image carrier matches with a position of an image on the conveyance body from information read by the information detecting portion in transferring the image from the second image carrier to the conveyance body. The information detecting portion is held by a hold member and is disposed at a transfer region.

8 Claims, 70 Drawing Sheets

FIG.22A
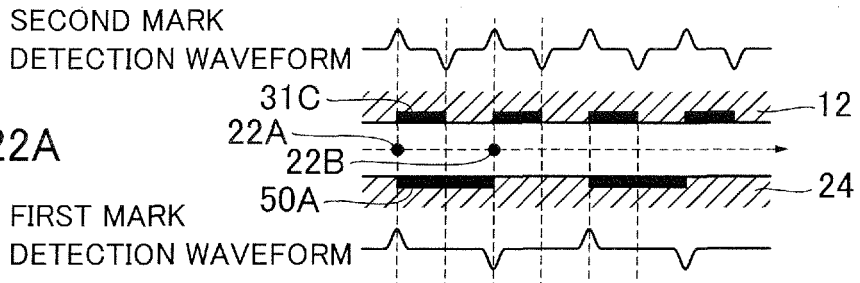
FIG.22B
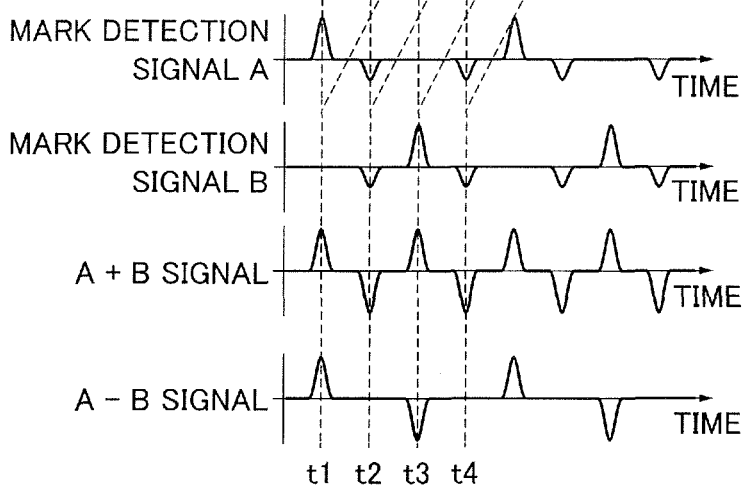
FIG.22C

MARK DETECTION SIGNAL A
TIME

MARK DETECTION SIGNAL B
TIME
SECOND MARK DETECTION SIGNAL (A + B)
TIME

FIRST MARK DETECTION SIGNAL (A − B)
TIME
SPEED COMMAND SIGNAL
Veb+ΔVe
Veb

TIME
t1 t2 t3 t4 t5 t6 t7 t8 t9 t10

MARK DETECTION SIGNAL A
TIME

MARK DETECTION SIGNAL B
TIME
MARK DETECTION SIGNAL C
TIME
MARK DETECTION SIGNAL D
TIME
A − B SIGNAL
TIME
C − D SIGNAL
TIME

SECOND MARK DETECTION SIGNAL (A − B) + (C − D)
TIME
FIRST MARK DETECTION SIGNAL (A − C)
TIME

SPEED COMMAND SIGNAL
Veb
Veb−ΔVe
TIME
t1 t2 t3 t4 t5 t6 t7 t8 t9 t10 t11 t12 t13 t14

Lp
Lp
50B
BELT GRADUATION
+ + + + +
+ + + + +

Lp
Lp
31D
DRUM GRADUATION
+ + + + +
+ + + + +

Xc
Xw

Xw

50B
BELT GRADUATION
+ + + + +
+ + + + +
31D

DRUM GRADUATION
+ + + + +
+ + + + +

V1
OUTPUT WAVEFORM FROM SENSOR
V2

WAVEFORM P A/D CONVERTED BY THRESHOLD VALUES V1 AND V2
w
w

DIFFERENTIAL WAVEFORM R OF OUTPUT
0

WAVEFORM X
b1
d1
b2
d2
b3
d3
b4
d4
b5 tlb
50B
BELT GRADUATION
+ + + + +
+ + + + + tld
31D
DRUM GRADUATION
+ + + + +
+ + + + +

V1
OUTPUT WAVEFORM
FROM SENSOR
V2
tlb twp
twp
WAVEFORM S
bi

OUTPUT SIGNAL X
FROM SENSOR
b(i+1)
TIME
t_bi
t_b(i+1)

BELT GRADUATION
DRUM GRADUATION
50D
31F

OUTPUT WAVEFORM FROM SENSOR
V1
V2

POSITION OF BELT GRADUATION
POSITION OF DRUM GRADUATION
b1
b2
b3
d1
d2
d3

31G
BELT GRADUATION
++++
++++
++++

DRUM GRADUATION
++
++
++
50E

OUTPUT SIGNAL FROM SENSOR
POSITION OF BELT GRADUATION
b1
b2
b3
b4
b5
b6

POSITION OF DRUM GRADUATION
d1
d2
d3
d4
d5
d6

FIRST EXAMPLE

SUPPOSE Vt − Vd + Vp = ΔV

SECOND EXAMPLE

IMAGE FORMING APPARATUS

BACKGROUND OF THE INVENTION

1. Field of the Invention

The present invention relates to an image forming apparatus such as a copier, a printer, a facsimile, and a multi-function printer, and more specifically to a configuration in which a plurality of image carriers is juxtaposed in a conveying direction of a conveyance body.

2. Description of the Related Art

In regard to an electrophotographic color image forming apparatus, various types of so-called tandem type image forming apparatuses each including a plurality of image forming portions and configured to transfer images of different colors sequentially on an intermediate transfer belt or on a recording medium held on a conveyor belt is proposed to speed up operations.

However, such tandem type image forming apparatuses have the following problem. That is, a gap or the like may occur between travels of an outer circumferential surface of a photoconductive drum and the intermediate transfer belt at a transfer position of each image forming portion variously per each color due to fluctuation of speeds of the plurality of photoconductive drums and the intermediate transfer belt caused by uneven mechanical precision or the like. Therefore, the tandem type image forming apparatuses have a possibility of causing a color registration error, i.e., a color shift of respective colors, when the images are superimposed.

Then, various configurations for suppressing such a color shift have been proposed since the past. For instance, according to one configuration, image position information provided on an intermediate transfer belt and image position information provided on a photoconductive drum are read, respectively, by information detecting portions separately provided. Then, each image forming portion is controlled such that an image formed on a first photoconductive drum located upstream in a conveying direction of the intermediate transfer belt and transferred to the intermediate transfer belt coincides with an image formed on a second photoconductive drum located downstream in the conveying direction. It is noted that a method utilizing an electrostatic latent image, a magnetic record or the like is used to form the image position information.

For instance, in configurations described in Japanese Patent Application Laid-open Nos. 2009-134264 and 2004-145077, an information detecting portion for detecting information on a photoconductive drum and an information detecting portion for detecting information on an intermediate transfer belt are separately installed. That is, the information detecting portions are mounted separately. Due to that, fluctuation of relative positions of the respective information detecting portions caused by temperature changes or the like and a difference of vibrations of the respective information detecting portions may cause an error in registering the images.

SUMMARY OF THE INVENTION

An image forming apparatus of the present invention includes a conveyance body configured to carry and convey an image or a recording medium, first and second image carriers juxtaposed in a conveying direction of the conveyance body and each carrying and conveying an image, a first image forming portion configured to form the image on the first image carrier, a second image forming portion configured to form the image on the second image carrier, a first transfer portion configured to transfer the image from the first image carrier to the conveyance body or to the recording medium conveyed by the conveyance body, a second transfer portion disposed downstream the first transfer portion in the conveying direction of the conveyance body and configured to transfer the image from the second image carrier to the conveyance body or to the recording medium conveyed by the conveyance body, a first position information forming portion configured to form first position information concerning a position of the image formed on the conveyance body by the first image forming portion, a second position information forming portion configured to form second position information concerning a position of the image formed on the second image carrier by the second image forming portion, an information detecting portion configured to detect the first position information formed on the conveyance body and the position information formed on the second image carrier, a control portion configured to control at least either one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body from the first and second position information detected by the information detecting portion in transferring the image from the second image carrier to the conveyance body or to the recording medium conveyed by the conveyance body, and a hold member configured to hold the information detecting portion and extending in the conveying direction of the conveyance body from the second image carrier to a transfer region where the image is transferred from the second image carrier to the conveyance body or to the recording medium.

Further features of the present invention will become apparent from the following description of exemplary embodiments with reference to the attached drawings.

BRIEF DESCRIPTION OF THE DRAWINGS

FIG. 22A is a schematic diagram showing detected waveforms of first and second marks when two signal detecting portions of the latent image sensor of the sixth embodiment are moved to a right hand side in FIG. 22A.

FIG. 22B is a chart showing waveforms of the respective detecting portions by matching time bases.

FIG. 22C is a chart represented by adding and subtracting those waveforms.

FIG. 46C is a chart, similar to FIG. 46B, showing an output waveform when there exists a color shift.

FIG. 47A is a diagram schematically showing a positional relation of the graduations formed on the intermediate transfer belt and the photoconductive drum in the eighth embodiment.

FIG. 47B is a chart showing an output waveform when these graduations are detected by the latent image sensor.

FIG. 48A is a diagram schematically showing a positional relation of the graduations.

FIG. 48B is a chart showing an output waveform when the graduations are detected.

FIG. 48C is a chart showing a waveform A/D converted by a threshold value.

FIG. 48D is a chart showing a differentiated waveform of the output.

FIG. 48E is a chart showing zero-cross positions of the waveforms in FIGS. 48C and 48D.

FIG. 49A is a diagram schematically showing a positional relation of the graduations.

FIG. 49B is a chart showing an output waveform when the graduations are detected.

FIG. 49C is a chart showing a waveform generated by considering an error.

FIG. 49D is a chart showing a relationship between zero-cross point similar to that shown FIG. 48E and time.

Figure 50A:
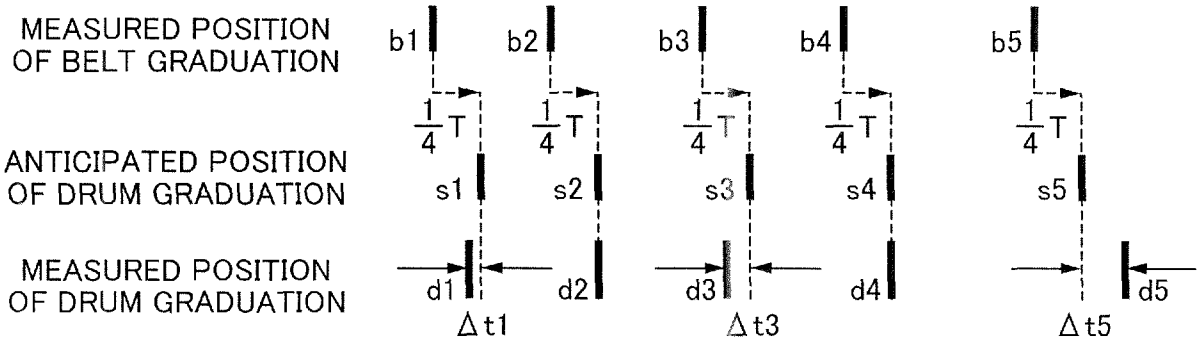

FIG. 50A illustrates a method for estimating a color shift equivalent from anticipated positions of the graduations of the photoconductive drum.

Figure 50B:
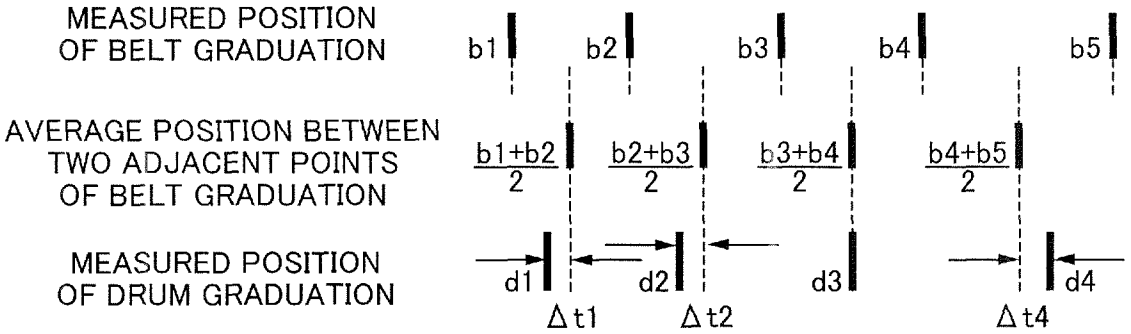

FIG. 50B illustrates a method for estimating a color shift equivalent from average positions between adjacent two points of the graduations of the intermediate transfer belt.

Figures 51A, 51B:
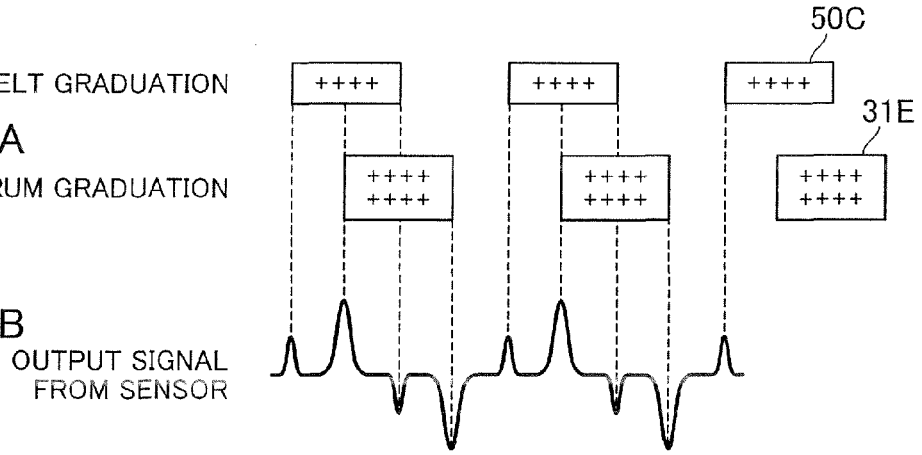

FIG. 51A is a diagram schematically showing a positional relation of the graduations formed on the intermediate transfer belt and the photoconductive drum in a ninth embodiment of the invention.

FIG. 51B is a chart showing an output waveform when these graduations are detected by the latent image sensor.

Figures 52A, 52B, 52C, 52D, 52E:
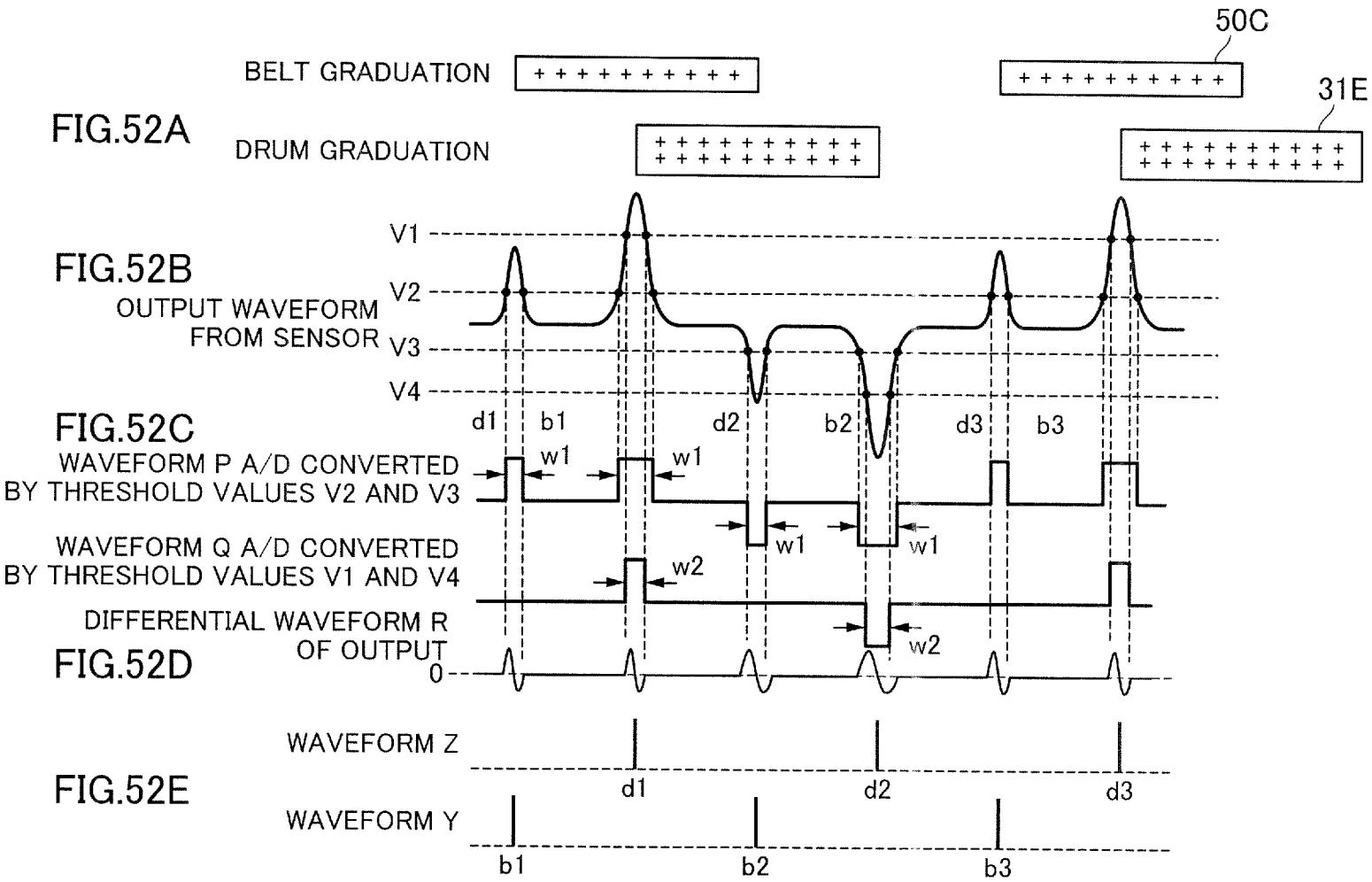

FIG. 52A is a diagram schematically showing a positional relation of the graduations.

FIG. 52B is a chart showing an output waveform when the graduations are detected.

FIG. 52C is a chart showing a waveform A/D converted by a threshold value.

FIG. 52D is a chart showing a differentiated waveform of the output.

FIG. 52E is a chart showing zero-cross positions of the waveforms in FIGS. 52C and 52D.

Figure 53:
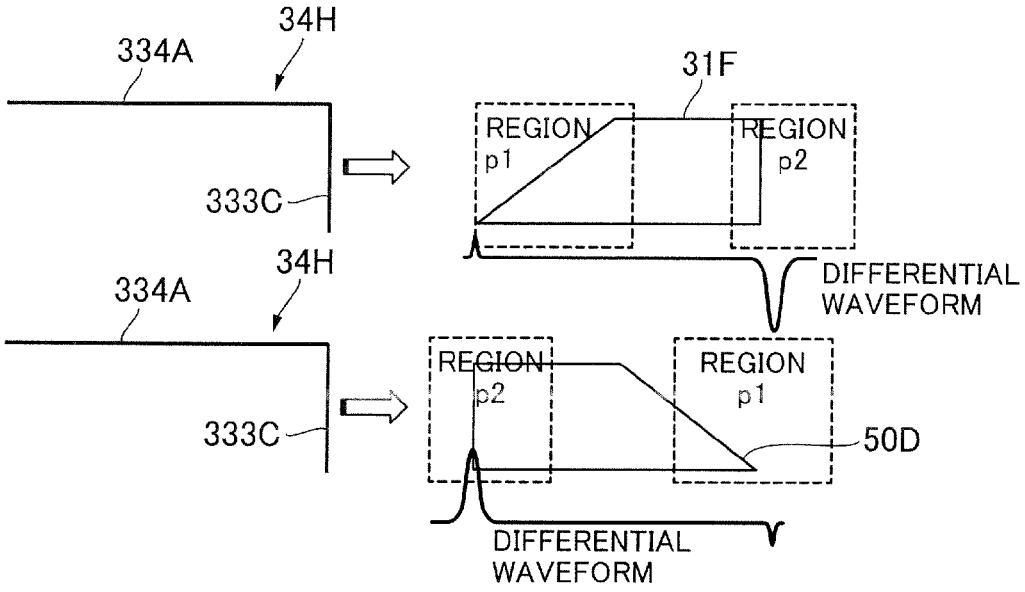

FIG. 53 is a diagram schematically showing a relationship between shapes of graduations formed on the intermediate transfer belt and the photoconductive drum and a detection direction of the latent image sensor in a tenth embodiment of the invention.

Figures 54A, 54B, 54C:
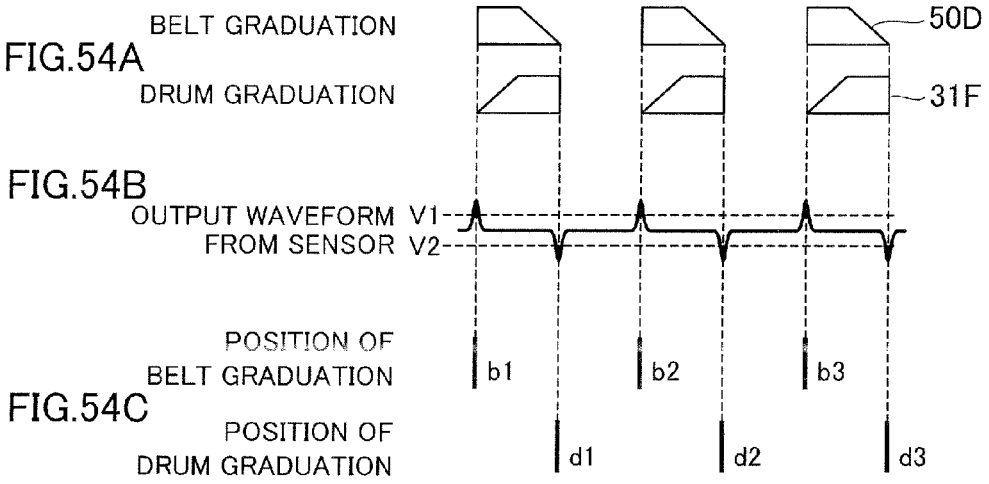

FIG. 54A is a diagram schematically showing a positional relation of the graduations formed on the intermediate transfer belt and the photoconductive drum.

FIG. 54B is a chart showing an output waveform when the graduations are detected by the latent image sensor.

FIG. 54C is a chart showing zero-cross positions similar to those shown in FIG. 52E.

Figures 55A, 55B, 55C:
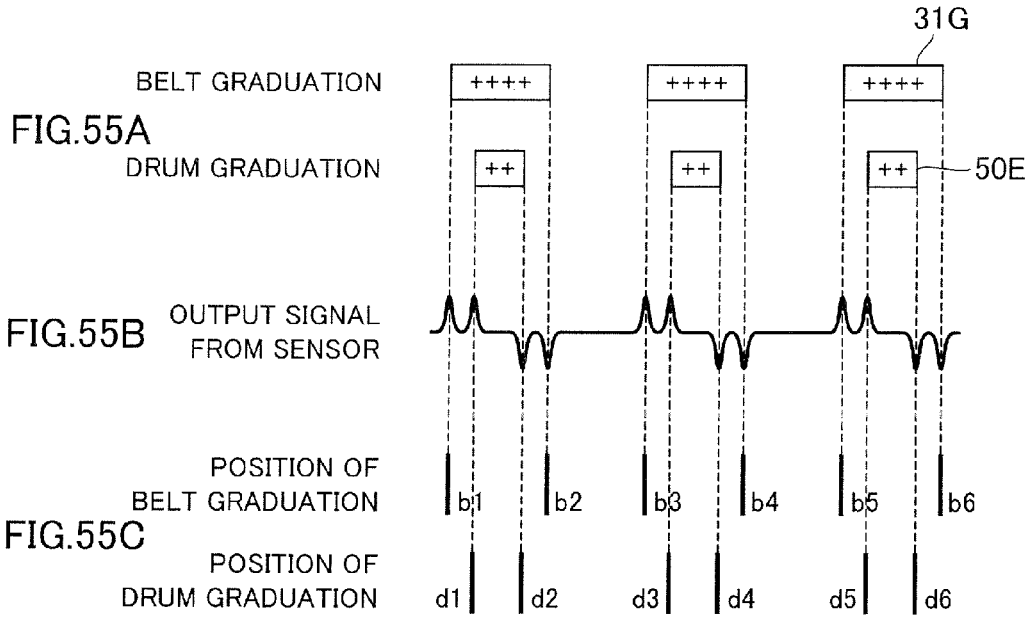

FIG. 55A is a diagram schematically showing a positional relation of the graduations formed on the intermediate transfer belt and the photoconductive drum according to an eleventh embodiment of the invention.

FIG. 55B is a chart showing an output waveform when the graduations are detected by the latent image sensor.

FIG. 55C is a chart showing zero-cross positions similar to those shown in FIG. 52E.

Figure 56A:
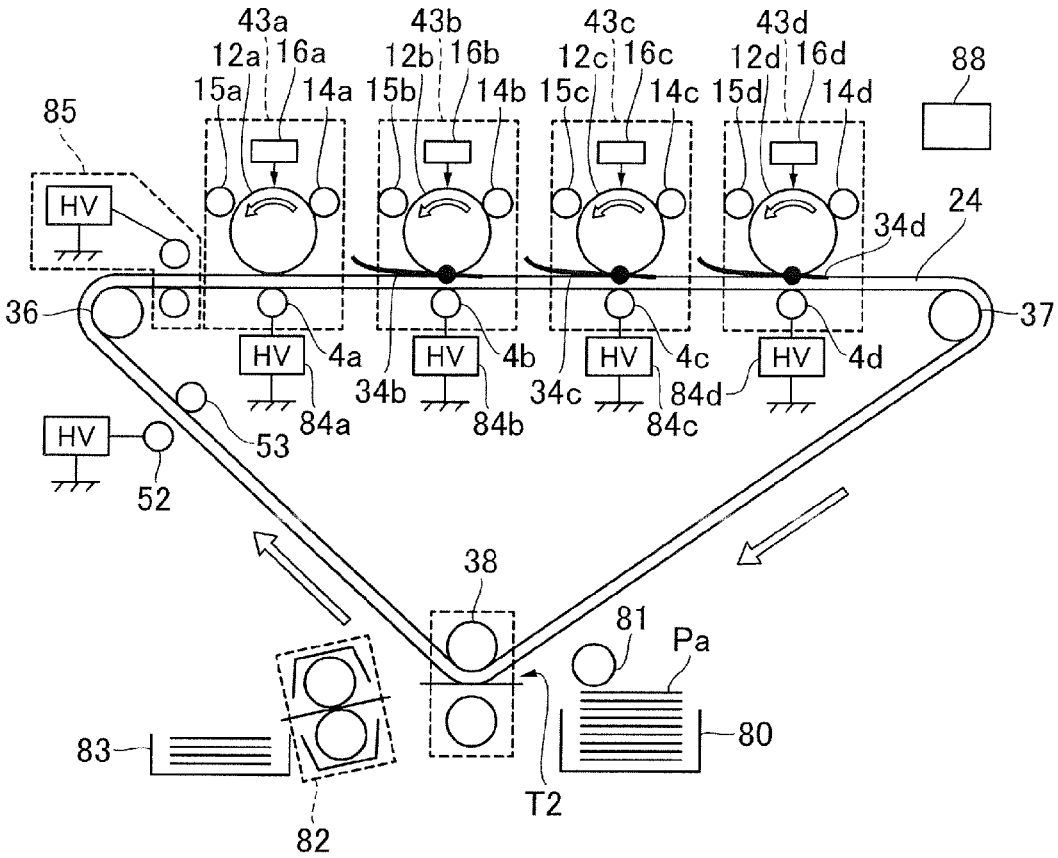

FIG. 56A is a schematic section view showing a part of a structure of an image forming apparatus according to a twelfth embodiment of the invention.

Figure 56B:
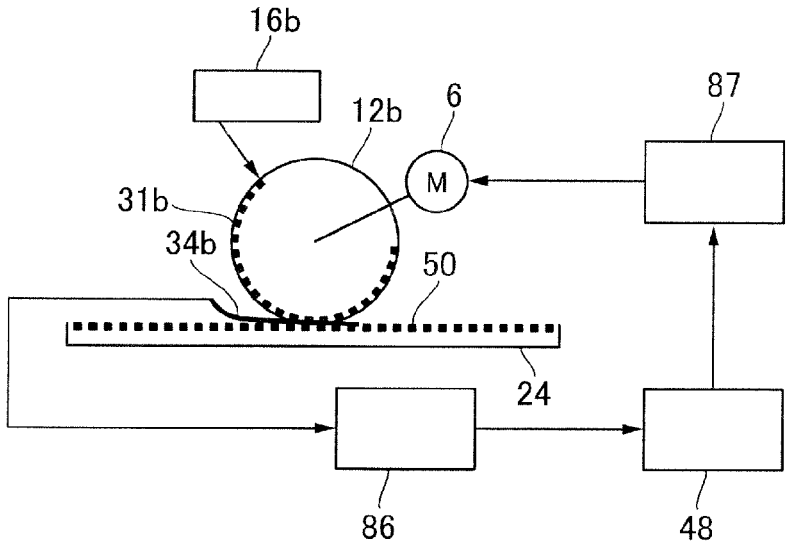

FIG. 56B is a block diagram illustrating a control in correcting a color shift by the image forming apparatus shown in FIG. 56A.

Figure 57A:
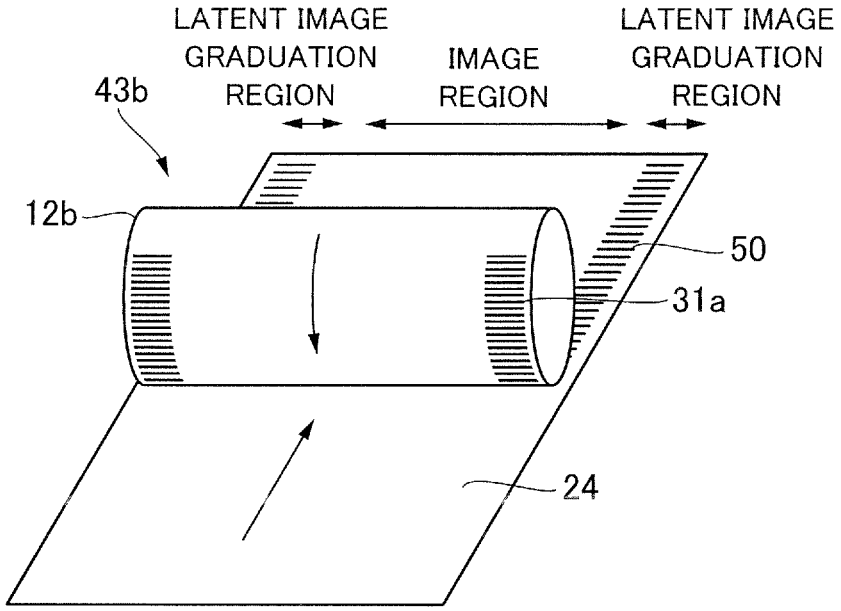

FIG. 57A is a perspective view schematically showing how to transfer a latent image graduation to an intermediate transfer belt in a first image forming portion.

Figure 57B:
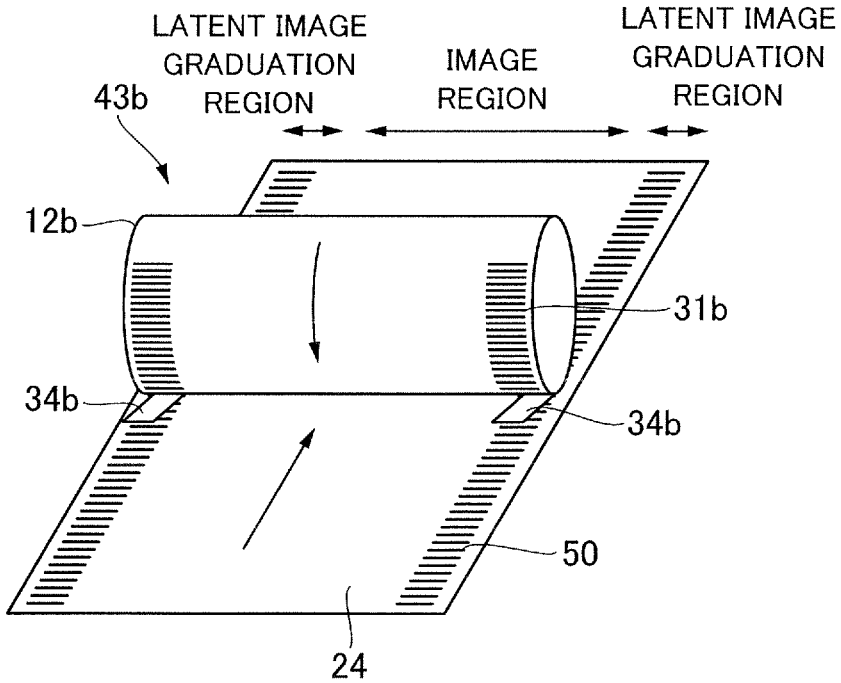

FIG. 57B is a perspective view schematically showing a positional relation among a latent image graduation formed in a second image forming portion, a latent image graduation on the intermediate transfer belt, and the latent image sensor.

Figure 58A:
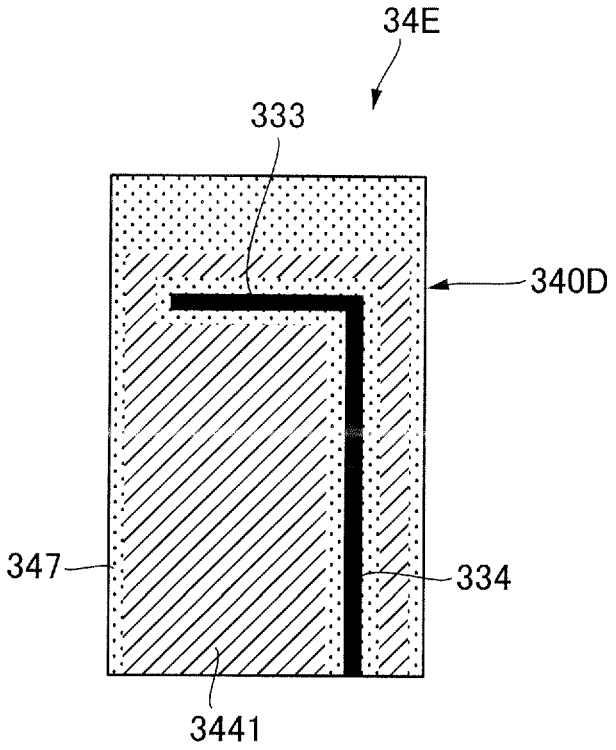

FIG. 58A is a plan view schematically showing a configuration of the latent image sensor of the twelfth embodiment.

Figure 58B:
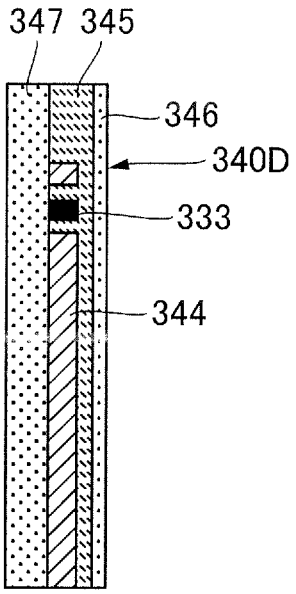

FIG. 58B is a section view of the latent image sensor of the twelfth embodiment.

Figure 59:
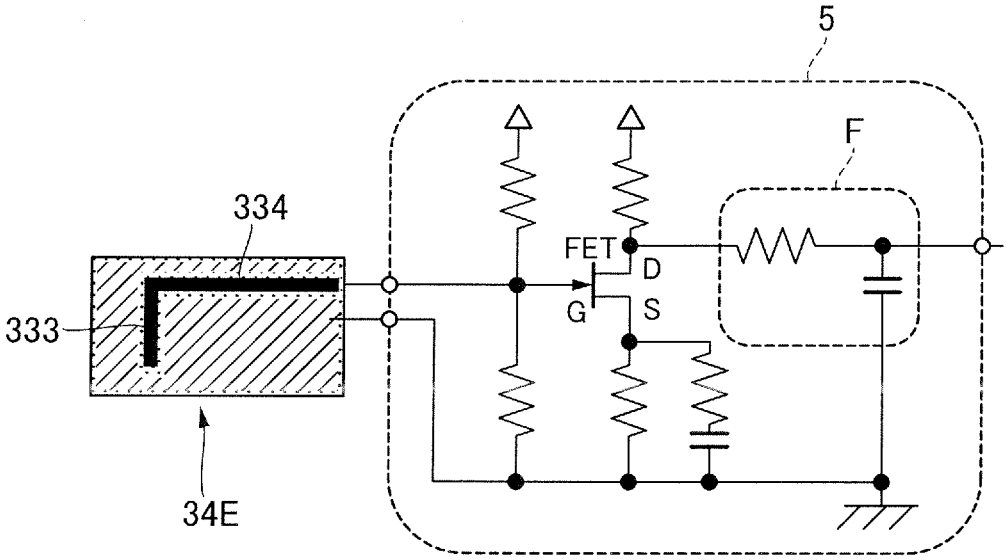

FIG. 59 is an amplifying electrical circuit connecting diagram of the latent image sensor of the twelfth embodiment.

Figure 60A:
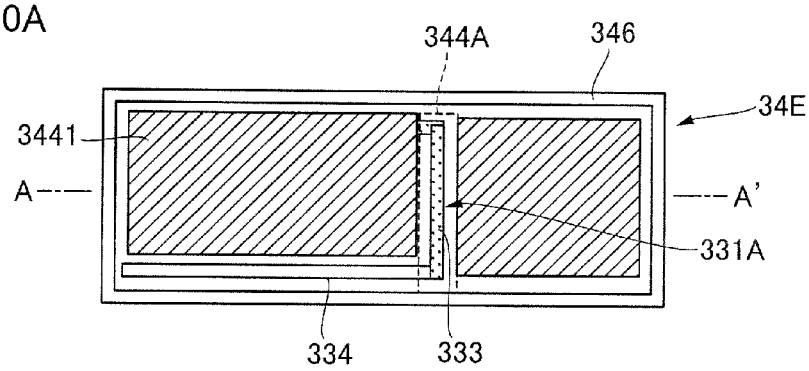

FIG. 60A is a plan view of the latent image sensor of the twelfth embodiment viewed from the intermediate transfer belt side.

Figure 60B:
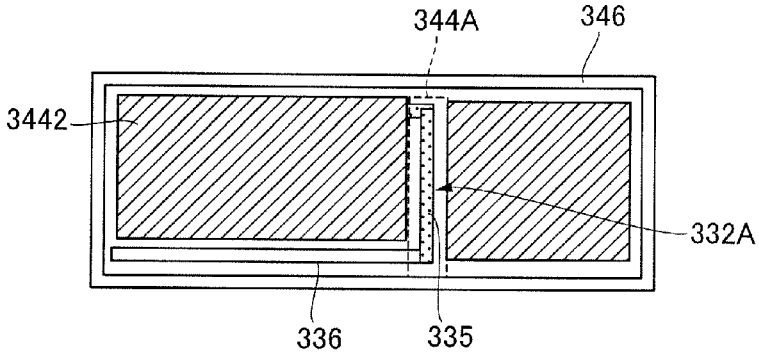

FIG. 60B is a plan view of the latent image sensor shown in FIG. 60A viewed from the photoconductive drum side.

Figure 60C:
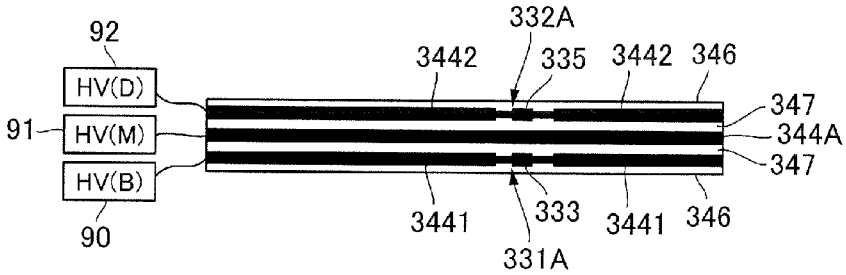

FIG. 60C is a section view taken along a line A-A' in FIG. 60A.

Figure 61:
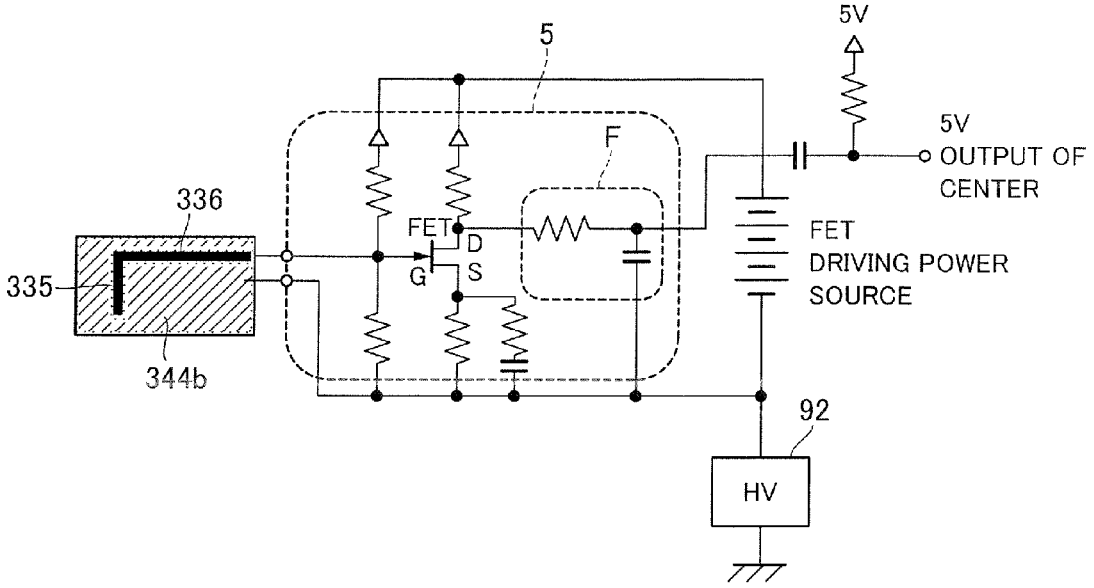
Figure 62:
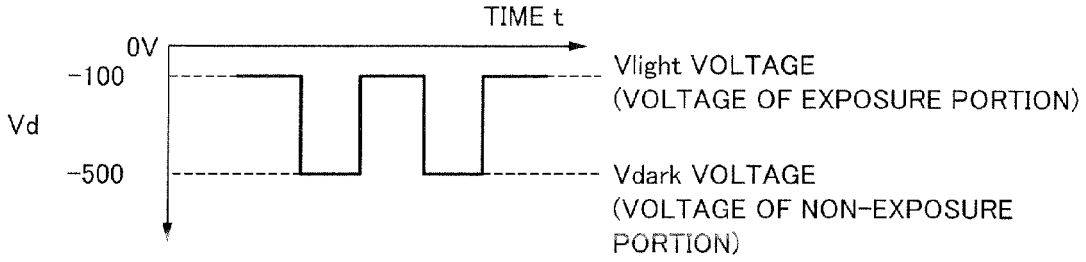

FIG. 61 is a circuit diagram in which a power supply is connected to the amplifying electrical circuit connecting diagram of the latent image sensor shown in FIG. 62.

FIG. 62 is a chart indicating a potential state of the surface of the photoconductive drum when the latent image graduation is formed.

Figure 63A:
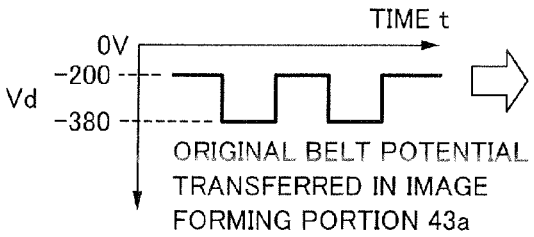

FIG. 63A is a chart indicating a potential state on the surface of the intermediate transfer belt to which the latent image graduation is transferred in the first image forming portion.

Figure 63B:
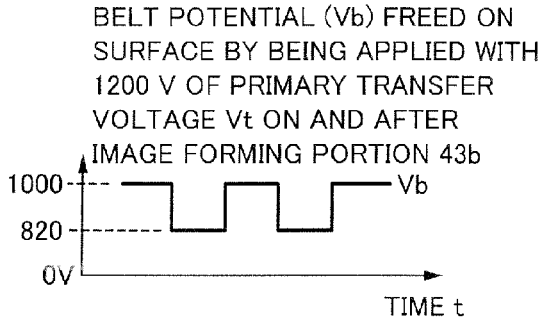

FIG. 63B is a chart indicating a potential state on the surface of the intermediate transfer belt to which a transfer bias is applied in the second image forming portion.

Figure 64:
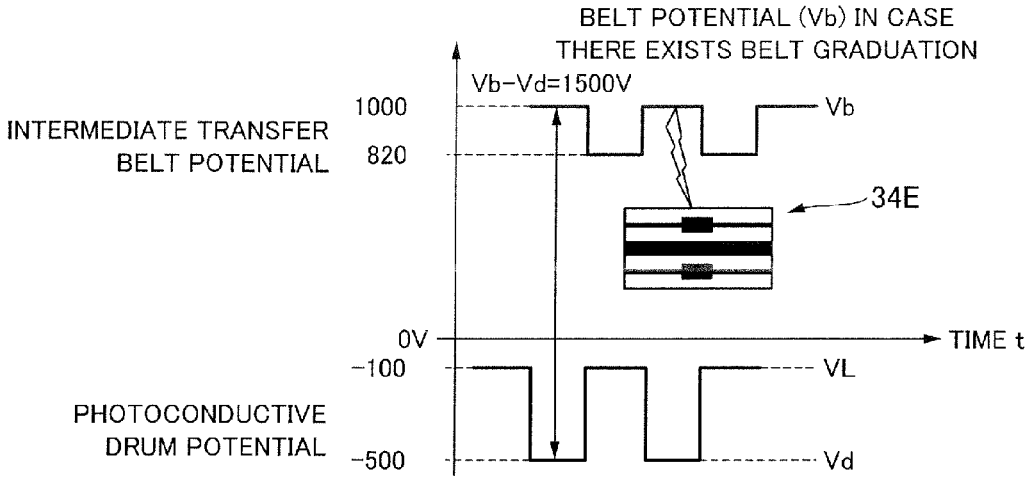

FIG. 64 is a schematic diagram indicating a potential difference in detecting the latent image graduation of the photoconductive drum and the latent image graduation of the intermediate transfer belt by the latent image sensor on and after the second image forming portion.

Figure 65:
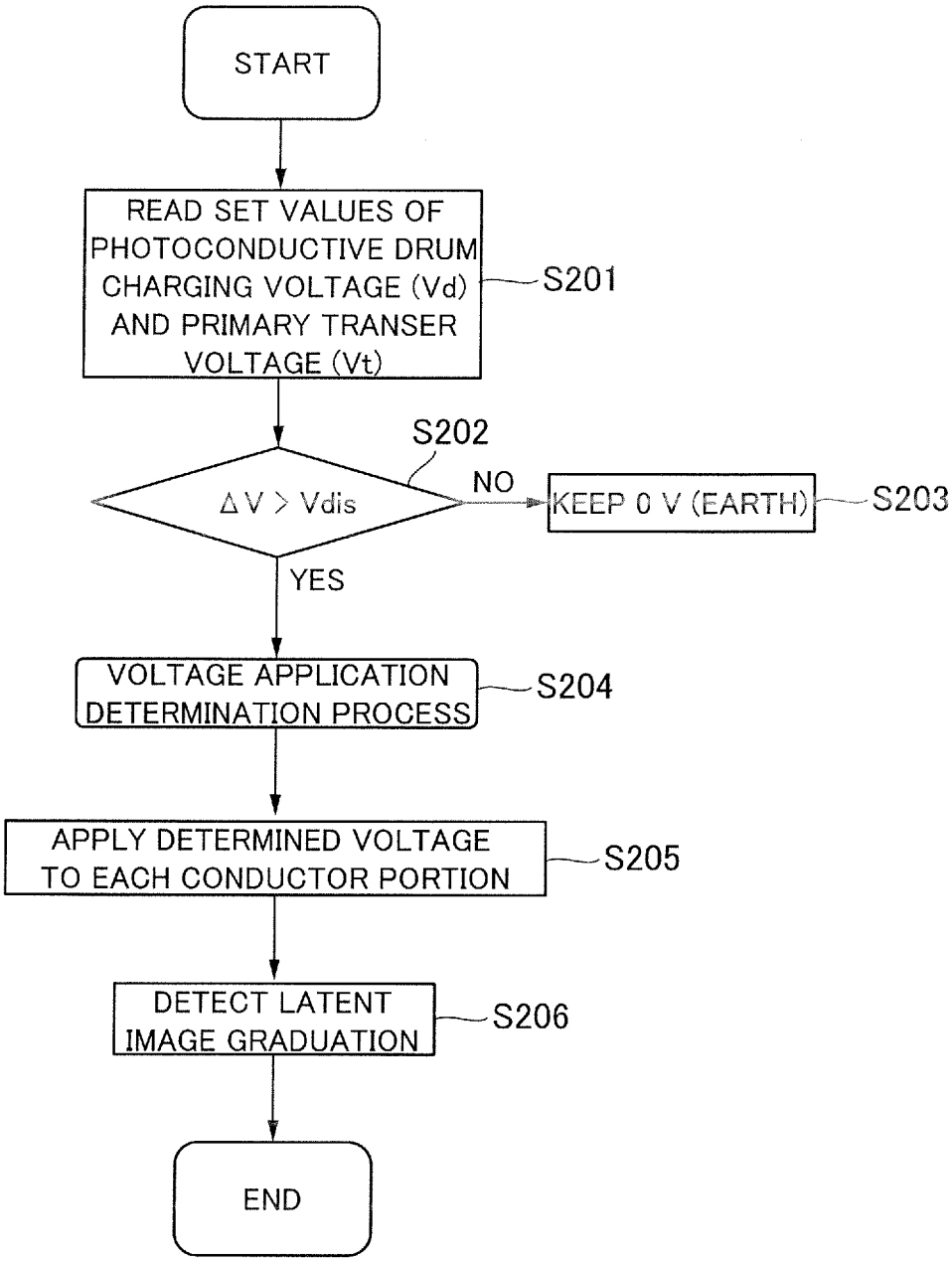

FIG. 65 is a flowchart showing a basic process in applying a voltage to the latent image sensor in the twelfth embodiment.

Figure 66:
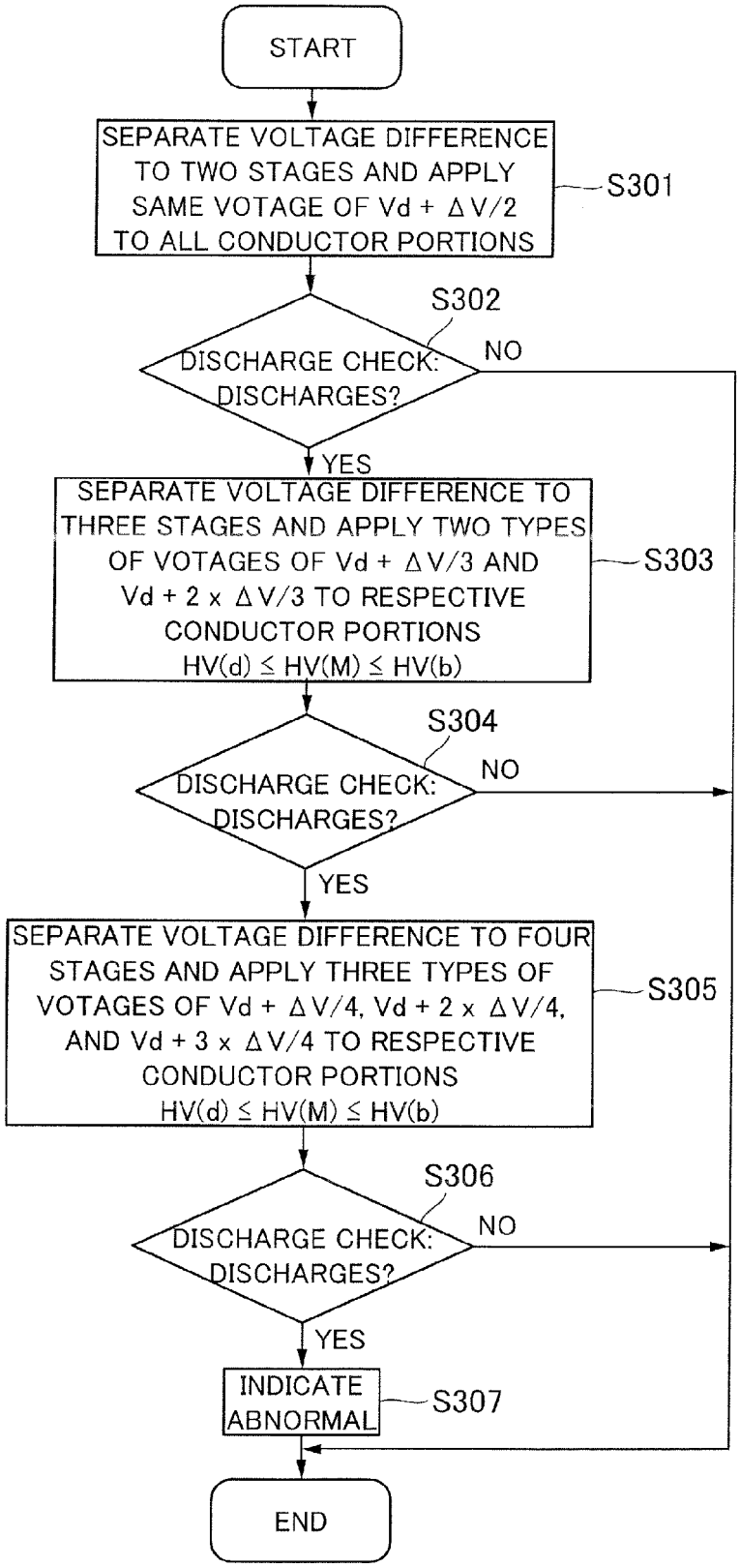

FIG. 66 is a flowchart showing a process of determining the voltage applied to the latent image sensor in the twelfth embodiment.

Figure 67:
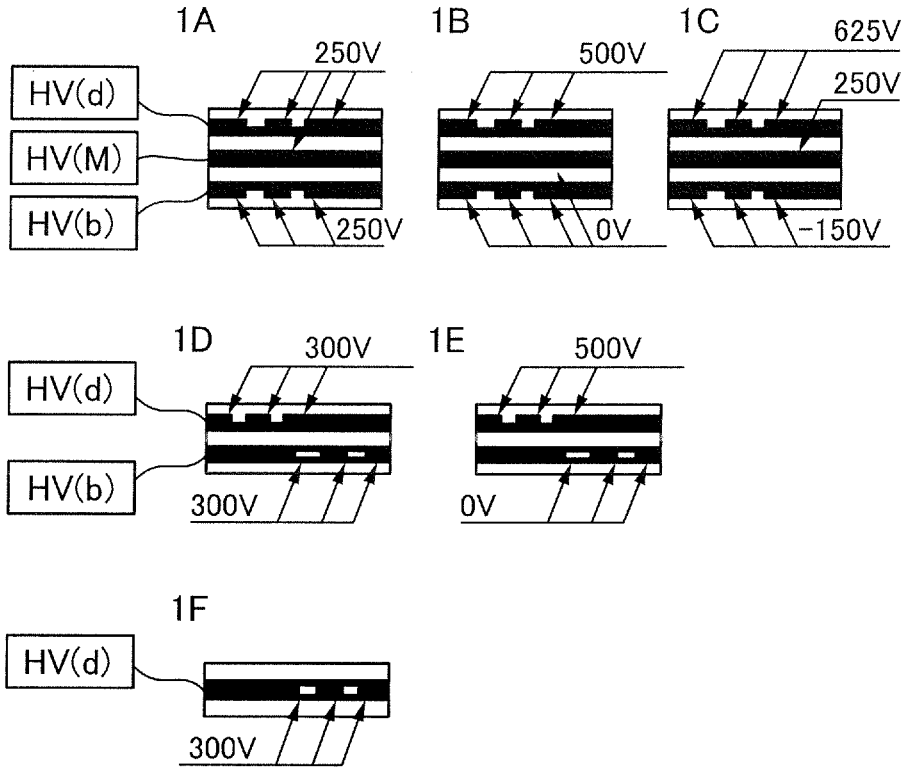

FIG. 67 is a schematic diagram showing a plurality of examples of voltages applied to the latent image sensor in the twelfth embodiment.

Figure 68:
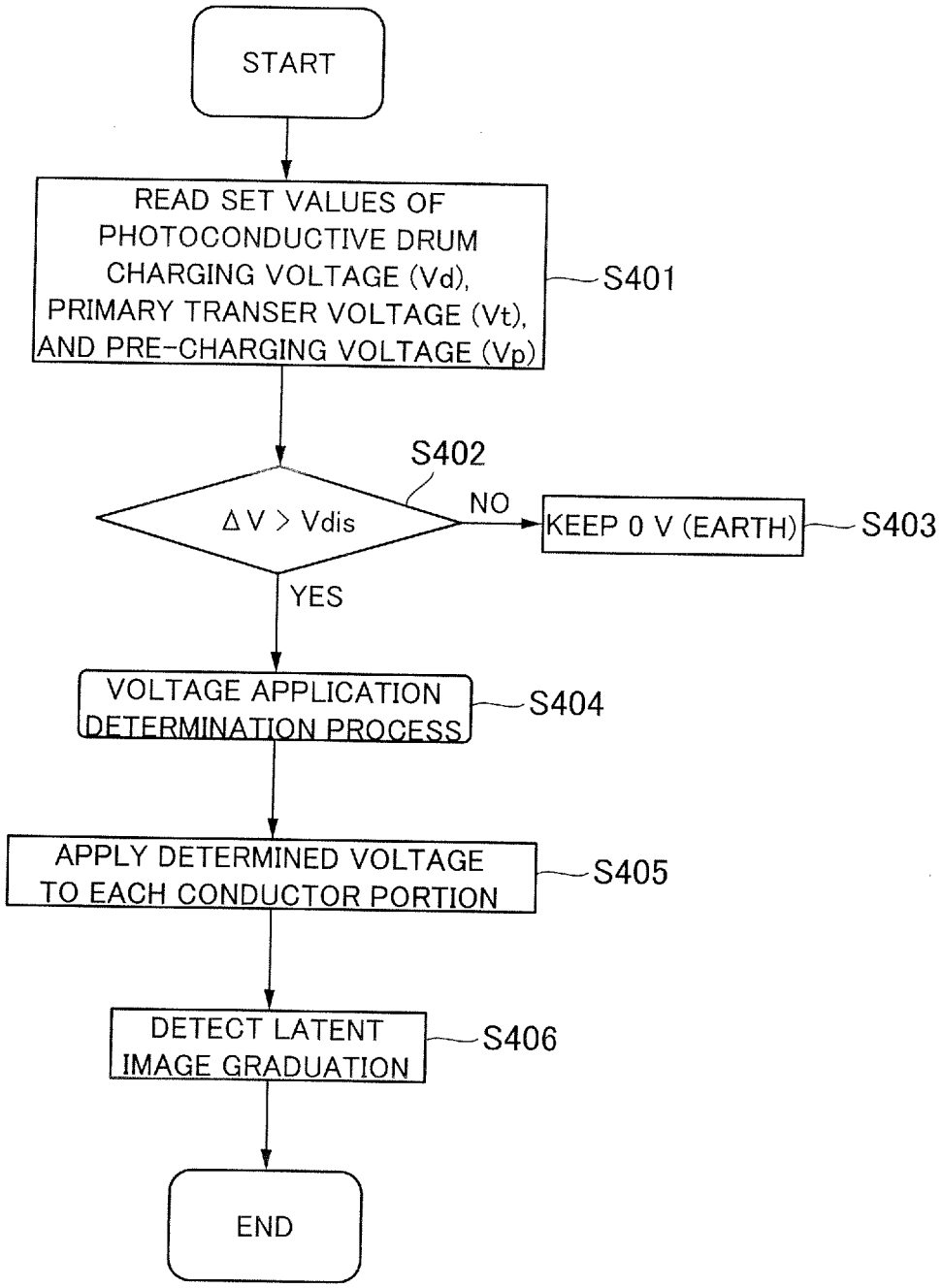

FIG. 68 is a flowchart showing a basic process in applying a voltage to the latent image sensor and the intermediate transfer belt in a thirteenth embodiment of the invention.

Figure 69:
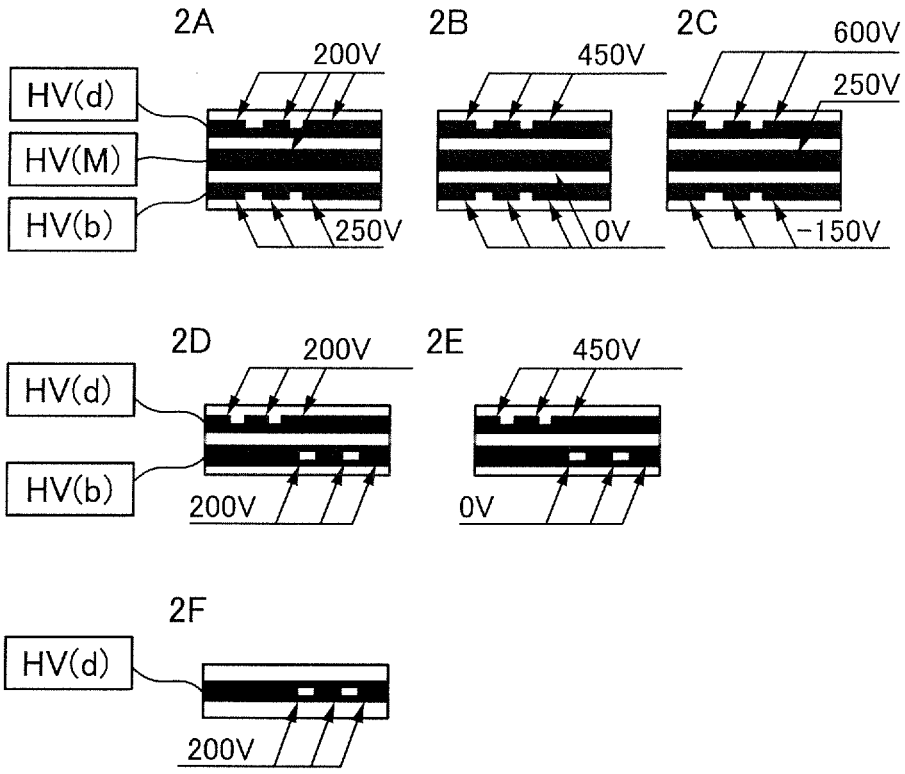

FIG. 69 is a schematic diagram showing a plurality of examples of voltages applied to the latent image sensor in the thirteenth embodiment.

Figure 70:
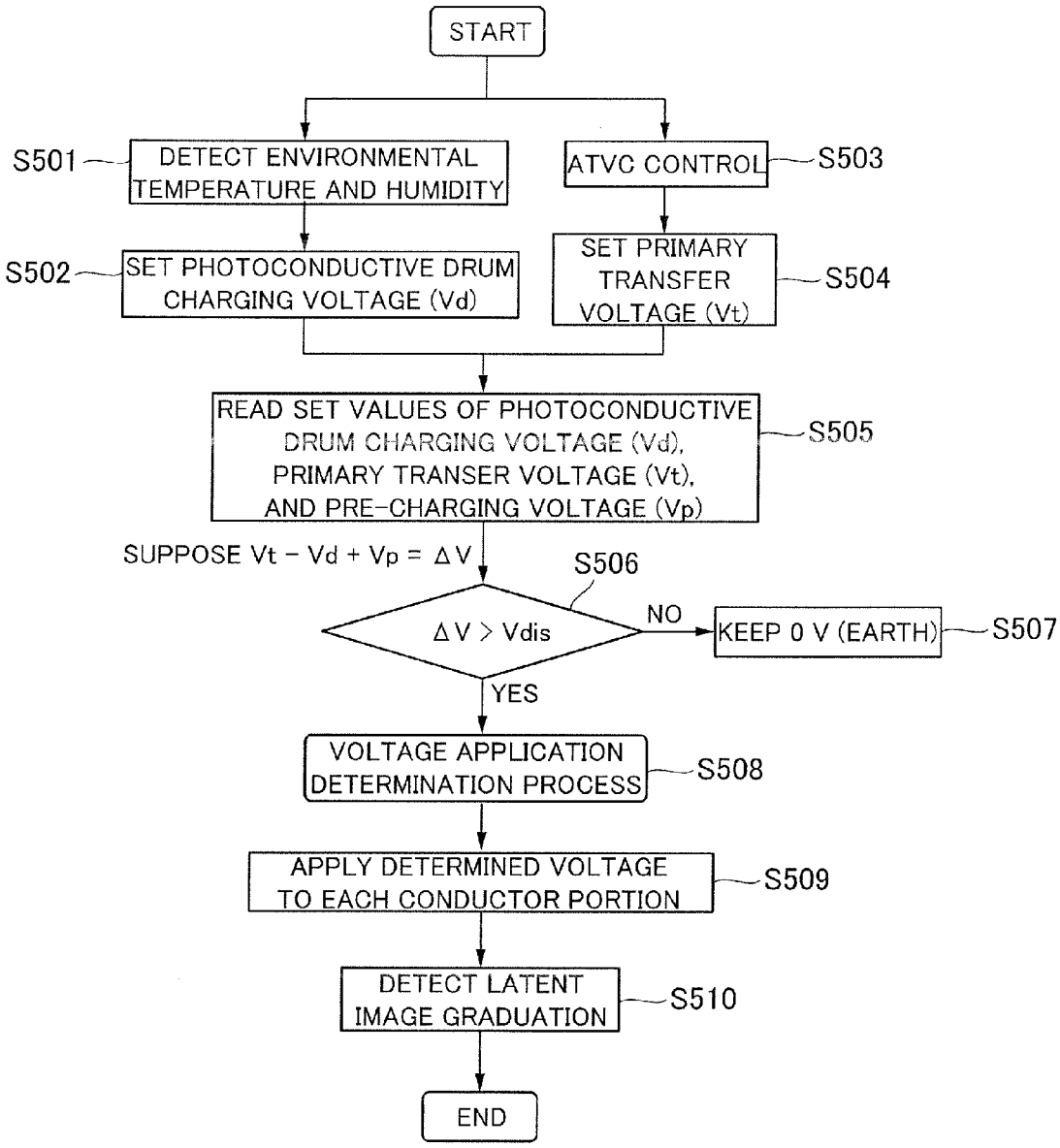

FIG. 70 is a flowchart showing a basic process in applying a voltage to the latent image sensor and the intermediate transfer belt in a fourteenth embodiment of the invention.

DESCRIPTION OF THE EMBODIMENTS

First Embodiment

A first embodiment of the present invention will be explained with reference to FIGS. 1 through 7. A schematic structure of an image forming apparatus of the present embodiment will be explained first with reference to FIG. 1A.

[Image Forming Apparatus]

The image forming apparatus 100 of the present embodiment is a so-called tandem type image forming apparatus in which a plurality of image forming portions 43*a*, 43*b*, 43*c* and 43*d* is arrayed in a direction in which an intermediate transfer belt 24, i.e., a conveyance body, travels (referred to as a 'conveying direction' hereinafter). The image forming portions 43*a*, 43*b*, 43*c* and 43*d* form toner images of yellow, magenta, cyan and black, respectively. Although not shown in detail in FIG. 1A, each image forming portion includes a photoconductive drum 12*a*, 12*b*, 12*c* or 12*d*, i.e., an image carrier, and forms the toner image of each color on each photoconductive drum.

Then, the image forming apparatus forms a full-color toner image by transferring and superimposing toner images formed respectively on the photoconductive drums 12*a*, 12*b*, 12*c* and 12*d* to the intermediate transfer belt 24 at the primary transfer portions T1a, T1b, T1c, and T1d, respectively. The intermediate transfer belt 24 is stretched around a driving roller 36, a driven roller 37 and a secondary transfer roller 38 and travels in a direction of arrows in FIG. 1A as the driving roller 36 is driven by a motor not shown. The toner image formed on the intermediate transfer belt 24 is transferred to a recording medium such as a sheet of paper, an OHP sheet and the like at a second transfer portion T2. The recording medium is conveyed to the secondary transfer portion T2 in synchronism with the toner image transferred on the intermediate transfer belt 24 by a recording medium conveying unit not shown.

A structure of the image forming portion will be explained by exemplifying an image forming portion 43*b* and by using FIG. 1B. It is noted that the structure of each image forming portion is substantially the same except that the color of toner used therein is different and that the most upstream image forming portion 43*a* has no latent image sensor described later. In forming an image, a surface of the photoconductive drum 12*b* is charged to a predetermined potential by a charging roller 14*b*, i.e., a charge portion. Next, an exposure unit 16*b*, i.e., an exposure portion, irradiates a laser beam on a basis of image information to form an electrostatic latent image on the surface of the photoconductive drum 12*b*. Then, a developing unit 15*b*, i.e., a developing portion, develops the electrostatic latent image by toner to form a toner image on the surface of the photoconductive drum 12*b*. This toner image is primarily transferred to the intermediate transfer belt 24 by a predetermined primary transfer bias applied between the photoconductive drum 12*b* and a primary transfer roller 4*b*, i.e., a transfer portion, disposed at a position facing the photoconductive drum 12*b* through the intermediate transfer belt 24. A cleaning device 17*b* removes the toner remaining on the surface of the photoconductive drum 12*b* after the primary transfer.

These charging roller 14*b*, the exposure unit 16*b*, and the developing unit 15*b* compose the image forming portion. A charging roller in the image forming portion 43*a* corresponds to a first charge portion, an exposure unit therein corresponds to a first exposure portion, a developing unit therein corresponds to a first developing unit, respectively, and a first image forming portion is composed of them. Each charging roller in each of the image forming portions 43*b*, 43*c* and 43*d* corresponds to a second charge portion, an exposure unit therein corresponds to a second exposure portion, a developing unit therein corresponds to a second developing unit, respectively, and the second image forming portion is composed of them. Still further, a primary transfer roller 4*a* in the image forming portion 43*a* corresponds to a first transfer portion, and each of the primary transfer rollers 4*b*, 4*c*, and 4*d* in the image forming portions 43*b*, 43*c* and 43*d* corresponds to a second transfer portion, respectively.

[Position Information of Image]

Thus, the toner image of each color is formed in each image forming portion and is superimposed and transferred on the intermediate transfer belt 24. At this time, in order to register positions of the respective color toner images at the respective primary transfer portions, position information related to the positions of the images is formed on the intermediate transfer belt 24 and on the respective photoconductive drums and the position information is detected to register the images and to reduce a color shift. In the present embodiment, such position information is latent image graduations formed respectively of electrostatic latent images. Still further, in a case of the present embodiment, the latent image graduation of the intermediate transfer belt 24 is formed by a latent image graduation formed on the photoconductive drum 12*a*, i.e., the most upstream first image carrier, and transferred to the intermediate transfer belt 24. Meanwhile, latent image graduations of the photoconductive drums 12*b*, 12*c*, and 12*d*, i.e., the second image carriers, on the downstream of the photoconductive drum 12*a* in the conveying direction of the intermediate transfer belt 24 are not transferred to the intermediate transfer belt 24.

Such latent image graduations are formed in a non-image region being out of an image region in which the toner image is formed as described above. That is, the non-image region is a region being out of the image region in a width direction intersecting the conveying direction of the photoconductive drum and the intermediate transfer belt among the surfaces of the respective photoconductive drums 12*a* through 12*d* and the intermediate transfer belt 24. In the present embodiment, both end portions in the width direction of the photoconductive drums and the intermediate transfer belt are set as the non-image regions, respectively. The latent image graduation 50 formed in the non-image region 250 of the intermediate transfer belt 24 corresponds to first position information, and latent image graduations 31*b*, 31*c* and 31*d* formed on the photoconductive drums 12*b*, 12*c*, and 12*d* correspond to second position information, respectively. The latent image graduation 31*a* formed on the photoconductive drum 12*a* corresponds to the first position information, and the latent image graduation 50 is formed by this latent image graduation 31*a* being transferred to the intermediate transfer belt 24.

Disposed upstream the photoconductive drum 12*a* in terms of the conveying direction of the intermediate transfer belt 24 are an erasure roller 53 and a counter electrode 52 as an erasure portion that erases the latent image graduation 50 formed on the intermediate transfer belt 24. The erasure roller 53 is disposed to be in contact with the non-image region 250 of the intermediate transfer belt 24 and erases the latent image graduation 50 formed in the non-image region 250 by applying a predetermined erasure bias between the erasure roller 53 and the counter roller 52.

The non-image region 250 in which the latent image graduation 50 is formed is composed of a highly resistant material whose volume resistivity is $10^{14}$ Ω·cm or more layered at the end portion of the surface or back of the intermediate transfer belt 24. Such a highly resistant material may be any material as long as it can be formed on the intermediate transfer belt and may be a resin material such as PTFE (polytetrafluoroethylene), PET (polyethylene terephthalate), and polyimide. The latent image graduation 50 transferred to the non-image region 250 is kept until at least when it reaches the most downstream photoconductive drum 12*d*.

[Formation of Latent Image Graduation]

A method for forming the latent image graduation 50 will be specifically described below. In forming the toner image on the surface of the photoconductive drum in the image forming portion 43*a*, the latent image graduation 31*a* is formed by a laser beam irradiated before and after writing the image by the exposure unit in the non-image region being out of the image region of the photoconductive drum 12*a*. Then, the latent image graduation 31*a* comes into contact with the non-image region provided on the both end portions of the surface of the intermediate transfer belt 24 at the primary transfer portion T1a. At this time, the toner image is transferred to the image region of the intermediate transfer belt 24 by the toner transferring primary transfer roller 4*a* extended to the non-image region and charged with the primary transfer bias (potential Vt). Simultaneously with that, a part of the charge forming the latent image graduation 31*a* is transferred to the non-image region 250, and the latent image graduation 50 is transferred. Accordingly, in the case of the present embodiment, a first position information forming portion forming the latent image graduation 50 on the intermediate transfer belt 24 as the first position information is composed of the exposure unit and the primary transfer roller 4*a* of the image forming portion 43*a*. At this time, the exposure unit of the image forming portion 43*a* corresponds to the first position information forming portion and the primary transfer roller 4*a* corresponds to an information transfer portion, respectively. The primary transfer roller 4*a* functions also as the information transfer portion in the present embodiment.

The first position information forming portion forms the latent image graduation 31*a* by arraying a plurality of first lines in parallel with the width direction intersecting the conveying direction in the conveying direction of the photoconductive drum 12*a* on the surface of the photoconductive drum 12*a* by the exposure unit, i.e., an information writing portion. That is, these plurality of first lines is formed as an electrostatic latent image to be utilized as the latent image graduation 31*a*, i.e., the first position information described above. Then, the latent image graduation 31*a* formed as described above is transferred to the intermediate transfer belt 24 by the primary transfer roller 4*a* and becomes the latent image graduation 50.

The exposure unit 16*b* as the second position information forming portion forms the latent image graduation 31*b* by arraying a plurality of second lines in parallel with the width direction intersecting the conveying direction in the conveying direction of the photoconductive drum 12*b* on the surface of the photoconductive drum 12*b*. That is, these plurality of second lines is formed as an electrostatic latent image to be utilized as the latent image graduation 31*b*, i.e., the second position information described above. A detailed description of the latent image graduation 50 composed of these plurality of first lines and the latent image graduation 31*b* composed of the plurality of second lines will be made later.

It is noted that the non-image region of the photoconductive drum 12*a* on which the latent image graduation 31*a* is formed may be located only at one side of the drum or at both ends of the drum. It is noted that if it is desirable to set the applied bias separately for transferring the toner and for transferring the latent image graduation, a latent image transfer roller 51 for transferring the latent image graduation may be separated coaxially from the primary transfer roller 4*a* for transferring the toner as shown in FIG. 1C. In this case, the latent image transfer roller 51 corresponds to the information transfer portion.

Figure 1A:
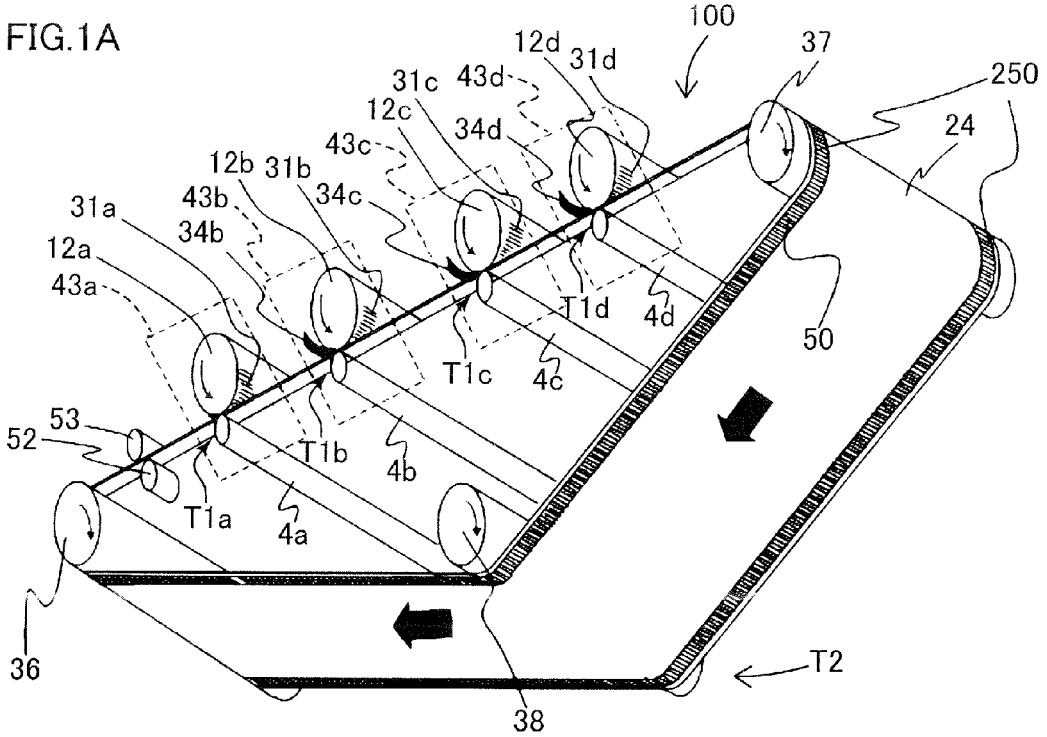
FIG. 1A is a schematic perspective view showing a part of an image forming apparatus according to a first embodiment of the invention.
Figure 1B:
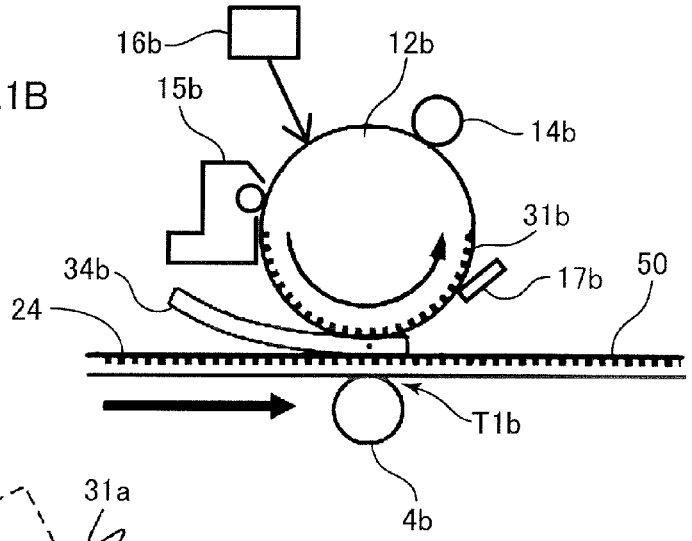
FIG. 1B is a schematic enlarged section view showing a part around a second image forming portion of the image forming apparatus of the first embodiment.
Figure 1C:
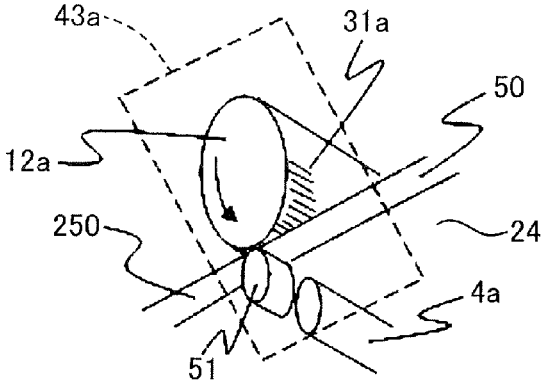
FIG. 1C is a schematic perspective view showing an another example of a transfer structure of a latent image graduation in a first image forming portion of the image forming apparatus of the first embodiment.

Meanwhile, in the image forming portion 43*b* in FIG. 1A, both the latent image graduation 31*b* on the photoconductive drum 12*b* and the latent image graduation 50 on the non-image region 250 provided on the intermediate transfer belt 24 are read by using a latent image sensor 34B that is configured to read the latent image graduations. FIG. 1B is a section view of the image forming portion 43*b* seen from an axial direction of the photoconductive drum, wherein the latent image sensor 34*b* is disposed such that the latent image sensor 34*b* is nipped at a nip position between the photoconductive drum 12*b* and the intermediate transfer belt 24. Latent image sensors 34*c* and 34*d* are also disposed so as to be nipped at nip portions between the photoconductive drums 12*c* and 12*d* and the intermediate transfer belt 24, respectively, in the same manner in the image forming portions 43*c* and 43*d*. A specific structure of these latent image sensors 34*b*, 34*c*, and 34*d* will be described later, and a control for correcting a position shift (color shift) of the image carried out by reading the latent image graduations 31*b* and 50 by these latent image sensors will be schematically described at first.

[Correction of Color Shift]

A color shift of each color is corrected in forming the color toner image on the intermediate transfer belt 24. To that end, the latent image sensor 34*b* reads changes of a potential of the latent image graduation corresponding to the toner image by a latent image detecting probe therein to calculate an amount of deviation of the graduations between the drum and the belt. Next, in response to the calculated amount of deviation, the photoconductive drum 12*b* is controlled such that the positions of the graduations of the drum and the belt coincide with each other. That is, the toner image is transferred while controlling the photoconductive drum 12*b* such the toner image formed on the intermediate transfer belt 24 from the photoconductive drum 12*b* of the image forming portion 43*b* is registered to the toner image formed on the intermediate transfer belt 24 in the image forming portion 43*a*.

The similar detection is carried out also in the image forming portions 43*c* and 43*d* in FIG. 1A, and the photoconductive drums 12*c* and 12*d* are controlled just before transferring toner to the intermediate transfer belt 24 such that the graduations of the corresponding drum and the belt are always registered with each other.

The erasure roller 53 and the counter electrode 52 erasing the graduation are provided to initialize the belt potential in the non-image region 250 of the latent image graduation on the intermediate transfer belt and are arranged to be able to superimpose and apply AC and DC potentials. Then, they are used to erase the previously transferred latent image graduation, i.e., to smooth irregularities of the potential on the belt, by using a sine wave, a rectangular wave, a pulse wave, or the like.

The erasure roller 53 and the counter electrode 52 may be disposed at any position after the most downstream image forming portion 43*d* and before the most upstream image forming portion 43*a*. However, the position just before the most upstream image forming portion 43*a* is desirable in order to reduce a possibility that a potential state of the surface of the belt is changed by being affected by external noise and others during the travel of the intermediate transfer belt. Note that it is also possible to use a different part such as a corona charger to erase the latent image graduation.

Thereby, it becomes possible to correct an amount corresponding to the color shift of the toner image on the intermediate transfer belt in high precision by using the latent image graduations on the drum and the belt and to provide the color image forming portion which causes less color shift. It is noted that it is possible to select if the latent image graduation 50 is to be transferred on the surface side or the back side of the intermediate transfer belt 24 in accordance to characteristics of the latent image forming process and to specifications of a product including the photoconductive drums and the intermediate transfer belt.

[Principle for Detecting Latent Image Graduation]

Next, a principle for detecting the latent image graduation by the latent image sensor will be described by exemplifying a case in detecting in the image forming portion 43*b* and by using FIGS. 2A through 2F. The latent image sensor has a latent image detecting probe 330 composed of a conductor such as copper (referred to simply as a 'probe 330' hereinafter: corresponds to signal detecting portions 333 and 335 described later). It is noted that the principle for detecting the latent image graduation will be explained here with the graduation and the probe vertical to a drum rotational direction.

FIGS. 2A through 2D show only one latent image graduation 31*b*. The probe 330 is connected to a detecting amplifying electrical circuit 5. The latent image graduation 31*b* exists as a potential difference on the surface of the photoconductive drum 12*b*, and the probe 330 is provided at a position slightly separated (several μm to several tens μm) from the surface of the photoconductive drum 12*b*. In FIGS. 2A through 2D, the probe 330 moves relatively with the latent image graduation 31*b* temporally from A to B to C and D while keeping a certain distance from the surface of the photoconductive drum 12*b*. The potential of the latent image graduation 31*b* is denoted as plus in FIGS. 2A through 2D because a case where a periphery of the latent image graduation 31*b* is charged to minus 500 V and the latent image graduation 31*b* is charged to minus 100V is supposed here.

Figure 2A:
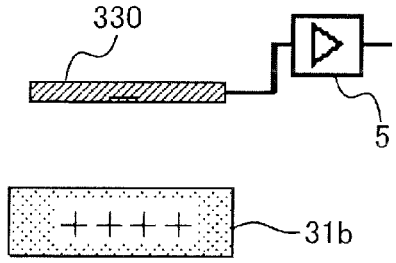
FIG. 2A is a schematic diagram illustrating a mutual relationship of potential at a relative position of a probe and a graduation for explaining a principle for detecting a latent image graduation by a latent image detecting probe of the first embodiment.
Figure 2B:
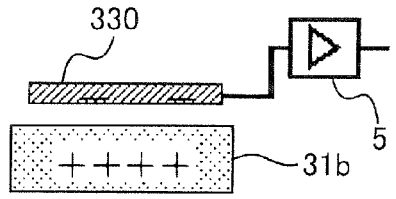
FIG. 2B is a schematic diagram illustrating a condition in which the probe is moved from a condition in FIG. 2A.
Figure 2C:
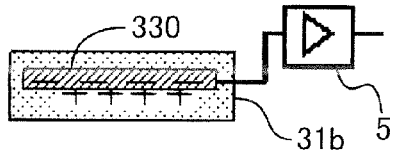
FIG. 2C is a schematic diagram illustrating a condition in which the probe is moved further from the condition in FIG. 2B.
Figure 2D:
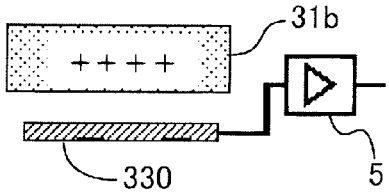
FIG. 2D is a schematic diagram illustrating a condition in which the probe is started to be separated from the condition in FIG. 2C.
Figure 2E:
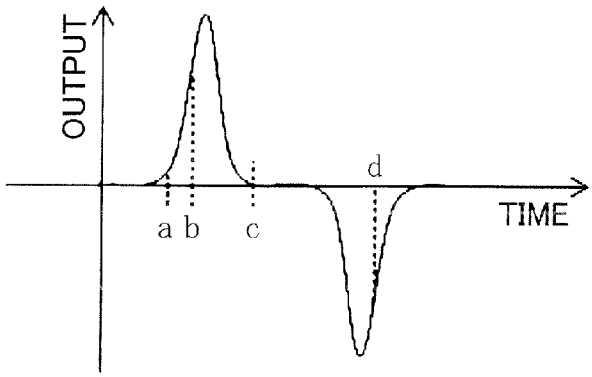
FIG. 2E shows one exemplary output signal detected when the probe is moved as shown in FIGS. 2A through 2D.
Figure 2F:
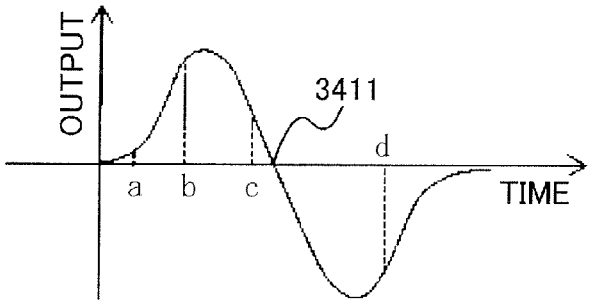
FIG. 2F shows another exemplary output signal detected when the probe is moved as shown in FIGS. 2A through 2D.

When the probe 330 approaches to the latent image graduation 31*b* as shown in FIG. 2A at first, free electrons within an electric wire from the probe 330 to the amplifying electrical circuit 5 are attracted slightly to the plus potential of the latent image graduation 31*b*. Next, when the probe 330 approaches further to the latent image graduation 31*b* as shown in FIG. 2B, the attracted free electrons increase. Next, when the probe 330 approaches most to the latent image graduation 31*b* as shown in FIG. 2C, an amount of the attracted free electrons increases most. When the probe 330 finally starts to separate from the latent image graduation 31 as shown in FIG. 2D, the free electrons that have been attracted start to return. It is possible to take out the position of the latent image graduation 31*b* as an electrical signal by detecting and outputting this flow of the free electrons (induction current) by the amplifying electrical circuit 5. FIGS. 2E and 2F are graphs indicating the outputs of the amplifying electrical circuit 5 at this time.

The output in FIG. 2E is different from that shown in FIG. 2F due to various conditions such as a width of the probe 330, a width of the latent image graduation 31*b*, a distance between the probe 330 and the latent image graduation 31*b*, relative speed of the probe 330 and the latent image graduation 31*b*, and others. In a case where the width of the latent image graduation 31*b* is wide, the output turns out to be a waveform as shown in FIG. 2E. The narrower the width of the latent image graduation 31*b*, the closer to a waveform in shown FIG. 2F the output is. The waveforms in FIGS. 2E and 2F will now be described. The output increases as the probe 330 approaches to the latent image graduation 31*b*, and the induction current is zeroed in a moment when the probe 330 overlaps with the latent image graduation 31*b* (approaches most) (zero-cross point 3411 in FIG. 2F). The output becomes minus as the probe 330 separates from the latent image graduation 31*b*, and the output signal is also zeroed as the probe 330 is gradually distant from the latent image graduation 31*b*. This zero-cross point 3411 is a moment when the probe 330 has passed through right above the latent image graduation 31*b*. This is the principle for detecting the latent image graduation 31*b* by the probe 330.

[Latent Image Sensor]

Figure 3A:
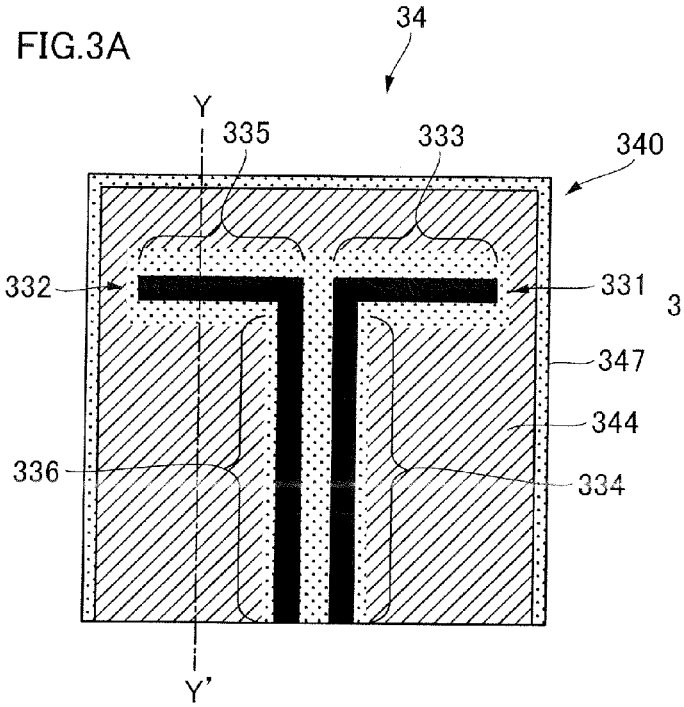
FIG. 3A is a plan view schematically showing a structure of a latent image sensor of the first embodiment.
Figure 3B:
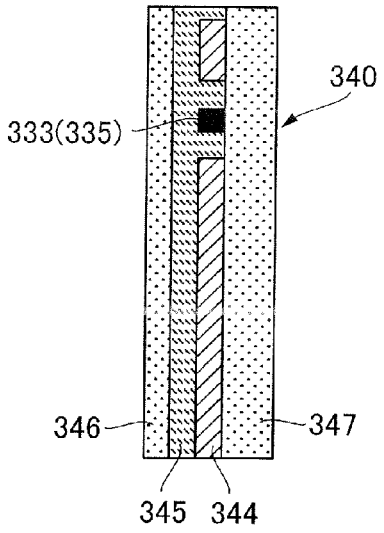
FIG. 3B is a section view schematically showing the structure of the latent image sensor of the first embodiment.
Figure 3C:
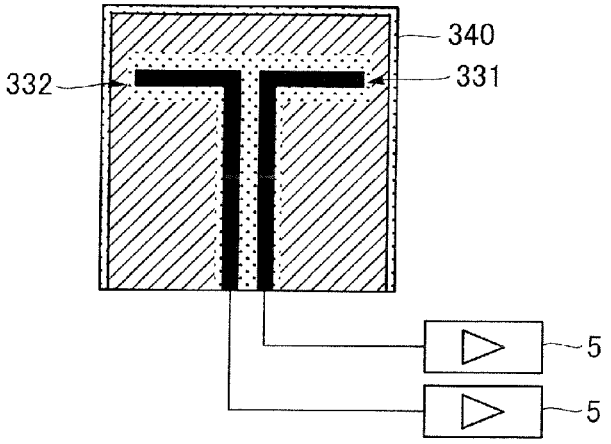
FIG. 3C is a connection diagram schematically showing an amplifying electrical circuit thereof.

Next, a specific structure of the latent image sensor as described above will be explained. It is noted that because the structures of the respective latent image sensors 34*b*, 34*c* and 34*d* are the same, the following explanation will be made by omitting subscripts appended to reference numerals of parts to indicate that the parts belong to the respective image forming portions, unless specifically required to append the subscripts (also in the following embodiments). In the present embodiment, the latent image sensor 34 is formed of a flexible print board. FIGS. 3A through 3C show this structure. The latent image sensor 34 in FIGS. 3A through 3C is a 'mono-layer flexible print board' used in wiring in ordinary electrical machineries, and copper patterns thereof form parts detecting latent images as position information. It is noted that although the flexible print board will be exemplified in the following explanation, any material may be used as long as a similar structure (insulative from a conductor) can be realized. FIG. 3A is a plan view of the latent image sensor 34, and FIG. 3B is a section view taken along a line Y-Y' in FIG. 3A.

The latent image sensor 34 has a first sensor portion 331 and a second sensor portion 332. The first sensor portion 331 includes a signal detecting portion 333 as a first information detecting portion and a signal transmitting portion 334. The second sensor portion 332 includes a signal detecting portion 335 as a second information detecting portion and a signal transmitting portion 336. The signal detecting portions 333 and 335 correspond to the probe 330 described above and detect the latent image graduations 31 and 50, respectively. The information detecting portion is also composed of the signal detecting portions 333 and 335. The signal transmitting portions 334 and 336 transmit detected signals. These signal detecting portions 333 and 335 and the signal transmitting portions 334 and 336 are composed of conductors, respectively, and are formed of the copper patterns described above in the case of the present embodiment. The signal detecting portions 333 and 335 are disposed colinearly in parallel with the width direction intersecting the conveying direction among the surface of the intermediate transfer belt 24. Thereby, if the latent image graduations 31 and 50 are detected simultaneously, the latent image graduations 31 and the latent image graduation 50 exist on one straight line. As shown in FIG. 3C, the first and second sensor portions 331 and 332 are connected with the amplifying electrical circuits 5, respectively, and the amplifying electrical circuits 5 amplify and output signals thus detected.

Such first and second sensor portions 331 and 332 detect changes of the signal outputted when the first and second lines of the latent image graduations 31 and 50 pass through positions facing the signal detecting portions 333 and 335 and explained in connection with FIG. 2. Thus, the first and second sensor portions 331 and 332 read the latent image graduations 31 and 50.

As shown in FIG. 3B, the latent image sensor 34 is layered such that a hold member 340 integrally holds the first and second sensor portions 331 and 332. The hold member 340 has a board 347 on which the signal detecting portions 333 and 335 and the signal transmitting portions 334 and 336 are printed on a surface thereof, a film-like cover 346 covering the surface of the board 347, and an adhesive 345 adhering the board 347 with the cover 346. The board 347 is provided with an earth 344 formed around the signal detecting portions 333 and 335 and the signal transmitting portions 334 and 336.

The earth 344 is composed of a conductor and is earthed. It is noted that the earth 344 is not always required to have an earth potential as long as it has an arbitrary constant potential. While the same applies also in the other following embodiments, the potential will be expressed as the "earth 344" for convenience in the following explanation.

The adhesive 345 enters gaps between the signal detecting portions 333 and 335, the signal transmitting portions 334 and 336, and parts around the earth 344 to adhere the board 347 with the cover 346. The board 347, the cover 346, and the adhesive 345 are composed of an insulating material such as a resin. For instance, the board 347 is composed of a polyimide board and the cover 346 is a polyimide film. Therefore, these board 347, the cover 346 and the adhesive 345 affect nothing in detecting the latent image graduation by the probe 330 as described with reference to FIG. 2.

The following are thicknesses of the respective parts. That is, the board 347 is 25 μm, the signal detecting portions 333 and 335, the signal transmitting portions 334 and 336, and the earth 344 are 9 μm, the cover is 12 μm, and a part of the adhesive excluding the earth 344 and others is 15 μm. A thickness of the whole latent image sensor 34 constructed as described above is preferably 50 to 70 μm. Thereby, the latent image sensor 34 barely affects the part where the image region of the photoconductive drum 12 comes into contact with the intermediate transfer belt 24 even if the latent image sensor 34 is nipped between the photoconductive drum 12 and the intermediate transfer belt 24 as described above. As a result, the existence of the latent image sensor 34 affects almost nothing to the transfer of a toner image from the photoconductive drum 12 to the intermediate transfer belt 24.

Next, how the latent image sensor 34 is installed will be explained with reference to FIGS. 4A through 4D. FIGS. 4A through 4D show the latent image sensor 34 by omitting the 'earth 344' shown in FIG. 3. The 'earth 344' will be omitted in the same manner also in installation diagrams of the sensor in the following other embodiments. The latent image graduations 31 and 50 are formed at different positions in terms of a main scan direction (in the width direction, in right and left directions in FIGS. 4A and 4C). The signal detecting portions 333 and 335 are also drawn on the board 347 of the hold member 340 at different positions in terms of the main scan direction. Thus, the latent image sensor 34 is configured such that the signal detecting portion 333 faces the latent image graduation 50 and the signal detecting portion 335 faces the latent image graduation 31, respectively, in a condition in which the latent image sensor 34 is installed. That is, the hold member 340 is configured such that it extends in the conveying direction of the intermediate transfer belt 24 to a transfer area in which a toner image is transferred from the photoconductive drum 12 to the intermediate transfer belt 24 such that the signal detecting portions 333 and 335 can detect the latent image graduations 50 and 31. In other words, the hold member 340 holds and positions the signal detecting portions 333 and 335 at the transfer area. It is noted that the 'transfer area' described here refers to an area in a vicinity of a primary transfer portion T1 and to an area where the signal detecting portions 333 and 335 can detect the latent image graduations 50 and 31.

Figure 4B:
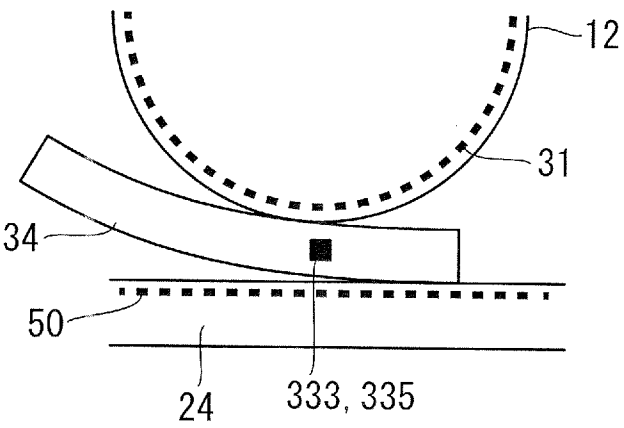
FIG. 4B is a section view of the latent image sensor of the first embodiment shown in FIG. 4A seen a main scan direction.
Figure 4D:
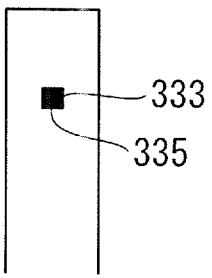
FIG. 4D is a section view of the latent image sensor of the first embodiment shown in FIG. 4D.
Figure 4A:
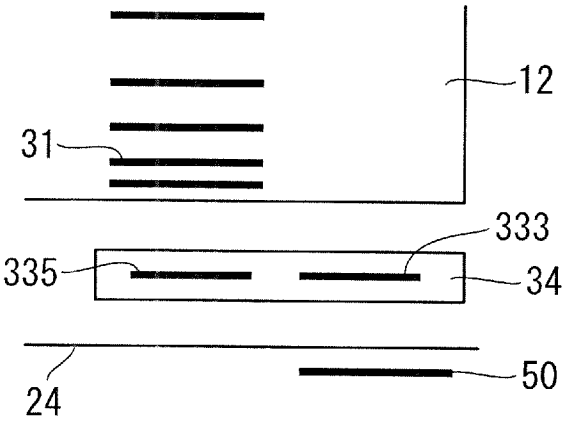
FIG. 4A is a schematic installation diagram of a latent image sensor of the first embodiment viewed from a sub-scanning direction.
Figure 4C:
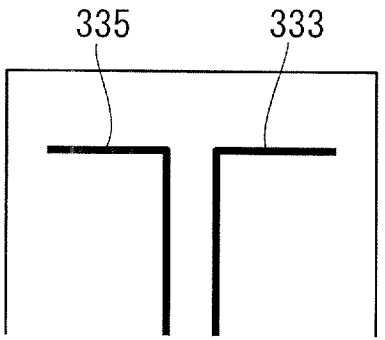
FIG. 4C is a schematic plan view of the latent image sensor of the first embodiment.

As shown in FIG. 4B, the latent image sensor 34 is installed in the condition in which the latent image sensor 34 is nipped by the photoconductive drum 12 and the intermediate transfer belt 24. The latent image sensor 34 is installed also such that the signal detecting portion 333 is in parallel with the latent image graduation 50 of the intermediate transfer belt 24 and the signal detecting portion 335 is in parallel with the latent image graduation 31 of the photoconductive drum 12, respectively. As shown also in a section view in FIG. 4B, the signal detecting portions 333 and 335 are installed in a nip position (primary transfer portion T1).

Figure 5A:
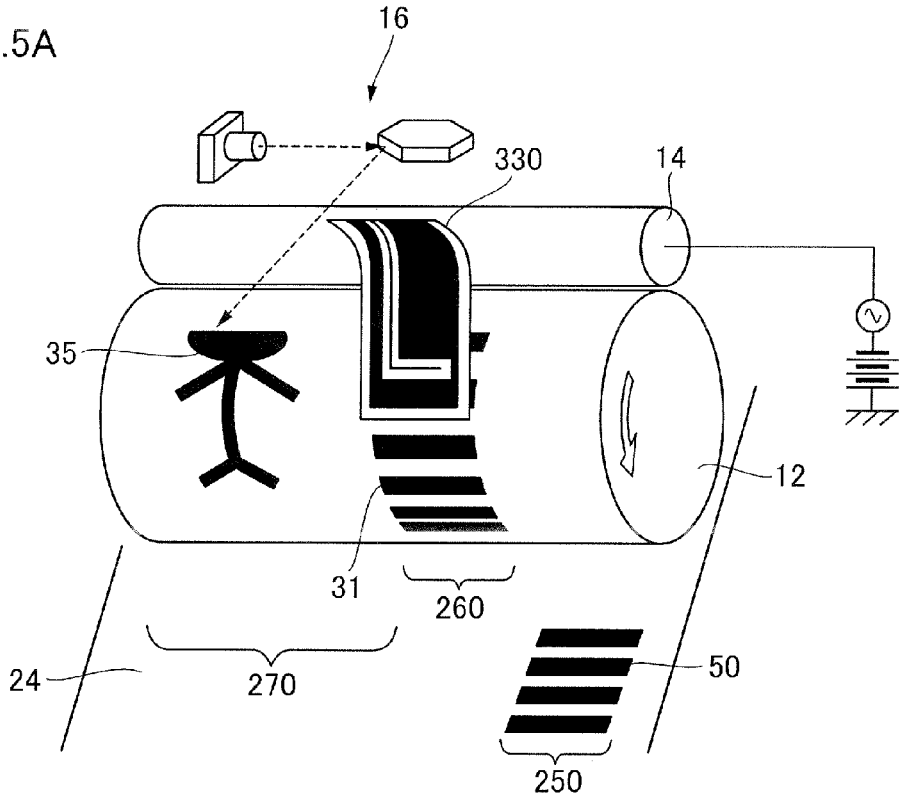
FIG. 5A schematically illustrates a manner of detecting the graduations on the photoconductive drum by the latent image sensor in the first embodiment.

Next, the operation for detecting the latent image graduation 31 on the photoconductive drum 12 will be explained in detail with reference to FIGS. 5A through 5C. The surface of the photoconductive drum 12 is charged to a predetermined potential by the charging roller 14 and is then exposed by the exposure unit 16. Then, an electrostatic latent image 35 based on image information is formed in an image region 270 of the photoconductive drum 12 and the latent image graduation 31 is formed in a non-image region 260, respectively. The electrostatic latent image 35 is developed to be a toner image by a developing unit not shown.

A surface potential of the non-image region 260 of the photoconductive drum 12 is of a same level of potential value with that of the image region 270. That is, in the latent image graduation 31, the potential value comes out as a square wave as shown in FIG. 5B whose low potential portion 342 is −500V and whose high potential portion 341 is −100V for example. When the surface potential of this square wave is detected by the latent image sensor 34, the surface potential is detected as a sine waveform having an amplitude centering on 0 (V) as shown in FIG. 5C. It is then possible to detect a zero-cross point 3411 in FIG. 5C as a center of a width of the latent image graduation 31. It is noted that FIG. 5A shows only a sensor part on a photoconductive drum side of the latent image sensor 34 showing a condition in which the latent image sensor 34 is not nipped with the intermediate transfer belt 24 for convenience.

Figure 5B:
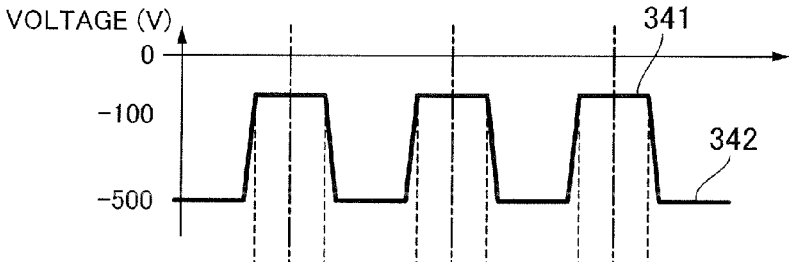
FIG. 5B is a chart indicating a potential state of the graduation in FIG. 5A.
Figure 5C:
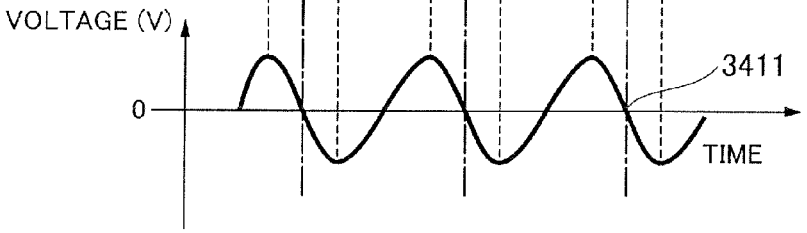
FIG. 5C is a chart indicating an output signal when the graduation in FIG. 5A is detected by the latent image sensor.

Similarly to what described above, regarding the latent image graduation 50 transferred to the intermediate transfer belt 24, a shape of distribution of a surface potential thereof also comes out like as shown FIG. 5B and a shape of an output waveform thereof comes out like as shown in FIG. 5C, so that it is possible to detect a center of a width of the latent image graduation 50.

Next, an operation for controlling color matching of the toner images of the present embodiment carried out by using the latent image graduations as described above will be described in detail with reference to FIGS. 6 and 7. It is noted that FIG. 6 only illustrates only a relationship between the image forming portions 43*a* and 43*b* in order to simplify the description, the same applies also to the image forming portions 43*c* and 43*d* in FIG. 1.

Figure 6:
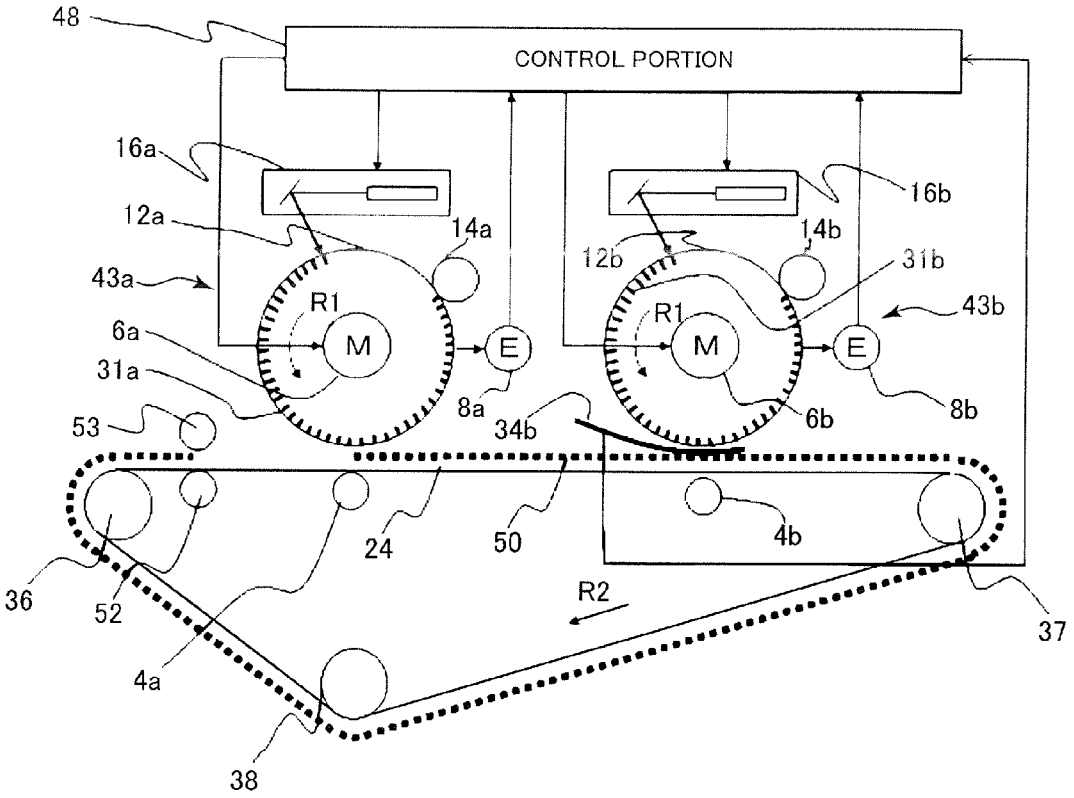
FIG. 6 is a schematic diagram illustrating a control operation in correcting a color shift by a relationship between two image forming portions according to the first embodiment.
Figure 7:
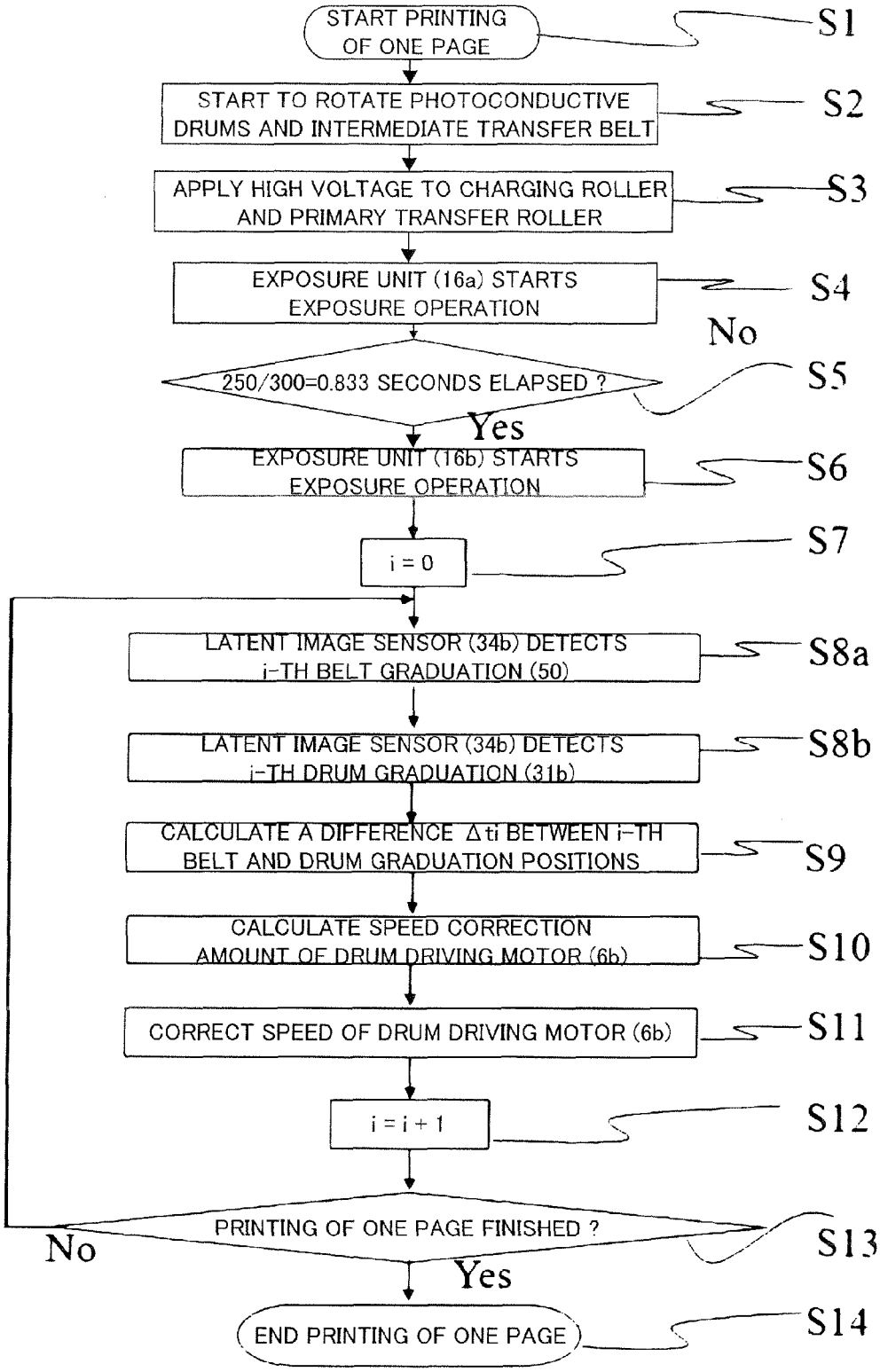
FIG. 7 is a control flowchart in correcting the color shift according to the first embodiment.

As shown in FIG. 6, the photoconductive drums 12*a* and 12*b* are rotationally driven by drum driving motors 6*a* and 6*b*, respectively. The drum driving motors 6*a* and 6*b* are provided with drum encoders 8*a* and 8*b*, respectively, and a control portion 48 controls rotational speeds of the drum driving motors 6*a* and 6*b* based on signals of the drum encoders 8*a* and 8*b*.

The latent image graduation 31*a*, i.e., the first position information, is written into the non-image region out of the image region (developing region) of a toner image in the main scan direction of the photoconductive drum 12*a* simultaneously with an electrostatic latent image (first latent image) based on image information by using the exposure unit 16*a*. Similarly to that, the latent image graduation 31*b*, i.e., the second position information, is written into the non-image region out of the image region in the main scan direction of the photoconductive drum 12*b* simultaneously with an electrostatic latent image (second latent image) based on image information by using the exposure unit 16*b*.

The first latent image on the photoconductive drum 12*a* is developed by a toner of a first color (yellow) supplied from the developing unit not shown. However, the latent image graduation 31*a* is not developed by the toner of the first color. In this state, 'the first latent image is transferred as a toner image of the first color' and 'the latent image graduation 31*a* is transferred while remaining as the latent image' from the photoconductive drum 12*a* to the intermediate transfer belt 24 at the same position in the sub-scan direction. 'The toner image of the first color' and 'the latent image graduation 50 formed by transferring the latent image graduation 31*a*' on the intermediate transfer belt 24 are then moved to a nip position where they come into contact with the photoconductive drum 12*b*.

The latent image sensor 34*b* is installed at the nip position sandwiched by the photoconductive drum 12*b* and the intermediate transfer belt 24 and detects 'the latent image graduation 31*b* and the latent image graduation 50'. The control portion 48 controls the drum driving motor 6*b* that rotationally drives the photoconductive drum 12*b* on a basis of a detection result of the latent image sensor 34*b*. Thereby, a toner image of a second color (magenta) of the photoconductive drum 12*b* is transferred and superimposed with the toner image of the first color that has been transferred from the photoconductive drum 12*a* to the intermediate transfer belt 24. That is, the first sensor portion 331 of the latent image sensor 34*b* reads the latent image graduation 50 and the second sensor portion 332 reads the latent image graduation 31*b*, respectively (see FIG. 4 and others). From the information thus read, the control portion 48 controls the rotation of the photoconductive drum 12*b* such that the toner image of the second color coincides with a position of the toner image of the first color in transferring the toner image of the second color from the photoconductive drum 12*b* to the intermediate transfer belt 24.

This control will be explained more specifically by using a flowchart in FIG. 7. By receiving a print starting signal in Step 1, the control portion 48 starts the drum driving motors 6*a* and 6*b* and a belt driving motor not shown in Step 2. The control portion 48 controls the drum driving motors 6*a* and 6*b* at a constant speed while reading the signals of the drum encoders 8*a* and 8*b* directly connected to a drum driving shaft to rotate the photoconductive drums 12*a* and 12*b* at a constant speed in a direction of arrows R1. In the same manner, the control portion 48 rotationally drives the belt driving motor at a constant speed to rotate the intermediate transfer belt 24 at a constant speed in a direction of an arrow R2 by the driving roller 36.

Next, the control portion 48 applies a charging voltage to the charging rollers 14*a* and 14*b* to charge the surfaces of the photoconductive drums 12*a* and 12*b* to −600 V for example. The control portion 48 also applies a predetermined voltage set in advance to the primary transfer rollers 4*a* and 4*b* in Step 3.

Next, by receiving an image signal, the control portion 48 starts an exposure operation by the exposure unit 16*a* in Step 4. The control portion 48 also forms the latent image graduation 31*a* with a predetermined pitch from a front end margin part. After starting the exposure operation of the image data, the control portion 48 continues the exposure operation until when one page of image data is finished to be exposed together with the latent image graduation 31*a*.

Next, when 0.833 seconds elapses, i.e., Yes in Step 5, from the start of the exposure operation of the exposure unit 16*a*, the control portion 48 starts an exposure operation of the exposure unit 16*b* in Step 6. In the present embodiment, an outer diameter of the photoconductive drum is set to be 84 mm and a pitch between the image forming portions 43*a* and 43*b* (pitch between stations) to be 250 mm. A distance between the exposure and the transfer, i.e., a distance from a position where the surface of the photoconductive drum is exposed to a position where a toner image is transferred to the intermediate transfer belt 24 is set to be 125 mm and a processing speed to be 300 mm/sec. Then, the time of 0.833 seconds is defined so that it corresponds to a time during which the intermediate transfer belt 24 is conveyed from the position where a toner image is transferred from the photoconductive drum 12*a* to the intermediate transfer belt 24 to the position where a toner image is transferred from the photoconductive drum 12*b* to the intermediate transfer belt 24.

Next, the control portion 48 sets a count as i=0 in Step 7. That is, the control portion 48 detects i-th (i=0) latent image graduation (belt graduation) 50 and latent image graduation (drum graduation) 31*b* by the latent image sensor 34B in Steps 8*a* and 8*b*. Then, the control portion 48 calculates a color shift equivalent Δti from a temporal difference between the detected 'signal timing of the belt graduation 50' and 'signal timing of the drum graduation 31*b*' in Step 9.

Based on Δti, the control portion 48 calculates a correction amount of speed of the drum driving motor 6*b* of the image forming portion 43*b* such that any misregistration is eliminated between 'the latent image graduation 31*b* of the photoconductive drum 12*b*' and 'the latent image graduation 50 of the intermediate transfer belt 24' in Step 10. The control portion 48 corrects a rotational speed of the drum driving motor 6*b* by the calculated correction amount in Step 11. Thus, the control portion 48 controls and corrects the rotational speed of the drum driving motor 6*b* so that the misregistration of the graduations is minimized.

The control portion 48 repeats the control of the drum driving motor 6*b* until when one page of image data finishes and ends the printing of one page in Step 13.

That is, the control portion 48 adjusts the positions of the graduations 31*b*, 31*c* and 31*d* corresponding to the toner images in the image forming portions 43*b*, 43*c* and 43*d* to the latent image graduation 50 corresponding to the toner image primarily transferred in the image forming portion 43*a*. This configuration makes it possible to transfer and superimpose the toner images in the image forming portions 43*b*, 43*c* and 43*d* to the toner image formed on the intermediate transfer belt 24 in high precision, so that a high quality full-color image having no color shift can be outputted.

As described above, the positions of the photoconductive drums 12*b*, 12*c* and 12*d* with respect to the intermediate transfer belt 24 are changed corresponding to the calculated misregistration such that the corresponding latent image graduations of the photoconductive drums and the intermediate transfer belt do not deviate from each other. This makes it possible to accurately correct even a misregistration of the toner images caused by expansion/contraction of the intermediate transfer belt 24 due to the toner images transferred to the intermediate transfer belt 24. For instance, a color shift amount among toner images of four colors of toners could be suppressed from 150 μm, i.e., a conventional value, to 40 μm as a result of the control of the color shift carried out based on the present embodiment.

Still further, in the case of the present embodiment, the first and second sensor portions 331 and 332 are held integrally by the hold member 340. In other words, the sensor portion that reads the latent image graduation on the photoconductive drum side and the sensor portion that reads the latent image graduation on the intermediate transfer belt side are integrally held by the hold member 340 without providing them separately. Due to that, it is possible to reduce error factors otherwise caused in registering images such as fluctuation of relative position of the sensor portions caused by temperature changes or the like and a difference of vibrations of the respective information detecting portions.

The hold member 340 is also disposed such that it is nipped between the photoconductive drum and the intermediate transfer belt. Due to that, even if the latent image sensor 34 integrally holds the first and second sensor portions 331 and 332, the latent image sensor 34 can read the latent image graduation 50 formed on the intermediate transfer belt and the latent image graduation 31 formed on the photoconductive drum 12 by the respective sensors. That is, in the case of the present embodiment, the latent image sensor 34 integrally holds the first and second sensor portions 331 and 332 by the hold member. Due to that, a position where the latent image sensor 34 can accurately read the latent image graduation 31 of the photoconductive drum 12 and the latent image graduation 50 of the intermediate transfer belt 24 is the part between the photoconductive drum 12 and the intermediate transfer belt 24 where the latent image sensor 34 can be in contact with or disposed closely to the both latent image graduations concurrently. The present embodiment makes it possible to output a high quality image whose color shift is reduced by constructing and operating as describe above.

Second Embodiment

A second embodiment of the present invention will be described with reference to FIG. 8. In the first embodiment described above, 'the signal detecting portions 333 and 335' of the latent image sensor 34 are installed so as to be parallel with 'the latent image graduations 31 and 50'. Still further, one copper pattern is used for the photoconductive drum 12 and one copper pattern is used for the intermediate transfer belt 24 as the signal detecting portions in the first embodiment. However, if a parallelism between the latent image sensor 34 and the latent image graduation is lost in the structure as described above, the loss of the parallelism comes out as a detection error as it is. Although it is possible to correct such an error as an installation error and an elapsed change from a printing result, it is difficult correct if the parallelism is lost dynamically during printing due to vibrations or the like.

Figure 8A:
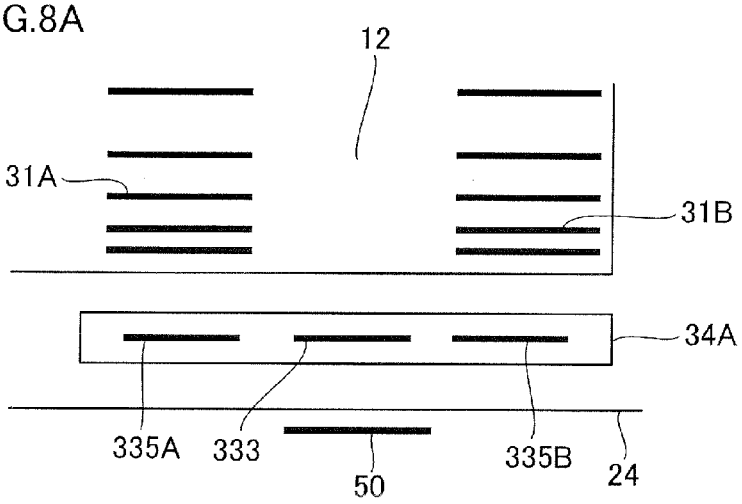
FIG. 8A is a schematic installation diagram of a latent image sensor of a second embodiment of the invention viewed from the sub-scanning direction.

Then, two copper patterns are used for the photoconductive drum 12 and one copper pattern is used for the intermediate transfer belt 24 as the signal detecting portions of the latent image sensor 34A as shown in FIG. 8A in the present embodiment. That is, the latent image sensor 34A of the present embodiment has one signal detecting portion 333 as a first information detecting portion and two signal detecting portions 335A and 335B as a second information detecting portions. In conformity also with that, two rows of latent image graduations 31A and 31B are formed on the photoconductive drum 12 as second position information. This configuration will now be described below in detail.

Figure 8B:
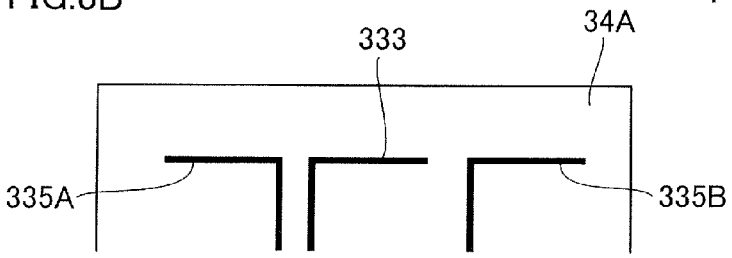
FIG. 8B is a schematic plan view of the latent image sensor of the second embodiment.
Figure 8C:
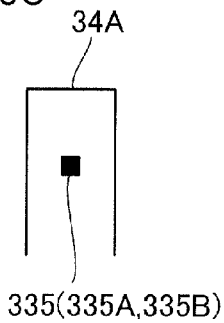
FIG. 8C is a section view of the latent image sensor of the second embodiment shown in FIG. 8B.

At first, as shown in FIG. 8B, 'the signal detecting portion 333 and the signal detecting portions 335A and 335B' are disposed as three copper patterns on one and same straight line in parallel with the main scan direction on the latent image sensor 34A. The signal detecting portions 335 and 335B are also disposed such that they interpose the signal detecting portion 333 between them in the main scan direction (on both sides in the main scan direction). Along with that, the two rows of latent image graduations 31A and 31B are formed on the photoconductive drum 12 such that they interpose the latent image graduation 50 formed on the intermediate transfer belt 24 between them in the main scan direction (the both sides in the main scan direction).

In the case of the present embodiment, the position information forming portion forming the latent image graduations 31A and 31B as two position information on the photoconductive drum 12 corresponds to one position information forming portion among the first and second position information forming portions. The position information forming portion forming the latent image graduation 50 as position information on the intermediate transfer belt 24 corresponds to the other position information forming portion. Then, the latent image graduations 31A and 31B as the two position information are formed on the both sides in the width direction (the both sides in the main scan direction) of the latent image graduation 50.

Still further, the signal detecting portions 335A and 335B correspond to one information detecting portion detecting the position information formed by one position information forming portion among the first and second information detecting portions. The signal detecting portion 333 also corresponds to the other information detecting portion detecting the position information formed by the other position information forming portion. Then, the two signal detecting portions 335A and 335B are disposed on the both sides in the width direction of the signal detecting portion 333. Then, as shown in FIG. 8A, the signal detecting portion 335A detects the latent image graduation 31A of the photoconductive drum 12, the signal detecting portion 333 detects the latent image graduation 50 on the intermediate transfer belt 24, and the signal detecting portion 335B detects the latent image graduation 31B on the photoconductive drum 12, respectively.

Figure 8D:
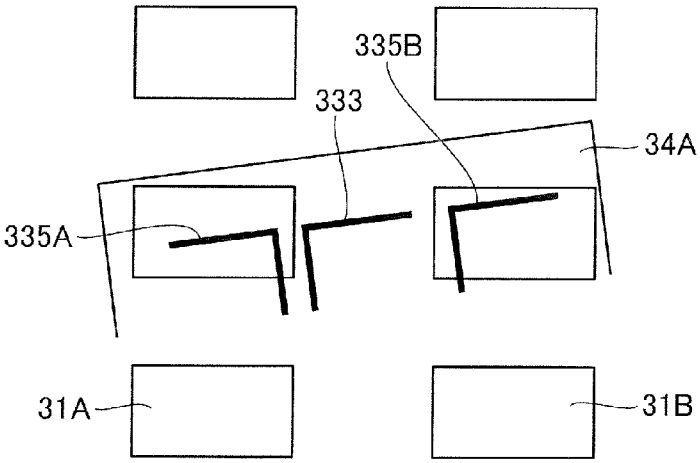
FIG. 8D is a schematic diagram indicating a case where the latent image sensor of the second embodiment is inclined to the latent image graduation.

As described above, according to the present embodiment, the signal detecting portions 335A and 335B detect the latent image graduations 31A and 31B of the photoconductive drum 12 formed so as to interpose the latent image graduation 50 of the intermediate transfer belt 24 in the main scan direction. Here, if the parallelism of the latent image sensor 34A to the latent image graduation is kept, signals of the two rows of latent image graduations 31A and 31B can be detected simultaneously by the signal detecting portions 335A and 335B. However, if the latent image sensor 34A is inclined, i.e., the parallelism to the latent image graduation is lost, as shown in FIG. 8D, a time difference is generated between two signals detected by the signal detecting portions 335A and 335B.

When the time difference is generated between the two signals detected by the signal detecting portions 335A and 335B as described above, an average of detection times of these two signals is taken in the present embodiment. Thereby, the latent image sensor 34A is put into a state in which the latent image sensor 34A detects the latent image graduation of the photoconductive drum 12 at a pseudo same position in the sub-scan direction with the signal detecting portion 333 located at the position interposed between the signal detecting portions 335A and 335B. As a result, even if the latent image sensor 34A is inclined to the latent image graduation, it is possible to correct the detected signals in real-time and to correct a color shift in high precision.

It is noted that although the two signal detecting portions are provided to detect the latent image graduations of the photoconductive drum 12 and the one signal detecting portion is provided to detect the latent image graduation of the intermediate transfer belt 24, respectively, in the above explanation, one signal detecting portion may be provided to detect the latent image graduation of the photoconductive drum 12 and two signal detecting portions may be provided to detect the latent image graduation of the intermediate transfer belt 24, respectively. In this case, one row of latent image graduation is formed on the photoconductive drum 12 and two rows of latent image graduations are formed on the intermediate transfer belt 24. Still further, the signal detecting portions may be disposed such that two signal detecting portions detecting two rows of latent image graduations are adjacent with each other. However, it is preferable to separate the distance in the main scan direction of these two signal detecting portions as much as possible by disposing another one signal detecting portion such that it is interposed between these two signal detecting portions. Thereby, it is possible to increase the time difference between the two signals caused by the inclination of the latent image sensor and to correct the detected signals more accurately. The other constructions and operations are the same with those of the first embodiment described above.

Third Embodiment

A third embodiment of the present invention will be explained below with reference to FIGS. 9 and 10. Because it is necessary to draw the two rows of latent image graduations of the photoconductive drum 12 in the main scan direction in order to correct the inclination of the latent image sensor 34A, both the photoconductive drum 12 and the intermediate transfer belt 24 are prolonged in the main scan direction in the second embodiment described above.

Then, signal detecting portions 333 and 335 of a latent image sensor 34B are formed on front and back sides of a board 347, respectively, and positions of the signal detecting portions 333 and 335 are equalized in the sub-scan direction in the present embodiment. This configuration makes it possible to compact the photoconductive drum 12 and the intermediate transfer belt 24 in the main scan direction while eliminating an influence of the inclination of the latent image sensor 34B. The present embodiment will now be described below in detail.

The latent image sensor 34B of the present embodiment is formed of a two-layered flexible print board. Specifically, as shown in FIG. 9B which is a section view taken along a line Y-Y' in FIG. 9A, a cross-sectional structure of the latent image sensor 34B is formed sequentially of a cover 346, an adhesive 345, the signal detecting portion 335 and an earth 344, a board 347, the signal detecting portion 333, another earth 344, another adhesive 345, and another cover 346. These members are held by a hold member 340A. In the case of the present embodiment, the signal detecting portion 333 as the first information detecting portion and the signal detecting portion 335 as the second information detecting portion are disposed at positions different in a direction of a thickness of the latent image sensor 34B which is orthogonal to the surface of the intermediate transfer belt 24 as a conveyance body.

Figure 9A:
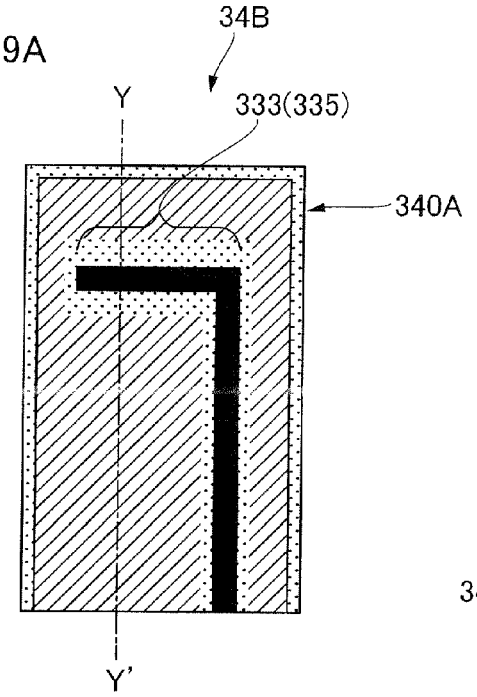
FIG. 9A is a plan view schematically showing a configuration of a latent image sensor of a third embodiment of the invention.
Figure 9B:
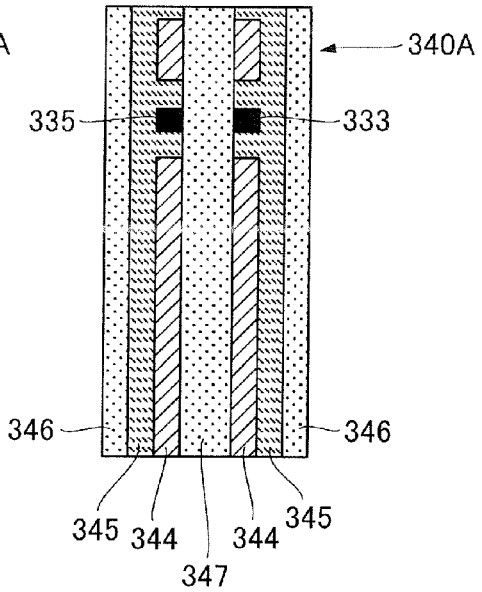
FIG. 9B is a section view of the latent image sensor of the third embodiment shown in FIG. 9A.
Figure 10A:
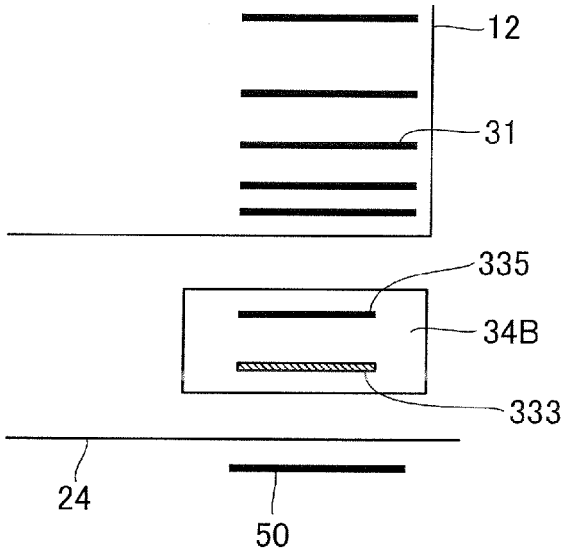
FIG. 10A is a schematic installation diagram of the latent image sensor of the third embodiment viewed from the sub-scanning direction.
Figure 10B:
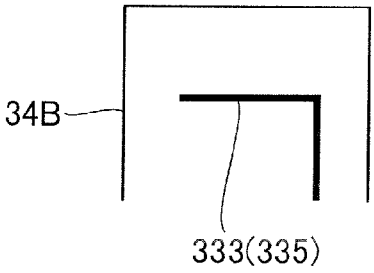
FIG. 10B is a schematic plan view of the latent image sensor of the third embodiment.
Figure 10C:
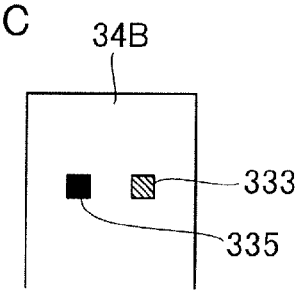
FIG. 10C is a section view of the latent image sensor of the third embodiment shown in FIG. 10B.

As shown in FIG. 9A, the signal detecting portions 333 and 335 are disposed such that they are superimposed from each other when viewed from a direction of a thickness orthogonal to surface of the flexible printed board. In other words, the signal detecting portions 333 and 335 are disposed such that their positions in the main scan direction and the sub-scan direction coincide with each other. Along with that, the second position information forming portion forming the latent image graduation on the photoconductive drum 12 forms the latent image graduation 31 at the position where at least parts of the latent image graduation 31 and the latent image graduation 50 overlap in the main scan direction. The positions in the main scan direction of the latent image graduation 31 and of the latent image graduation 50 are substantially overlapped in the present embodiment.

The latent image sensor 34B constructed as described above is installed as shown in FIGS. 10A through 10C. That is, the signal detecting portion 333 is disposed on the intermediate transfer belt 24 side and the signal detecting portion 335 is disposed on the photoconductive drum 12 side, respectively. Then, the signal detecting portion 333 detects the latent image graduation 50 of the intermediate transfer belt 24 and the signal detecting portion 335 detects the latent image graduation 31 of the photoconductive drum 12, respectively. It is noted that while the signal detecting portion 333 is indicated by hatching in FIG. 10, the signal detecting portion 333 is so indicated in order to be able to readily discern from the signal detecting portion 335 and the material and others are not different from those of the signal detecting portion 335. The signal detecting portion detecting the latent image graduation of the intermediate transfer belt 24 side will be indicated by hatching also in the following embodiments.

In the case of the present embodiment, even if the latent image sensor 34B is inclined, the signal detecting portions 333 and 335 are located at the same position in the sub-scan direction, so that no detection error occurs. Still further, this arrangement makes it possible to realize the signal detecting portions with a least latent image graduation width in the main scan direction. It is noted that although it is conceivable a case where the signal detecting portions 333 and 335 are deviated due to an error in manufacturing the flexible printed board, it can be correct from a printing result in shipping out of a factory, and a similar correction may be made to a deviation of the copper patterns also in the following embodiment. The other constructions and operations are the same with those of the first embodiment described above.

Fourth Embodiment

Figure 13A:
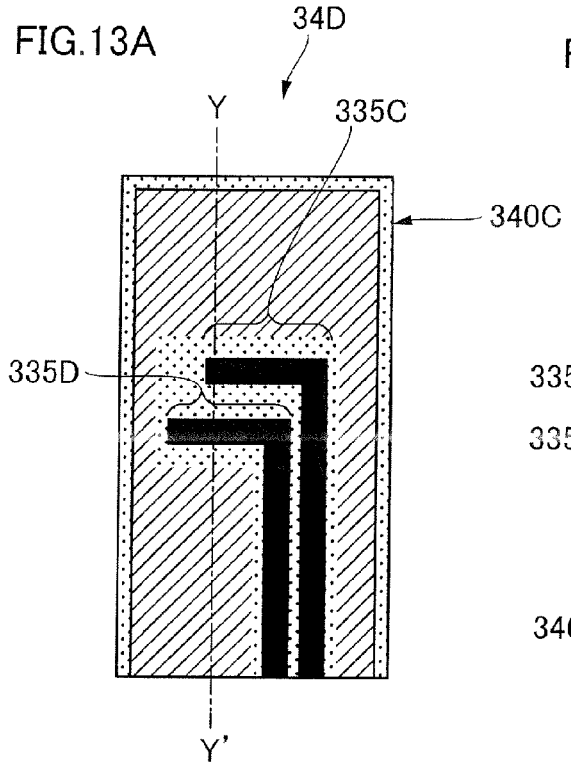
FIG. 13A is a plan view schematically showing a configuration of another example of the latent image sensor of the fourth embodiment of the invention.
Figure 13B:
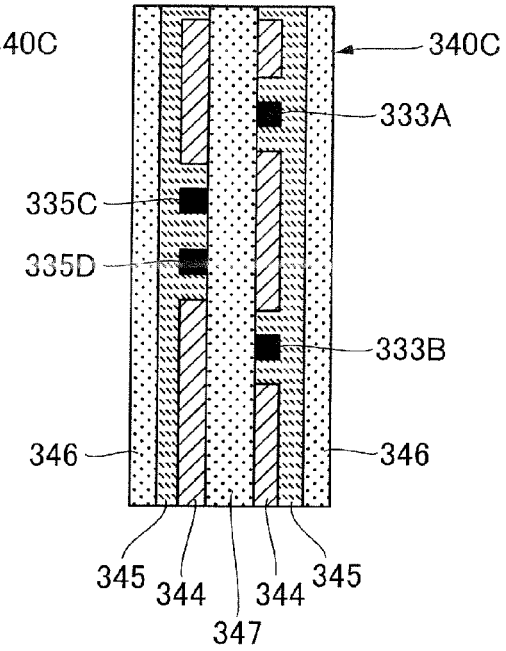
FIG. 13B is a section view of the latent image sensor of the fourth embodiment shown in FIG. 13A.
Figure 14A:
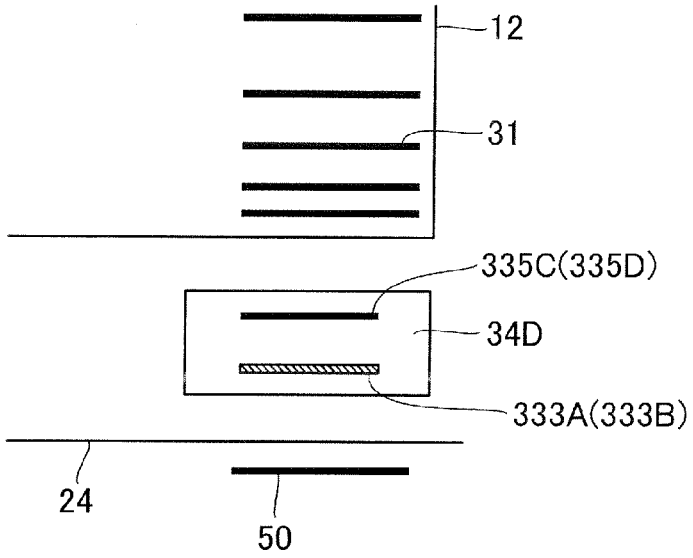
FIG. 14A is a schematic installation diagram of the other example of the latent image sensor of the fourth embodiment viewed from the sub-scanning direction.
Figure 14B:
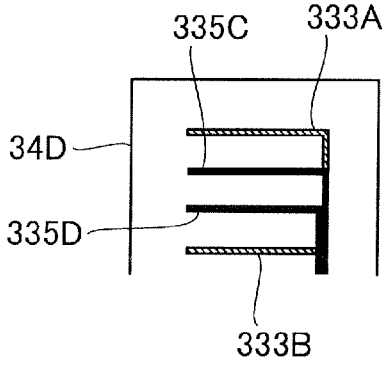
FIG. 14B is a schematic plan view of the other example of the latent image sensor of the fourth embodiment.
Figure 14C:
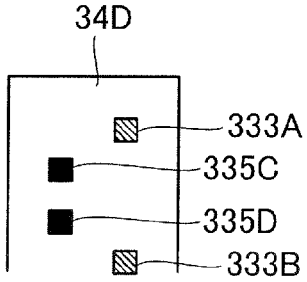
FIG. 14C is a section view of the other example of the latent image sensor of the fourth embodiment shown in FIG. 14B.

A fourth embodiment of the present invention will be described below by using FIGS. 11 through 14. While the signal detecting portion 335 is installed to detect the latent image graduation 31 of the photoconductive drum 12 in the third embodiment described above, there is a possibility that the signal detecting portion 335 is affected slightly by the latent image graduation 50 of the intermediate transfer belt 24 and causes a detection error. In the same manner, the signal detecting portion 333 may be affected by the latent image graduation 31 of the photoconductive drum 12. The present embodiment proposes a structure that permits to reduce such influence from the latent image graduation not to be detected as described above. It is noted that while two examples shown in FIGS. 11 and 12 and in FIGS. 13 and 14 are shown in the present embodiment, the example shown in FIGS. 11 and 12 will be explained first.

Figure 11A:
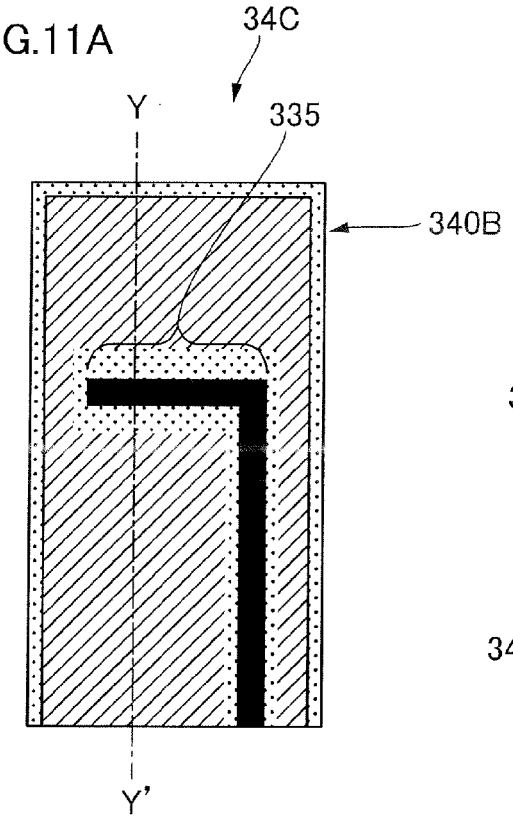
FIG. 11A is a plan view schematically showing a configuration of a latent image sensor of a fourth embodiment of the invention.
Figure 11B:
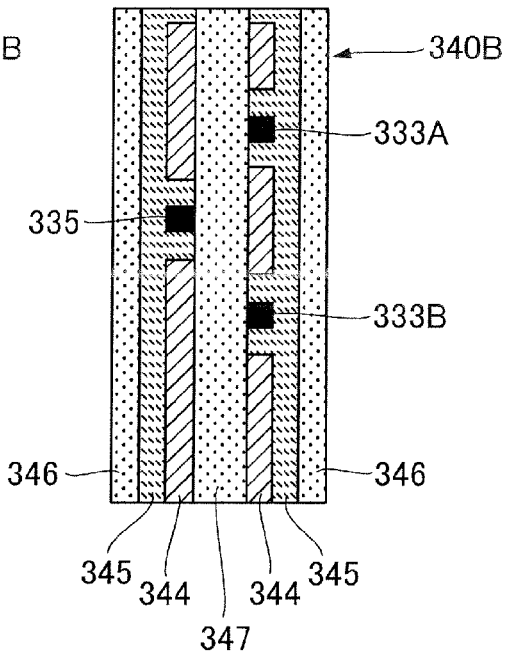
FIG. 11B is a section view of the latent image sensor of the fourth embodiment shown in FIG. 11A.
Figure 12A:
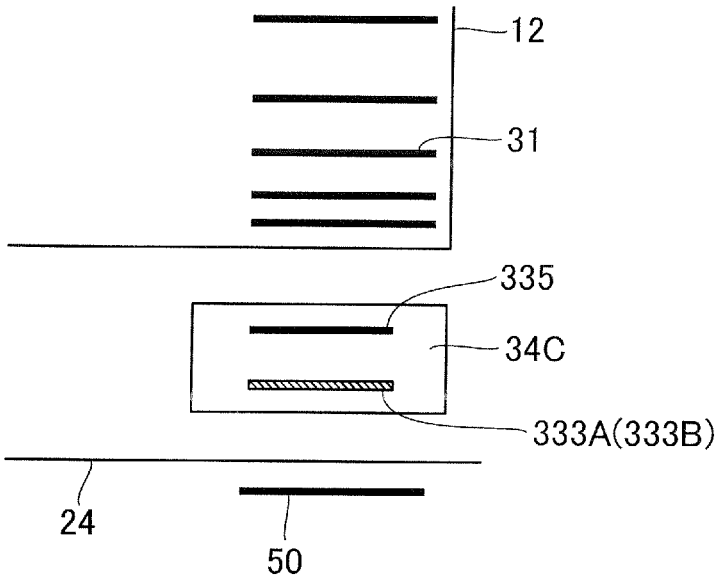
FIG. 12A is a schematic installation diagram of the latent image sensor of the fourth embodiment viewed from the sub-scanning direction.
Figure 12B:
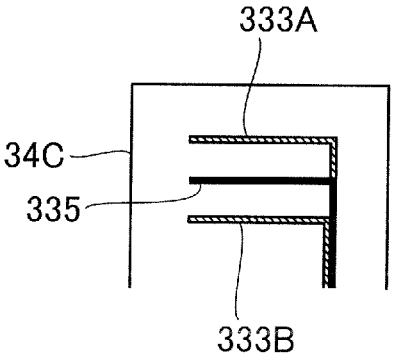
FIG. 12B is a schematic plan view of the latent image sensor of the fourth embodiment.
Figure 12C:
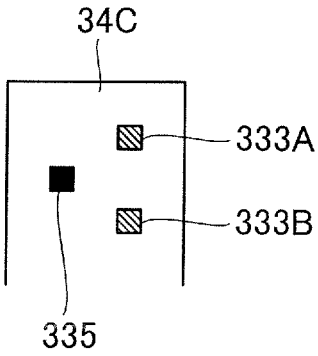
FIG. 12C is a section view of the latent image sensor of the fourth embodiment shown in FIG. 12B.

In the example shown in FIGS. 11 and 12, two copper patterns as conductors are used to detect the latent image graduation of the intermediate transfer belt 24. A latent image sensor 34C of the present embodiment is formed of a two-layered flexible printed board whose layered structure is the same with that of the latent image sensor 34B of the third embodiment. That is, one copper pattern is used as the conductor for the signal detecting portion 335 that detects the latent image graduation 31 of the photoconductive drum 12 and two copper patterns are used for the signal detecting portions 333A and 333B to detect the latent image graduation 50 of the intermediate transfer belt 24. These members are held by a hold member 340B.

A distance between the two signal detecting portions 333A and 333B is set in accordance to a pitch of the latent image graduation 50 on the intermediate transfer belt 24. For instance, the pitch of the latent image graduation 50 is equalized with the distance between the two copper patterns to take a sum of two output signals and to output it as a detection signal of the latent image graduation 50 of the intermediate transfer belt 24. Or, a half of the pitch of the latent image graduation 50 is taken as a distance between the two copper patterns to take a difference between two output signals and to output it as a detection signal of the latent image graduation 50 of the intermediate transfer belt 24.

Here, the two signal detecting portions 333A and 333B need to exist within a range of a nip portion in a condition in which the latent image sensor 34C is installed at the nip portion between the photoconductive drum 12 and the intermediate transfer belt 24. To that end, the distance between the signal detecting portions 333A and 333B is desirable to be a nip width or less. In the same manner, the distance is desirable to be the nip width or less also in the following embodiments because the signal detecting portions need to exist within the range of the nip portion in detecting the latent image graduation by a plurality of signal detecting portions.

The use of the two copper patterns to detect the latent image graduation 50 allows a pattern of the earth 344 as a first conductive portion which is kept at a constant potential to be provided between the two signal detecting portions 333A and 333B. That is, the earth 344, i.e., the first conductive portion, is disposed around the signal detecting portions 333A and 333B at the same position in terms of the thickness direction. Then, the signal detecting portion 335 that detects the latent image graduation 31, i.e., the electrical signal, on the photoconductive drum 12 is disposed on an opposite side of the board 347 from the earth 344. That is, the signal detecting portion 335 is formed of the copper pattern, i.e., the conductor, and is disposed at a position superimposing with the earth 344, i.e., the first conductive portion, when viewed from the thickness direction. This configuration makes it possible to eliminate the influence otherwise received by the signal detecting portion 335 from the latent image graduation 50 of the intermediate transfer belt 24 because the earth 344 exists between the signal detecting portion 335 and the intermediate transfer belt 24.

In the same manner, the pattern of the earth 344, i.e., the second conductive portion which is kept at a constant potential, exists around the signal detecting portion 335. That is, the earth 344 as the second conductive portion is disposed around the signal detecting portion 335 at the same position in terms of the thickness direction. Then, the signal detecting portions 333A and 333B that detect the latent image graduation 50 of the intermediate transfer belt 24 are disposed on an opposite side of the board 347 from the earth 344. That is, the signal detecting portions 333A and 333B are formed of the copper patterns as the conductor and are disposed at positions superimposed with the earth 344 as the second conductive portion when viewed from the thickness direction. This configuration makes it possible to eliminate the influence otherwise received by the signal detecting portions 333A and 333B from the latent image graduation 31 of the photoconductive drum 12 because the earth 344 exists between the signal detecting portions 333A and 333B and the photoconductive drum 12.

As described above, according to the present embodiment, it is possible to reduce the influence from the latent image graduation not to be detected by disposing the earth 344 at the positions superimposing with the signal detecting portions 333A and 333B and the signal detecting portion 335, respectively, in the thickness direction. Note that it is possible to use two copper patterns to detect the latent image graduation 31 of the photoconductive drum 12 and to use one copper pattern to detect the latent image graduation 50 of the intermediate transfer belt 24.

Next, the example shown in FIGS. 13 and 14 will be explained. In this example, two copper patterns are used to detect the latent image graduation 31 of the photoconductive drum 12 and two copper patterns are also used to detect the latent image graduation 50 of the intermediate transfer belt 24. A latent image sensor 34D of this example is formed of a two-layered flexible printed board whose layered structure is the same with that of the latent image sensor 34B of the third embodiment. Then, the two copper patterns as the conductors are used for the signal detecting portions 335C and 335D that detect the latent image graduation 31 of the photoconductive drum 12 and the two copper patterns are used for the signal detecting portions 333A and 333B that detect the latent image graduation 50 of the intermediate transfer belt 24. These members are held by a hold member 340C.

An installation distance between the two signal detecting portions 335C and 335D is calculated from the pitch of the latent image graduation 31 on the photoconductive drum 12 similarly to the installation method concerning the distance between the signal detecting portions 333A and 333B in the example of FIGS. 11 and 12 described above. The signal detecting portions 335C and 335D are also disposed at positions superimposed with the earth 344 between the signal detecting portions 333A and 333B when viewed from the thickness direction. The other points are the same with those of the example in FIGS. 11 and 12. It is possible to obtain the similar effect with that of the example in FIGS. 11 and 12 also in such a case of the example shown in FIGS. 13 and 14. The other configurations and operations are the same with those of the third embodiment described above.

Fifth Embodiment

Figure 15A:
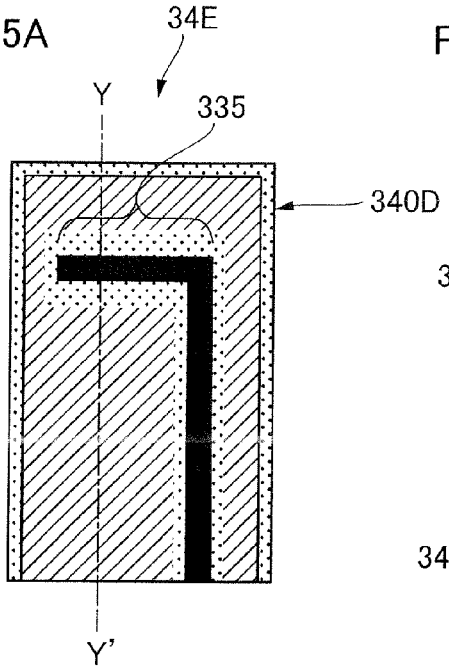
FIG. 15A is a plan view schematically showing a configuration of a latent image sensor of a fifth embodiment of the invention.
Figure 15B:
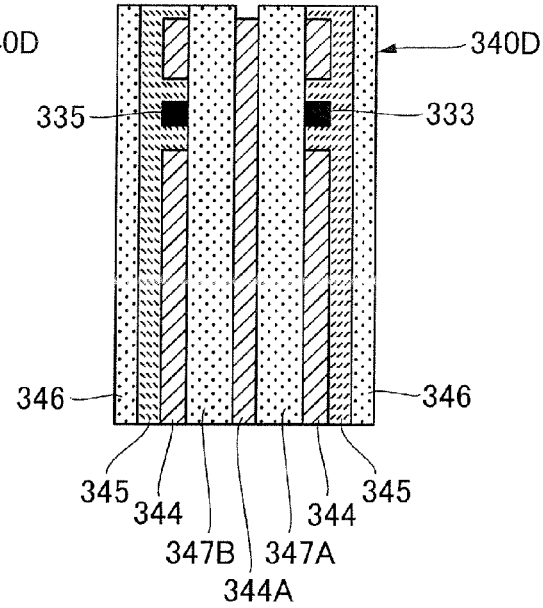
FIG. 15B is a section view of the latent image sensor of the fifth embodiment shown in FIG. 15A.
Figure 16A:
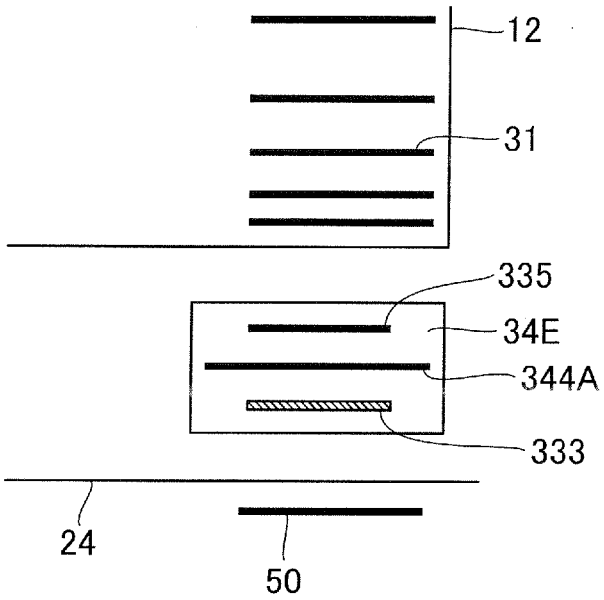
FIG. 16A is a schematic installation diagram of a latent image sensor of a fifth embodiment viewed from the sub-scanning direction.
Figure 16B:
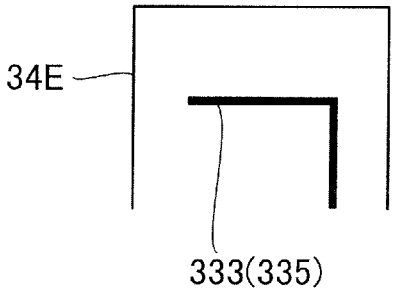
FIG. 16B is a schematic plan view of the latent image sensor of the fifth embodiment.
Figure 16C:
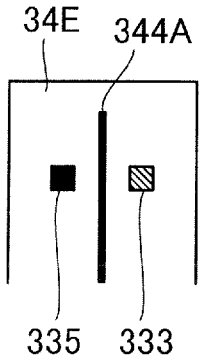
FIG. 16C is a section view of the latent image sensor of the fifth embodiment shown in FIG. 16B.

A fifth embodiment of the present invention will be described below by using FIGS. 15 and 16. The present embodiment proposes a configuration that enables to reduce an influence from a latent image graduation not to be detected, differing from the fourth embodiment.

A latent image sensor 34E of the present embodiment is formed of a three-layered flexible printed board. Specifically, as shown in FIG. 15B which is a section view taken along a line Y-Y' in FIG. 15A, a cross-sectional structure of the latent image sensor 34E is formed sequentially of a cover 346, an adhesive 345, a signal detecting portion 335 and an earth 344, a board 347B, another earth 344A, a board 347A, a signal detecting portion 333 and the earth 344, another adhesive 345, and another cover 346. These members are held by a hold member 340D. In the case of the present embodiment, the signal detecting portion 333 as the first information detecting portion and the signal detecting portion 335 as the second information detecting portion are disposed at positions different in the thickness direction of the latent image sensor 34E which is orthogonal to the surface of the intermediate transfer belt 24 as the conveyance body.

The latent image sensor 34E of the present embodiment has the two boards 347A and 347B and the earth 344A, i.e., a conductor which is kept at a constant potential, disposed between these two boards 347A and 347B, as compared to the latent image sensor 34B of the third embodiment described above. The signal detecting portion 333 is disposed on an opposite side of the board 347A from the earth 344A, and the signal detecting portion 335 is disposed on an opposite side of the board 347B from the earth 344A.

That is, the signal detecting portion 333 as the first information detecting portion is formed of the copper pattern as the conductor on the board 347A of the intermediate transfer belt 24 side to detect the latent image graduation 50 as the electrical signal formed on the intermediate transfer belt 24. The signal detecting portion 335 as the second information detecting portion is also formed of the copper pattern as the conductor on the board 347B of the photoconductive drum 12 side to detect the latent image graduation 31, i.e., the electrical signal, formed on the photoconductive drum 12. Then, the earth 344A is disposed between the signal detecting portions 333 and 335 at a position superimposing with the signal detecting portions 333 and 335 when viewed from the thickness direction.

As described above, according to the present embodiment, because the earth 344A which is kept at a constant potential exists between the signal detecting portions 333 and 335, it is possible to reduce the influence otherwise receiving from the latent image graduation not to be detected. The other configurations and operations are the same with those of the third embodiment described above.

Sixth Embodiment

The sixth embodiment of the present invention will now be described with reference to FIGS. 17 through 31. The configuration in which the information detecting portion includes the signal detecting portion 333 and others (the first information detecting portion) detecting the latent image graduation of the intermediate transfer belt 24 and the signal detecting portion 335 and others (the second information detecting portion) detecting the latent image graduation of the photoconductive drum 12 has been explained in the embodiments described above. In contrary to that, according to the present embodiment, the information detecting portion has two signal detecting portions 22A and 22B juxtaposed in the conveying direction (the sub-scan direction) of the intermediate transfer belt 24 as the conveyance body and a detection signal extraction circuit 30 as an information processing portion. The two signal detecting portions 22A and 22B detect both the latent image graduation 50A formed on the intermediate transfer belt 24 and the latent image graduation 31C formed on the photoconductive drum 12, respectively. Then, the detection signal extraction circuit 30 processes detection signals of the two signal detecting portions 22A and 22B to correct a color shift. The present embodiment will be described in detail below.

[Latent Image Sensor]

Figure 17A:
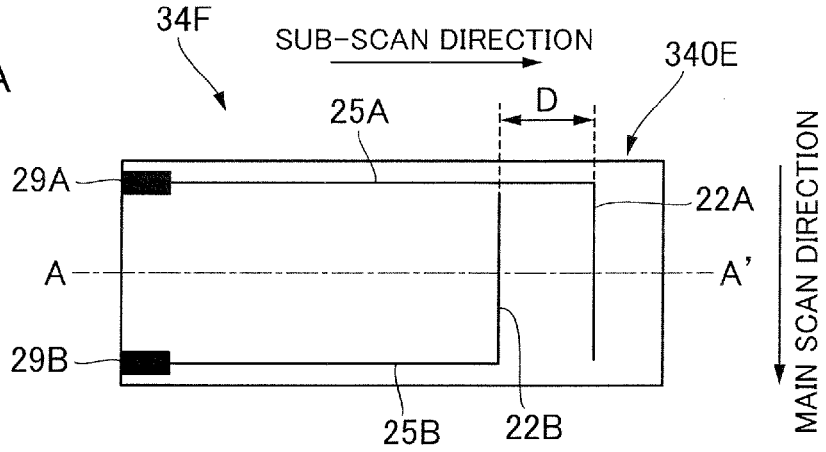
FIG. 17A is a plan view schematically showing a configuration of a latent image sensor of a sixth embodiment of the invention.
Figure 17B:
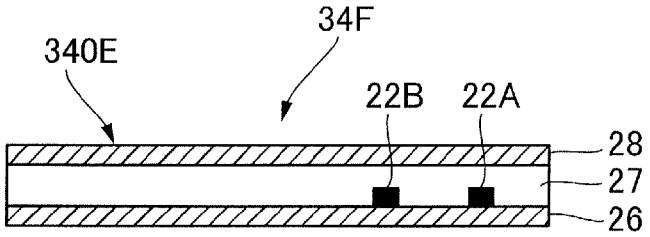
FIG. 17B is a section view of the latent image sensor of the sixth embodiment shown in FIG. 17A.

In the present embodiment, the latent image sensor 34F is also formed of a flexible print board in the same manner with the embodiments described above. FIGS. 17A and 17B show this structure. The latent image sensor 34F in FIGS. 17A and 17B is a 'mono-layer flexible print board' used in wiring in ordinary electrical machineries, and copper patterns thereof form parts detecting latent images as position information. It is noted that although the flexible print board will be exemplified in the following explanation, any material may be used as long as a similar structure (insulative from a conductor) can be realized. FIG. 17A is a plan view of the latent image sensor 34F, and FIG. 17B is a section view taken along a line A-A' in FIG. 17A. It is noted that a correlation between sizes of respective parts of the latent image sensor 34F in the plan and section views thereof is neglected for convenience of the explanation.

As shown in FIG. 17A, the latent image sensor 34F has the two signal detecting portions 22A and 22B juxtaposed in the conveying direction (the sub-scan direction) of the intermediate transfer belt 24 and signal transmitting portions 25A and 25B. The signal detecting portions 22A and 22B are formed into thin and long shapes disposed in the main scan direction, respectively, and are disposed in parallel from each other by being distant by D in the sub-scan direction. These signal detecting portions 22A and 22B correspond to the probe 330 shown in FIG. 2 and described above and detect latent image graduations 31C and 50A shown in FIGS. 18, 19 and others and described later, respectively. The signal transmitting portions 25A and 25B are detection signal lead wires for leading out signals from the signal detecting portions 22A and 22B, respectively, and are lead in the sub-scan direction such that they do not detect fluctuations of potential of the latent image graduations. Provided at end parts of the signal transmitting portions 25A and 25B are connecting terminals 29A and 29B for taking the signals to the outside. These signal detecting portions 22A and 22B and the signal transmitting portions 25A and 25B are formed of conductors, respectively, and are formed of the copper patterns described above in the present embodiment.

As shown in FIG. 17B, the latent image sensor 34F is layered and is constructed so as to integrally hold the signal detecting portions 22A and 22B, the signal transmitting portions 25A and 25B, and the connecting terminals 29A and 29B by a hold member 340E. The hold member 340E has a board 26, a cover 28, and an adhesive 27. The board 26 is a base layer and is composed of a high strength and highly insulative material whose coefficient of linear expansion is close to that of metal such as polyimide, and the signal detecting portions 22A and 22B, the signal transmitting portions 25A and 25B, and the connecting terminals 29A and 29B are formed of highly conductive metal on the surface of the board 26. For example, the signal detecting portions 22A and 22B, the signal transmitting portions 25A and 25B, and the connecting terminals 29A and 29B are printed by copper patterns on the surface of the board 26.

The cover 28 is a cover layer protecting the signal detecting portions 22A and 22B and the signal transmitting portions 25A and 25B and is composed of polyimide similarly to the base layer. For example, the surface of the board 26 is covered by the film-like cover 28. The adhesive 27 is an adhesive layer adhering the board 26 with the cover 28. The board 26 is 38 μm thick, the signal detecting portions 22A and 22B and the signal transmitting portions 25A and 25B are 9 μm thick, the cover 28 is 12.5 μm thick, and a part of the adhesive 27 excluding an earth is 15 μm thick. A thickness of the whole latent image sensor 34F constructed as described above is preferable to be 65.5 to 74.5 μm for example.

It is noted that although the thickness is even in the section view in FIG. 17B, actually the thickness varies such that a part where the signal detecting portions 22A and 22B and the signal transmitting portions 25A and 25B exists is 74.5 μm thick and a part where they do not exist is 65.5 μm thick. However, it is possible to uniform the thickness to be 74.5 μm by providing a dummy plane pattern which does not come in contact with the signal detecting portions 22A and 22B and the signal transmitting portions 25A and 25B at the part (peripheral part) where the signal detecting portions 22A and 22B and the signal transmitting portions 25A and 25B do not exist. It is also possible to prevent an influence of a potential of a latent image sensor adjacent to a latent image sensor to be detected by earthing (shielding) the dummy plane pattern. An earth not shown is formed on the board 26 around the signal detecting portions 22A and 22B and the signal transmitting portions 25A and 25B. This earth corresponds to the earth 344 explained in the embodiments described above.

[Relationship Between Signal Detecting Portion and Latent Image Graduation]

Figure 18:
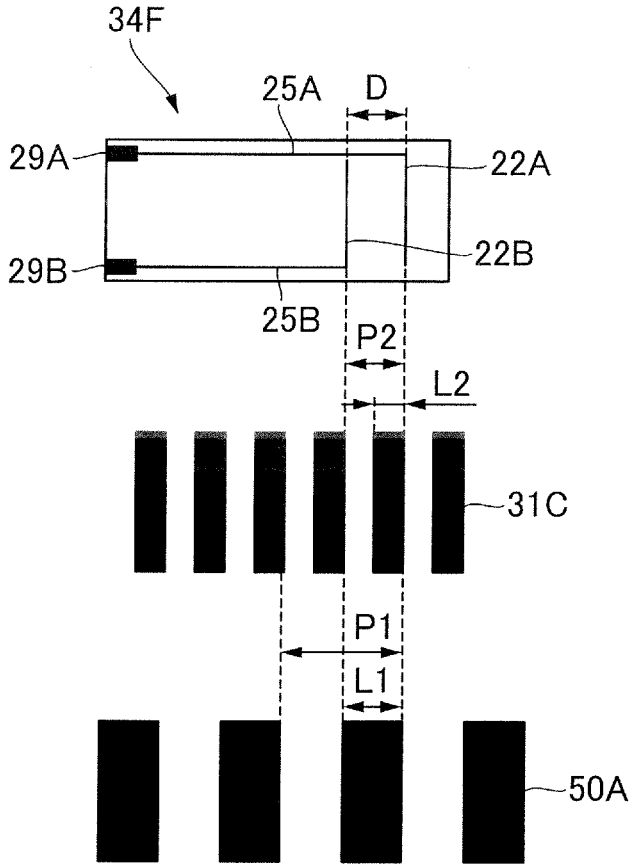
FIG. 18 is a schematic diagram illustrating one exemplary relationship of pitches between two signal detecting portions of the latent image sensor of the sixth embodiment and first and second marks.
Figure 19:
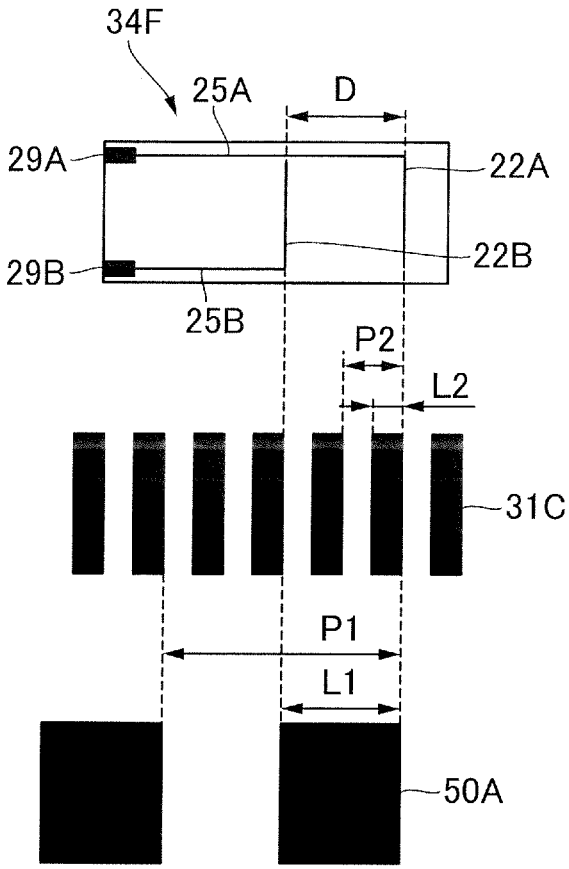
FIG. 19 is a schematic diagram illustrating another exemplary relationship different from that shown in FIG. 18.

Next, a relationship between the signal detecting portions 22A and 22B described above and the latent image graduations 50A and 31C formed in the present embodiment will be explained with reference to FIGS. 18 through 21. At first, the latent image graduations 50A and 31C are formed as shown in FIG. 18 or 19. That is, the latent image graduation 50A is formed as the first position information on the intermediate transfer belt 24 as the conveyance body such that two types of signals are formed consecutively at equal intervals at a duty ratio of 50% in terms of the conveying direction (the sub-scan direction) of the intermediate transfer belt 24. The latent image graduation 31C is also formed as the second position information on the photoconductive drum 12 as a second image carrier such that two types of signals are formed consecutively at equal intervals at a duty ratio of 50% in terms of the conveying direction (the sub-scan direction) of the photoconductive drum 12. In the case of the present embodiment, the two types of signals are formed by repeating potentials higher and lower than a midpoint potential in the sub-scan direction in the same manner with the embodiments described above.

Here, the two signals have a relationship of meeting the following conditions: $P1=P2/(2\times n)$ or $P1=P2\times 2\times m$, where P1 is a distance between the signals of the latent image graduation 50A, P2 is a distance between the signals of the latent image graduation 31C, and n and m are natural numbers. It is noted that FIG. 18 shows a case where a pitch of the latent image graduation 50A is twice a pitch of the latent image graduation 31C. Meanwhile, FIG. 19 shows a case where a pitch of the latent image graduation 50A is quadruple a pitch of the latent image graduation 31C.

Figure 20A:
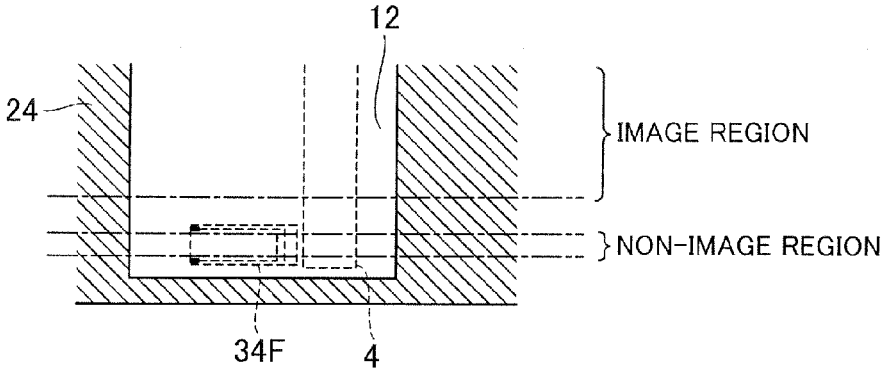
FIG. 20A is a plan view schematically showing an installation condition of the latent image sensor of the sixth embodiment.

The latent image graduation 31C is also formed such that at least parts of the latent image graduation 31C and the latent image graduation 50A are located at a same position in terms of the width direction (the main scan direction) intersecting with the conveying direction of the photoconductive drum 12 in the surface of the photoconductive drum 12. In the present embodiment, the latent image graduation 31C and the latent image graduation 50A are formed substantially at the same position in terms of the main scan direction. Such latent image graduations 50A and 31C are formed in a non-image region out of an image region as shown in FIG. 20A.

Figure 20B:
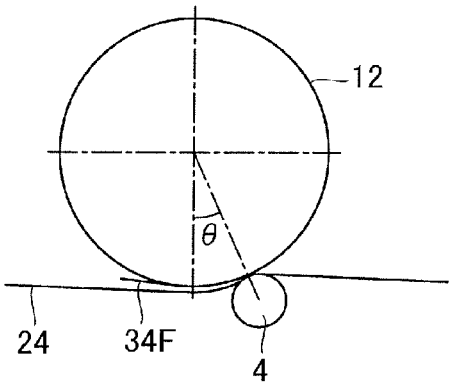
FIG. 20B is a section view of the latent image sensor of the sixth embodiment shown in FIG. 20A viewed from the main scan direction.
Figure 21:
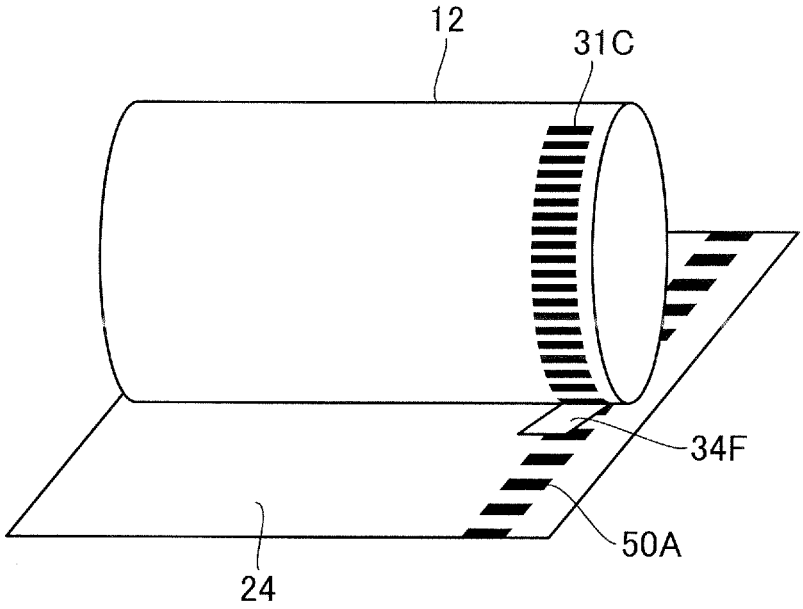
FIG. 21 is a perspective view schematically showing an installation condition of the latent image sensor of the sixth embodiment.

As shown in FIGS. 20 and 21, the latent image sensor 34F is disposed such that the signal detecting portions 22A and 22B are located at a position superimposed with these latent image graduations 31C and 50A when viewed from the thickness direction orthogonal to the surface of the intermediate transfer belt 24. It is noted that the latent image graduations 31C and 50A may be disposed anyway as long as at least the parts thereof are located at the same position in the main scan direction, and in this case, the signal detecting portions 22A and 22B superimpose with such parts in the thickness direction.

The latent image sensor 34F detects the latent image graduations 50A and 31C respectively by the signal detecting portions 22A and 22B by disposing the signal detecting portions 22A and 22B at the part where the latent image graduations 50A and 31C are located in the same position in the main scan direction. Then, the latent image sensor 34F synthesizes and outputs signals detected by the signal detecting portions 22A and 22B, respectively.

Here, a distance D in the sub-scan direction of the two signal detecting portions 22A and 22B is set such that $D=P2/2$ when $P1<P2$ and $D=P1/2$ when $P1>P2$. Further, in FIG. 20B, a section of an angle θ is a transfer section in which the photoconductive drum 12 is in contact with the intermediate transfer belt 24 and an electrostatic latent image formed on the photoconductive drum 12 is transferred to the intermediate transfer belt 24. A position where the latent image sensor 34F is mounted in terms of the main scan direction is in the non-image region out of the image region and in a region where the latent image graduations 50A and 31C are formed as shown in FIG. 20A. In terms of the sub-scan direction, the latent image sensor 34F is mounted at a nipped position between the photoconductive drum 12 and the intermediate transfer belt 24 as shown in FIG. 20B. Then, the latent image sensor 34F is disposed such that the two signal detecting portions 22A and 22B are located within the transfer section and the connecting terminals 29A and 29B are located out of the transfer section. It is noted that the latent image sensor 34F is fixed by a support member not shown such that the mount position does not fluctuate.

In short, the pitch of the latent image graduation 50A (first mark) is denoted as P1, a width of the latent image graduation 50A in the sub-scan direction as L1, the pitch of the latent image graduation 31C (second mark) as P2, a width of the latent image graduation 31C in the sub-scan direction as L2, and the distance between the two signal detecting portions 22A and 22B as D.

In this case, the duty ratio of the latent image graduation 50A is 50% as represented as $P1=2\times L1$ and the duty ratio of the latent image graduation 31C is also 50% as represented by $P2=2\times L2$. It is noted that if the potential of the latent image graduation is not a potential like a rectangular wave, a latent image graduation may be also of a potential in which a potential difference of maximum and minimum values of the potential to a midpoint potential is inverted to plus and minus per ½ period.

Still further, the relationship between the latent image graduation 50A and the latent image graduation 31C is set such that a half period of a latent image graduation whose pitch is long is an integer multiple of a pitch of a latent image graduation whose pitch is short as represented as $P1=P2/(2\times n)$ (n is a positive integer) or $P1=P2\times 2\times m$ (m is a positive integer). The relationship between the signal detecting portions 22A and 22B and the latent image graduations 50A and 31C is set such that the distance D between the signal detecting portions 22A and 22B is a half period of the latent image graduation whose pitch is long as represented as $D=P2/2$ when $P1<P2$ and $D=P1/2$ when $P1>P2$.

[Extraction of Detection Signal]

Next, an extraction of the detection signals of the latent image graduations 50A and 31C in the latent image sensor 34F will be explained by using FIGS. 22 through 25. In the present embodiment, the detection signal of the latent image graduation 50A and the detection signal of the latent image graduation 31C are extracted from two types of detection signals outputted by synthesizing detection signals of the two signal detecting portions 22A and 22B. Suppose here that the detection signals of the two signal detecting portions 22A and 22B as S1 and S2, the detection signal related to the latent image graduation 50A as M1, and the detection signal related to the latent image graduation 31C as M2. In this case, the detection signal extraction circuit 30 (see FIG. 25) described later processes the detection signals of the two signal detecting portions 22A and 22B such that the following conditions are met: M1=S1+S2 and M2=S1−S2 when P1<P2, and M1=S1−S2 and M2=S1+S2 when P1>P2. This process will be now explained in detail.

In FIG. 22, the photoconductive drum 12 is disposed at an upper part of the diagram and the intermediate transfer belt 24 is disposed at a lower part and the latent image sensor 34 not shown is interposed between them. In the latent image sensor 34F, the two signal detecting portions 22A and 22*b* are juxtaposed in the sub-scan direction. Here, the signal detecting portion 22A is disposed downstream in the sub-scan direction and the signal detecting portion 22B is disposed upstream in the sub-scan direction, respectively. Still further, the latent image graduation 31, i.e., the second mark, is formed on the photoconductive drum 12 and the latent image graduation 50A, i.e., the first mark, is formed on the intermediate transfer belt 24, respectively. A ratio of the pitch P2 of the latent image graduation 31C and the pitch P1 of the latent image graduation 50A is 1:2 (P1>P2), and their surface potentials are equalized.

Because a waveform detected by the signal detecting portion from the latent image graduation is inversely proportional to a distance between the signal detecting portion and the latent image graduation, the further the distance, the smaller the waveform becomes. Therefore, it is preferable to equalize a distance between the signal detecting portion 22A and the photoconductive drum 12 with a distance between the signal detecting portion 22B and the photoconductive drum 12. It is because it is preferable to equalize sizes of amplitudes of a detected waveform of the latent image graduation 31C in order to cancel the detected waveform of the latent image graduation 31C in extracting a detection signal of the latent image graduation 50A from a synthesized waveform of signals detected by the signal detecting portions 22A and 22B. In the same manner, it is preferable to equalize sizes of amplitudes of a detected waveform of the latent image graduation 50A in order to cancel the detected waveform of the latent image graduation 50A in extracting a detection signal of the latent image graduation 31C from a synthesized waveform of signals detected by the signal detecting portions 22A and 22B. Therefore, it is preferable to equalize a distance between the signal detecting portion 22A and the intermediate transfer belt 24 with a distance between the signal detecting portion 22B and the intermediate transfer belt 24.

However, the distance between the signal detecting portion 22A and the photoconductive drum 12 may be different from the distance between the signal detecting portion 22A and the intermediate transfer belt 24 as long as the abovementioned relationship of distance is held. It is noted that even if the abovementioned relationship of distance is not held, the sizes of the amplitudes of the detected waveform may be equalized by using an amplifier.

The extraction of the detection signal will be explained under a supposition that the photoconductive drum 12 and the intermediate transfer belt 24 are fixed and the latent image sensor 34F is moved at constant velocity to a right hand side in FIG. 22A for convenience of explanation. It is the same with a case where the photoconductive drum 12 and the intermediate transfer belt 24 are moved to a left hand side (the sub-scan direction) in FIG. 22A while fixing the latent image sensor 34F. Therefore, the signal detecting portion 22A is located downstream in the sub-scan direction and the signal detecting portion 22B is located upstream in the sub-scan direction, respectively, as described above.

A first mark detection waveform shown in FIG. 22A is a waveform of a detection signal of the latent image graduation 50A, i.e., a first mark, to be obtained by extracting by the latent image sensor 34F. A second mark detection waveform is a waveform of a detection signal of the latent image graduation 31C, i.e., a second mark, to be obtained by extracting by the latent image sensor 34F. A mark detection signal A is a waveform of a detection signal (S1) actually detected by the signal detecting portion 22A. A mark detection signal B is a waveform of a detection signal (S2) actually detected by the signal detecting portion 22B. A waveform of an A+B signal is obtained by adding the mark detection signals A and B (S1+S2). A waveform of an A−B signal is obtained by subtracting the mark detection signal B from the mark detection signal A (S1−S2).

Here, because the relationship between the pitch P2 of the latent image graduation 31C and the pitch P1 of the latent image graduation 50A is P1>P2 in the present embodiment, the detection signal extraction circuit 30 processes the detection signals such that the following conditions are met: M1=S1−S2 and M2=S1+S2. Accordingly, the A+B signal (S1+S2) corresponds to the detection signal M2 and the A−B signal (S1−S2) corresponds to the detection signal M1.

It is noted that while an axis of abscissa of each waveform shown in FIG. 22A through and 22C represents time, the position of the signal detecting portion 22A is arranged to coincide with the time. FIGS. 22A through 22C also show the positions of the signal detecting portions 22A and 22B when the time is t1. The principle of detection of the latent image graduations (marks) described above in connection with FIG. 2 also applies to the following explanation.

[Time t1]

At time t1, because mark starting portions (front edges in the conveying direction of the marks) of the latent image graduation 50A and 31C are both detected by the signal detecting portion 22A, a double voltage is outputted on a plus side as the mark detection signal A. Meanwhile, the mark starting portion of the latent image graduation 31C and a mark ending portion (rear edge in the conveying direction of the mark) of the latent image graduation 50A are detected by the signal detecting portion 22B. Therefore, because potentials of the two marks are equal and their distances are also equal, they are canceled with each other and 0 (V) is outputted as the mark detection signal B. Because the mark detection signal B is 0 (V), the mark detection signal A is outputted as it is in the A+B signal. Because the mark detection signal B is 0 (V), the mark detection signal A is outputted as it is also in the A−B signal.

[Time t2]

At time t2, because the mark ending portion of the latent image graduation 31C is detected by the signal detecting portion 22A, a minus side voltage is outputted as the mark detection signal A. Meanwhile, the mark ending portion of the latent image graduation 31C is detected by the signal detecting portion 22B, a minus side voltage is outputted as the mark detection signal B. Because the mark detection signals A and B are both the minus side voltages, a double voltage is outputted on the minus side in the A+B signal. 0 (V) is outputted in the A−B signal because the mark detection signals A and B are both the minus side voltage and are cancelled.

[Time t3]

At time t3, the mark starting portion of the latent image graduation 31C and the mark ending portion of the latent image graduation 50A are detected by the signal detecting portion 22A. Therefore, 0 (V) is outputted as the mark detection signal A because the two marks are canceled with each other as potentials of the two marks are equal and their distances are also equal. Meanwhile, because the mark starting portions of the latent image graduation 31C and the latent image graduation 50A are both detected by the signal detecting portion 22B, a double voltage is outputted on the plus side as the mark detection signal B. Because the mark detection signal A is 0 (V), the mark detection signal B is outputted as it is in the A+B signal. Because the mark detection signal A is 0 (V), a double voltage is outputted on the minus side in which a polarity of voltage of the mark detection signal B is reversed in the A−B signal.

[Time t4]

At time t4, because the mark ending portion of the latent image graduation 31C is detected by the signal detecting portion 22A, a minus side voltage is outputted as the mark detection signal A. Meanwhile, because the mark ending portion of the latent image graduation 31C is detected by the signal detecting portion 22B, a minus side voltage is outputted as the mark detection signal B. Because the mark detection signals A and B are both the minus side voltages, a double voltage is outputted on the minus side in the A+B signal. Because the mark detection signals A and B are both the minus side voltages, they are canceled and 0 (V) is outputted in the A−B signal.

The A+B signal and the A−B signal are outputted as described above. At this time, the A+B signal has a waveform similar to the second mark detection waveform (signal). Similarly to that, the A−B signal has a waveform similar to the first mark detection waveform (signal). That is, the second mark detection signal is extracted by adding the mark detection signals A and B. In the same manner, the first mark detection signal is extracted by subtracting the mark detection signal B from the mark detection signal A. Accordingly, because the A+B signal (S1+S2) corresponds to the detection signal M2 and the A−B signal (S1−S2) corresponds to the detection signal M1 as described above, the second mark detection signal turns out to be the detection signal M2 and the first mark detection signal to be the detection signal M1.

It is noted that although the outputs of the A+B signal and the A−B signal are set at the double voltage so that the calculation is understandable, it is preferable to set at a voltage of 1 time by attenuating the output voltage. However, the following explanations will be made by exemplifying waveforms that do not attenuate so that calculations will be understandable in the following embodiments.

Still further, in the case of the present embodiment, the positions in the sub-scan direction of the signal detecting portions 22A and 22B may switched. In such a case, the waveforms of the mark detection signals A and B are also switched in FIG. 22B. As a result, plus and minus of the waveform of the A−B signal (S1−S2)=M1 is reversed from the waveform of the first mark detection signal in FIG. 22A. The A−B signal may be handled in the same manner with the first mark detection signal even in such case because positions of peaks in the waveform of the A−B signal are located at the same positions with those in the waveform of the first mark detection signal.

Figures 23A, 23B, 23C:
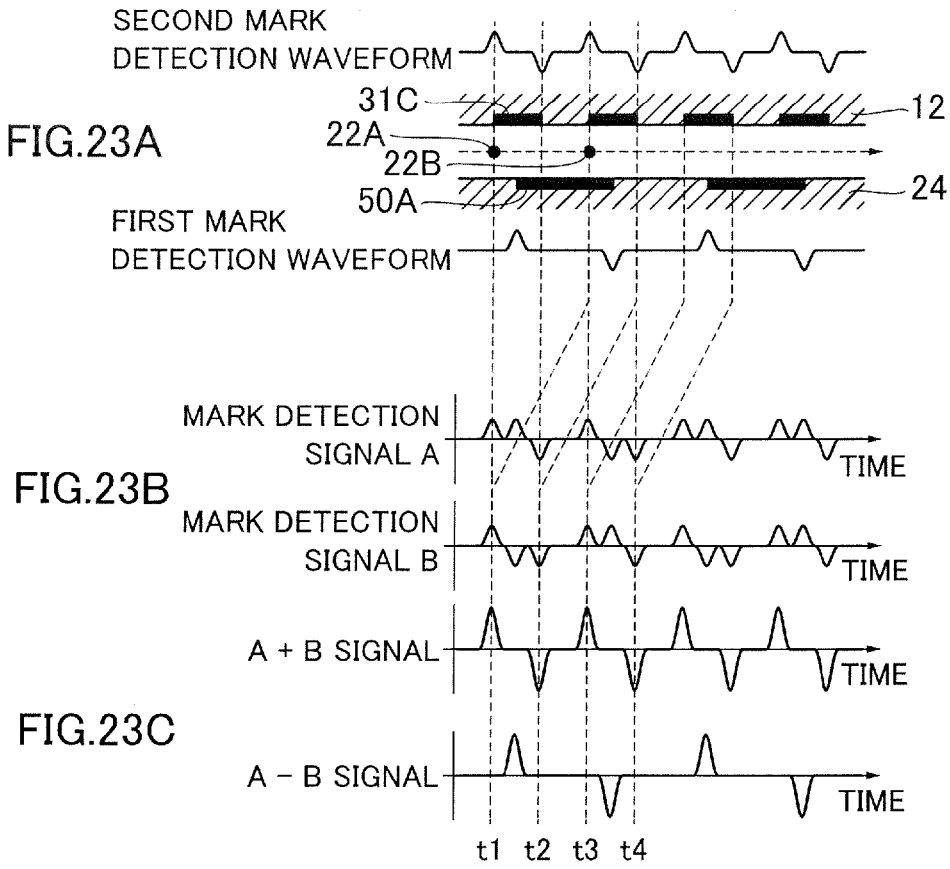
FIG. 23A is a schematic diagram, similar to FIG. 22A, showing a case where phases of the first and second marks are shifted.
FIG. 23B is a chart, also similar to FIG. 22B, showing the waveforms in the case in FIG. 23A.
FIG. 23C is a chart, also similar to FIG. 22C, represented by adding and subtracting those waveforms.

FIGS. 23A through 23C are charts in which phases of the latent image graduation 50A (first mark) and the latent image graduation 31C (second mark) are different from those in FIGS. 22A through 22C. Because the phases of the two marks are shifted and mark starting portions and mark ending portions of all the marks are detected, mark detection signals A and B are more complicated in FIG. 23B than those in FIG. 22B. However, extracted first and second mark detection signals have waveforms identical to those of first and second mark detection waveforms, respectively. Accordingly, it can be seen that the extraction can be made regardless of the phases of the two marks.

Figures 24A, 24B, 24C:
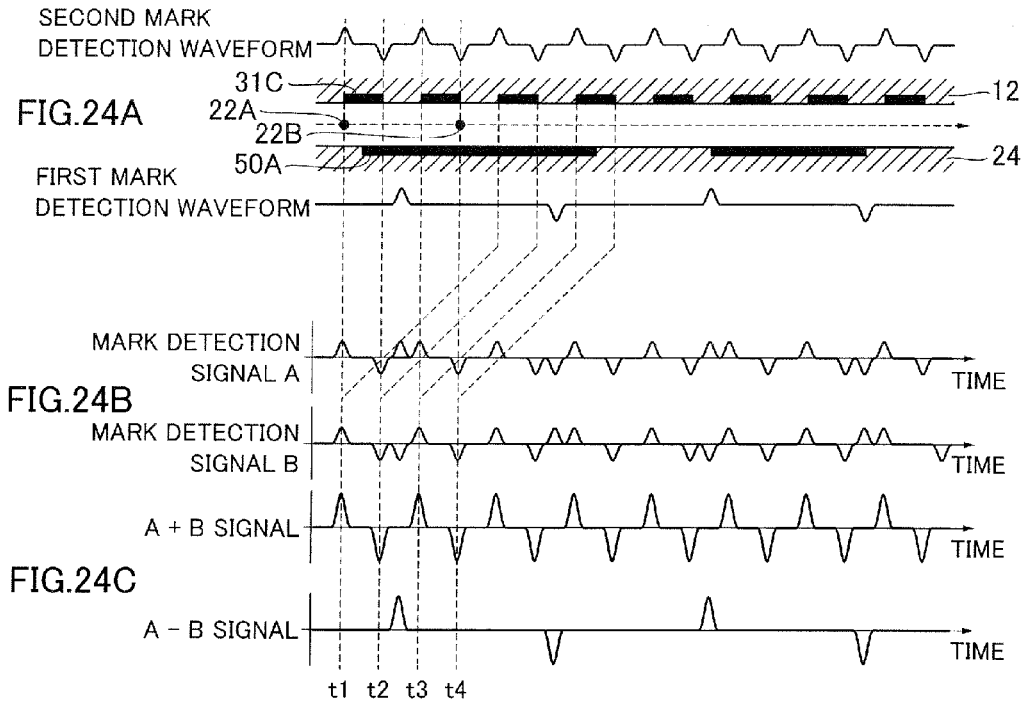
FIG. 24A is a schematic diagram, similar to FIG. 22A, showing a case where the phases of the first and second marks are shifted and a pitch of the second mark is twice a pitch of the first mark.
FIG. 24B is a chart, also similar to FIG. 22B, showing the waveforms in the case in FIG. 24A.
FIG. 24C is a chart, also similar to FIG. 22C, represented by adding and subtracting those waveforms.

FIG. 24 is a chart showing a case where the pitch of the latent image graduation 50A (first mark) is doubled further. It can be seen that the extraction of the two marks can be made even in this case, though its detailed explanation is omitted here.

Figure 25:
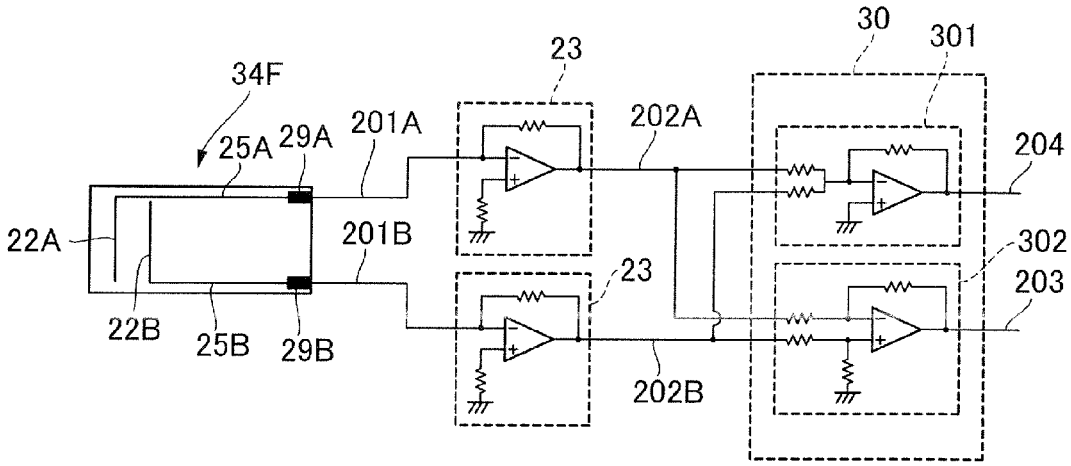
FIG. 25 is a circuit diagram for extracting a detection signal of the latent image sensor of the sixth embodiment.

FIG. 25 is a circuit diagram configured to extract the detection signals detected as described above. A mark detection current signal 201A detected by the signal detecting portion 22A and a mark detection current signal 201B detected by the signal detecting portion 22B are converted from the current signals into voltage signals by current/voltage conversion circuits 23, respectively. Then, the detection signal of the signal detecting portion 22A is outputted of the current/voltage conversion circuit 23 as a mark detection signal 202A converted into the voltage signal and the detection signal of the signal detecting portion 22B is outputted of the current/voltage conversion circuit 23 as a mark detection signal 202B converted into the voltage signal, respectively.

These mark detection signals 202A and 202B are processed by the detection signal extraction circuit 30, i.e., an information processing portion. The detection signal extraction circuit 30 includes an adding circuit 301 and a subtracting circuit 302. The signal processed by the adding circuit 301 is outputted as a second mark detection signal 204. The signal processed by the subtracting circuit 302 is outputted as a first mark detection signal 203. That is, in the detection signal extraction circuit 30, the mark detection signal 202A detected by the signal detecting portion 22A and the mark detection signal 202B detected by the signal detecting portion 22B are added in the adding circuit 301 to extract the second mark detection signal 204. In the same manner, the subtraction is carried out between the mark detection signal 202A detected by the signal detecting portion 22A and the mark detection signal 202B detected by the signal detecting portion 22B in the subtracting circuit 302 to extract the first mark detection signal 203. It is noted that parts such as a register and a capacitor which need not to be explained in the explanation here are omitted in the circuit diagram. For the same reason, a value of the resistor is omitted.

[Correction of Color Shift]

Figure 26:
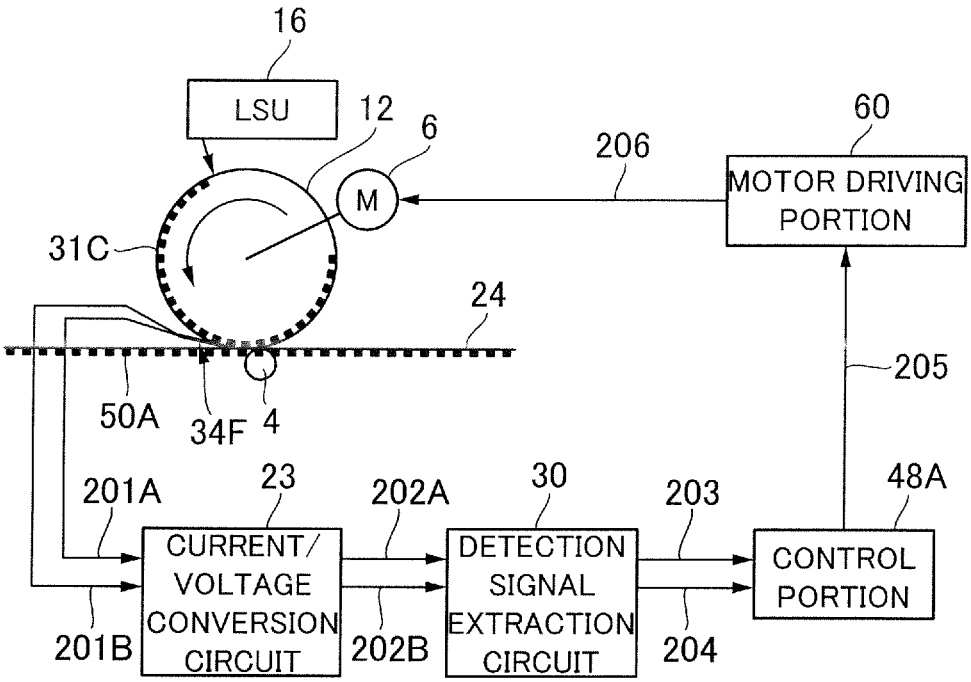
FIG. 26 is a block diagram illustrating a control in correcting a color shift according to the sixth embodiment.
Figure 27:
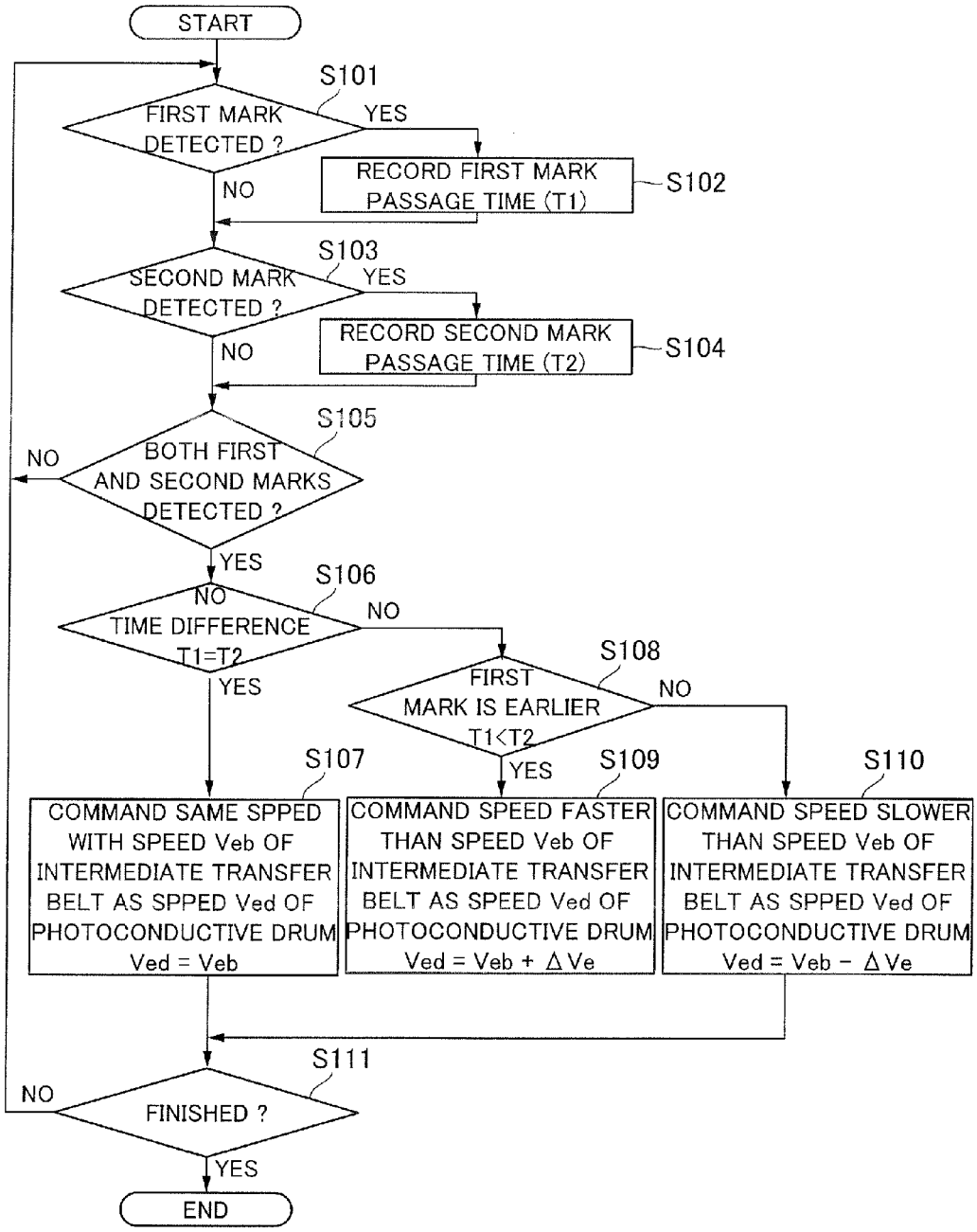
FIG. 27 is a control flowchart in correcting the color shift according to the sixth embodiment.

Next, a method for correcting a color shift by the two mark detection signals extracted as described above will be explained by using FIG. 26. As shown in FIG. 26, the latent image graduation 50A, i.e., the first mark, is formed on the intermediate transfer belt 24, and the latent image graduation 31C, i.e., the second mark, is formed on the photoconductive drum 12 by the exposure unit 16. The photoconductive drum 12 is rotationally driven by the drum driving motor 6. It is noted that a toner image formed in the image region of the photoconductive drum 12 is transferred to the intermediate transfer belt 24 by the primary transfer roller 4.

The latent image sensor 34F is nipped between the photoconductive drum 12 and the intermediate transfer belt 24. The mark detection current signals 201A and 201B detected by the signal detecting portions 22A and 22B (not shown in FIG. 26) of the latent image sensor 34F are converted from the current signals into the voltage signals by the current/voltage conversion circuit 23 and are outputted as the mark detection signals 202A and 202B. At this time, amplification is carried out such that sizes of the converted voltage signals are equalized. The mark detection signals 202A and 202B are extracted by the detection signal extraction circuit 30 as first and second mark detection signals 203 and 204.

The first and second mark detection signals 203 and 204 extracted by the detection signal extraction circuit 30 are sent to a control portion 48A. The control portion 48A calculates a position shift amount (color shift amount) from a time lag between the first and second mark detection signals 203 and 204. Then, the control portion 48A outputs a speed command signal 205 to a motor driving portion 60 such that this shift amount is zeroed, i.e., such that phases of the detection signals M1 and M2 described above coincide. That is, the speed of the photoconductive drum 12 is calculated in order to zero the shift amount. For instance, when the latent image graduation 31C formed on the photoconductive drum 12 is slower than the latent image graduation 50A, a speed faster than that of the intermediate transfer belt 24 is commanded as the speed of the photoconductive drum 12. Then, when the latent image graduation 31C catches up the latent image graduation 50A and the time lag is eliminated, the same speed with that of the intermediate transfer belt 24 is commanded as the speed of the photoconductive drum 12.

In accordance to the speed command signal 205, the motor driving portion 60 outputs a drum driving signal 206 to the drum driving motor 6, and in accordance to the drum driving signal 206, the drum driving motor 6 rotationally drives the photoconductive drum 12. At this time, the photoconductive drum 12 is driven such that a speed difference between the photoconductive drum 12 and the intermediate transfer belt 24 becomes a speed difference defined in advance in order to improve efficiency of the primary transfer of the toner image.

[Control Flow of Correction of Color Shift]

Next, a flow of a control for correcting a color shift of the present embodiment will be explained by using FIGS. 27 through 30. At first, the control flow will be schematically explained by using FIG. 27. As described above, passages of the latent image graduations 50A (first mark) and 31C (second mark) are monitored by the signal detecting portions 22A and 22B of the latent image sensor 34F. That is, the passage of the first mark is detected from the first and second mark detection signals 203 and 204 extracted by the detection signal extraction circuit in Step 101, and if the passage of the first mark is detected, a time T1 when the first mark has passed is recorded in Step 102. Next, the passage of the second mark is detected in Step 103, and if the passage of the second mark is detected, a time T2 when the second mark has passed is recorded in Step 104. The abovementioned steps are repeated until when both the first and second marks are detected in Step 105. Then, the times when the passages of the first and second marks have been detected are compared in Step 106.

If the times when the first and second marks have passed are the same time (T1=T2) in Step 106, the same speed with a speed Veb of the intermediate transfer belt 24 is commanded as a speed Ved1 of the photoconductive drum 12 (Ved1=Veb) in Step 107. If the first mark (the latent image graduation 50A) of the intermediate transfer belt 24 has passed earlier than the second mark (T1<T2), i.e., Yes in Step 108, a speed faster than the speed Veb of the intermediate transfer belt 24 is commanded as a speed Ved2 of the photoconductive drum 12 (Ved2=Veb+ΔVe) in Step 109. If the first mark of the intermediate transfer belt 24 has passed late (T1>T2), i.e., No in Step 108, a speed slower than the speed Veb of the intermediate transfer belt 24 is commanded as a speed Ved3 of the photoconductive drum 12 (Ved3=Veb−ΔVe) in Step 110. This flow is finished when the image forming process ends in Step 111.

[Specific Example of Control of Correction of Color Shift]

While the flow of the control in correcting a color shift of the present embodiment has been schematically explained above with reference to FIG. 27, such control will be explained specifically by using FIGS. 28 through 30. FIGS. 28 and 29 are charts showing positional relations between the latent image graduations 50A and 31C, i.e., the two marks, and the two signal detecting portions 22A and 22B at times t1 through t10. It is noted that FIGS. 28 and 29 show a case where the signal detecting portions 22A and 22B are fixed and the photoconductive drum 12 and the intermediate transfer belt 24 move in the right hand side in FIGS. 28 and 29. Parts surrounded by circles in FIGS. 28 and 29 indicate positions where phases of the first mark detection signal (A−B) and the second mark detection signal (A+B) are to be matched by the control portion 48A.

Figures 30A, 30B, 30C:
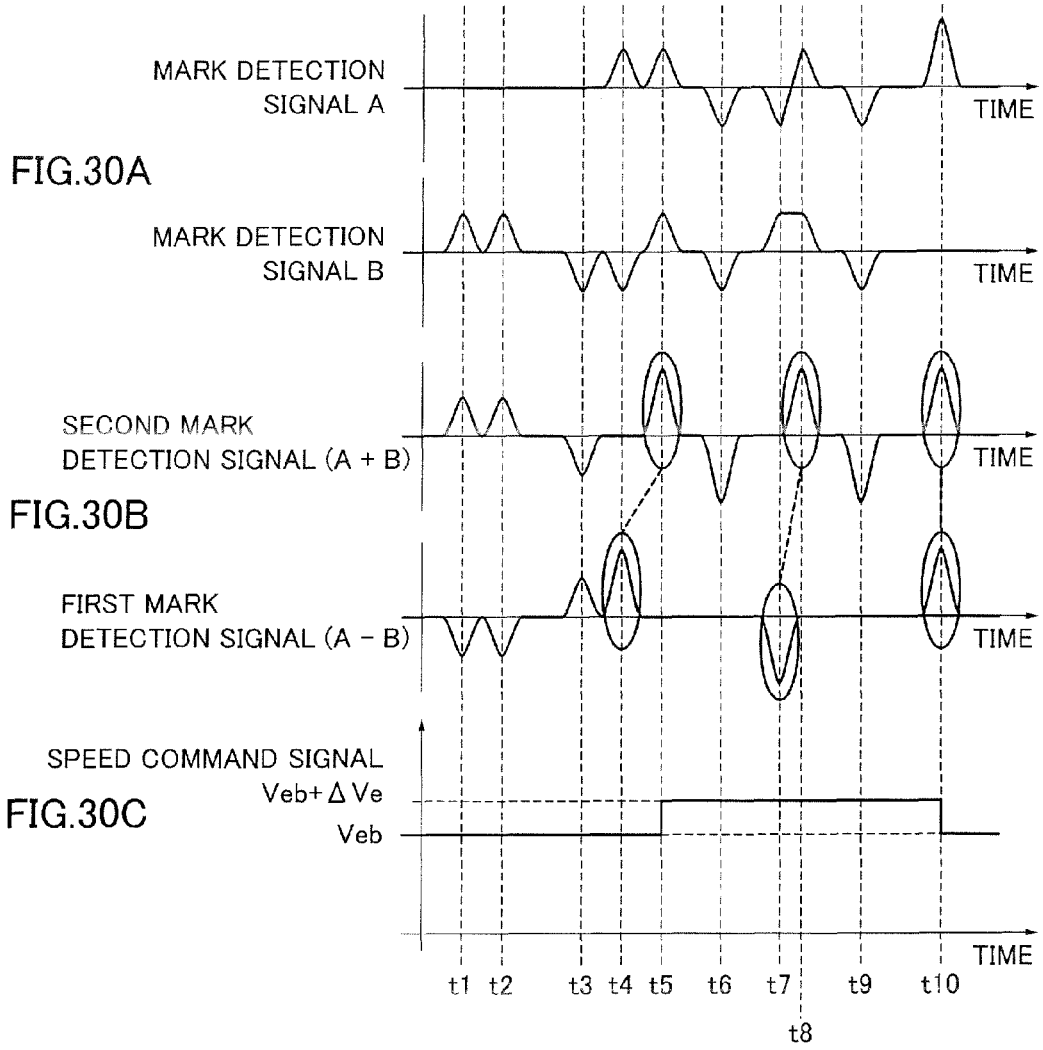
FIG. 30A is a schematic diagram showing the waveforms of the two signal detecting portions in FIGS. 28 and 29 by matching time bases.
FIG. 30B is a chart represented by adding (first mark detection signal) and subtracting (second mark detection signal) these waveforms.
FIG. 30C is a chart showing a speed command signal to the photoconductive drum in the case of FIG. 30B.

FIGS. 30A and 30B are charts showing waveforms of the respective signals, wherein FIG. 30A shows the waveforms of the mark detection signal A detected by the signal detecting portion 22A and a mark detection signal B detected by the signal detecting portion 22B, and FIG. 30B shows the waveforms of a second mark detection signal (A+B) extracted from the two mark detection signals and a first mark detection signal (A−B) extracted from the two mark detection signals. FIG. 30C shows a waveform of a speed command signal applied to the photoconductive drum 12 to correct a color shift.

Figure 28A:
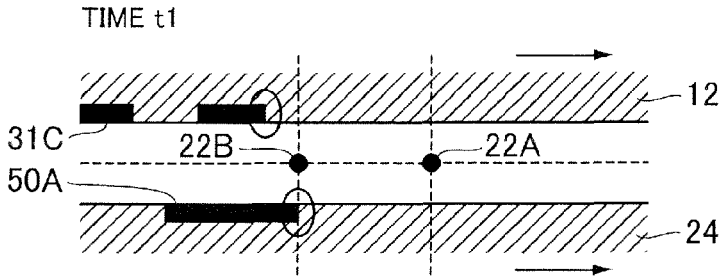
FIG. 28A is a schematic diagram illustrating a positional relation between the two signal detecting portions and the first and second marks at time t1 when the photoconductive drum and the intermediate transfer belt are moved to the right hand side in FIG. 28A in a control in correcting a color shift in the sixth embodiment.

As shown in FIG. 28A, time t1 is a time when a first one of the latent image graduation 50A has arrived at the signal detecting portion 22B. As indicated at time t1 in FIG. 30, a signal is outputted on the plus side only in the mark detection signal B. Because the detection signal extraction circuit 30 extracts signals by executing simple addition and subtraction, the detection signal extraction circuit 30 cannot accurately extract the signals if both of the two detecting portions do not detect the marks. Because the signal detecting portion 22A does not detect a first one of the mark yet, the control portion 48A does not execute a phase matching control. Accordingly, the speed Veb of the intermediate transfer belt 24 is outputted as a speed command signal of the photoconductive drum 12.

Figure 28B:
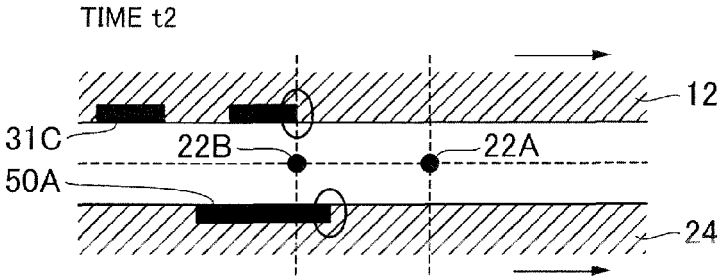
FIG. 28B is a schematic diagram, similar to FIG. 28A, illustrating the positional relation at time t2.

As shown in FIG. 28B, time t2 is a time when a first one of the latent image graduation 31C has arrived at the signal detecting portion 22B. As indicated at time t2 in FIG. 30, a signal is outputted on the plus side only in the mark detection signal B. Because the signal detecting portion 22A does not detect a first one of the mark yet, the control portion 48A does not execute the phase matching control. Accordingly, the speed Veb of the intermediate transfer belt 24 is successively outputted as the speed command signal of the photoconductive drum 12.

Figure 28C:
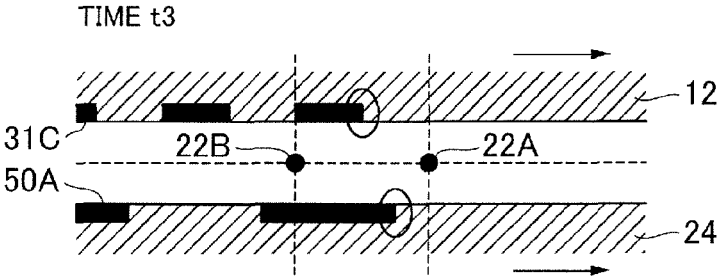
FIG. 28C is a schematic diagram, similar to FIG. 28A, illustrating the positional relation at time t3.

As shown in FIG. 28C, time t3 is a time when the first one of the latent image graduation 31C has passed through the signal detecting portion 22B. As indicated at time t3 in FIG. 30, a signal is outputted on the minus side only in the mark detection signal B. Because the signal detecting portion 22A does not detect a first one of the mark yet, the control portion 48A does not execute the phase matching control. Accordingly, the speed Veb of the intermediate transfer belt 24 is successively outputted as the speed command signal of the photoconductive drum 12.

Figure 28D:
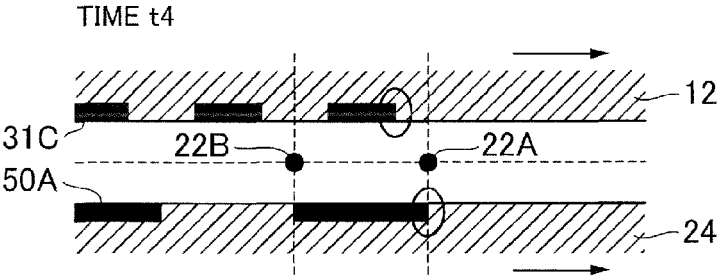
FIG. 28D is a schematic diagram, similar to FIG. 28A, illustrating the positional relation at time t4.

As shown in FIG. 28D, time t4 is a time when the first one of the latent image graduation 50A has arrived at the signal detecting portion 22A and has passed through the signal detecting portion 22B. As indicated at time t4 in FIG. 30, a signal is outputted on the plus side in the mark detection signal A, and a signal is outputted on the minus side in the mark detection signal B. Because the mark detection signal A is a plus signal and the mark detection signal B is a minus signal, the mark detection signals A and B are canceled in the second mark signal and a signal thereof is kept to be zero. That is, this case coincides with the case where the latent image graduation 31C (second mark) has not arrived at the signal detecting portion 22A. Meanwhile, because the second mark detection signal is outputted on the plus side, this time t4 is recorded as a time when the first one of the latent image graduation 50A (first mark) is detected. Because the two signal detecting portions 22A and 22B detect the marks, respectively, and the signals corresponding to the first and second marks can be detected, the control portion 48A starts the phase matching control. Because only the first mark is detected at this time, the speed Veb of the intermediate transfer belt 24 is successively outputted as the speed command signal of the photoconductive drum 12.

Figure 28E:
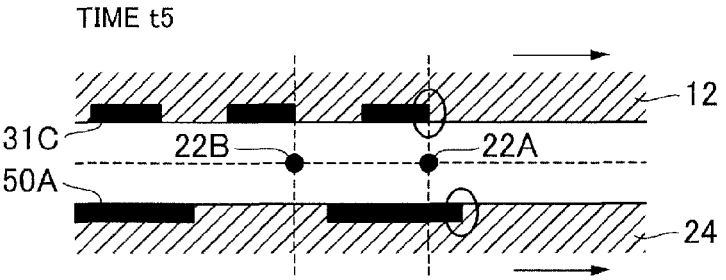
FIG. 28E is a schematic diagram, similar to FIG. 28A, illustrating the positional relation at time t5.

As shown in FIG. 28E, time t5 is a time when the first one of the latent image graduation 31C has arrived at the signal detecting portion 22A and a second one of the latent image graduation 31C has arrived at the signal detecting portion 22B. As indicated at time t5 in FIG. 30, a signal is outputted on the plus side in the mark detection signal A and a signal is outputted on the plus side also in the mark detection signal B. Because the mark detection signal A is a plus signal and the mark detection signal B is also a plus signal, a plus signal is outputted in the second mark detection signal, and the mark detection signals A and B are canceled and no signal is outputted in the first mark detection signal. Because the second mark detection signal is outputted on the plus side, this time t5 is recorded as a time when the first one of the latent image graduation 31C (second mark) is detected.

Because both the first and second marks have been detected, the control portion 48A compares the two times (t4 and t5). Here, because the passage time t5 of the second mark is later than the passage time t4 of the first mark, a speed Veb+ΔVe faster than the speed Veb of the intermediate transfer belt 24 by ΔVe is outputted as a speed command signal of the photoconductive drum 12. ΔVe is a speed calculated in accordance to speed or a time difference determined in advance.

Figure 29A:
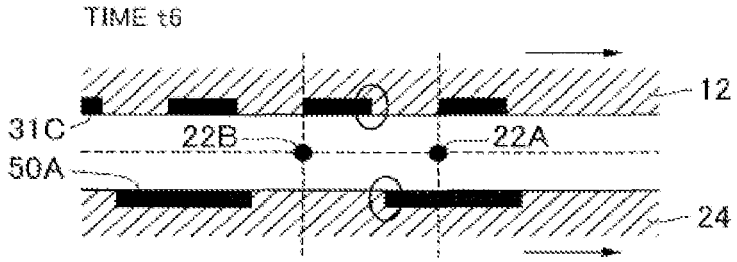
FIG. 29A is a schematic diagram illustrating the positional relation between the two signal detecting portions and the first and second marks at time t6.

As shown in FIG. 29A, time t6 is a time when the first one of the latent image graduation 31C has passed through the signal detecting portion 22A and the second one of the latent image graduation 31C has passed through the signal detecting portion 22B. As indicated at time t6 in FIG. 30, a signal is outputted on the minus side in the mark detection signal A and a signal is outputted on the minus side also in the mark detection signal B. Because the signals of the mark detection signals A and B are minus signals, a minus signal is outputted in the second mark detection signal, and the mark detection signals A and B are canceled and no signal is outputted in the first mark detection signal. Although the second mark detection signal is outputted on the minus side, there is no position on the side of the first mark to be matched with the second mark because the pitch of the first mark (the latent image graduation 50A) is twice the pitch of the second mark (the latent image graduation 31C). Accordingly, the minus side signal of the second mark detection signal is neglected. Because nothing is detected in the first mark detection signal, the speed Veb+ΔVe determined at the time t5 is successively outputted as the speed command signal of the photoconductive drum 12.

Figure 29B:
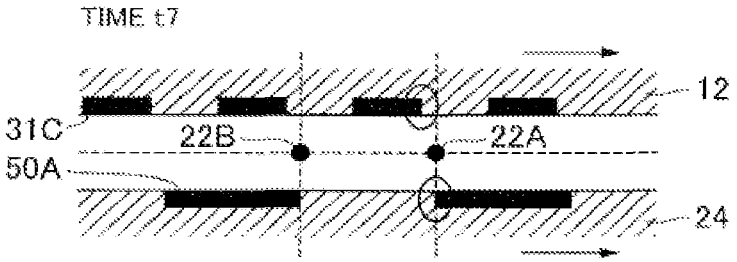
FIG. 29B is a schematic diagram, similar to FIG. 29A, illustrating the positional relation at time t7.

As shown in FIG. 29B, time t7 is a time when the first one of the latent image graduation 50A has passed through the signal detecting portion 22A and a second one of the latent image graduation 50A has arrived at the signal detecting portion 22B. As indicated at time t7 in FIG. 30, a signal is outputted on the minus side in the mark detection signal A and a signal is outputted on the plus side in the mark detection signal B. Because the mark detection signal A is a minus signal and the mark detection signal B is a plus signal, they are canceled and no signal is outputted as the second mark detection signal and a minus signal is outputted as the first mark detection signal. Because the first mark detection signal is outputted on the minus side, this time t7 is recorded as a time when the second one of the first mark is detected. Because the second one of only the first mark is detected at this time, the speed Veb+ΔVe is successively outputted as the speed command signal of the photoconductive drum 12.

Figure 29C:
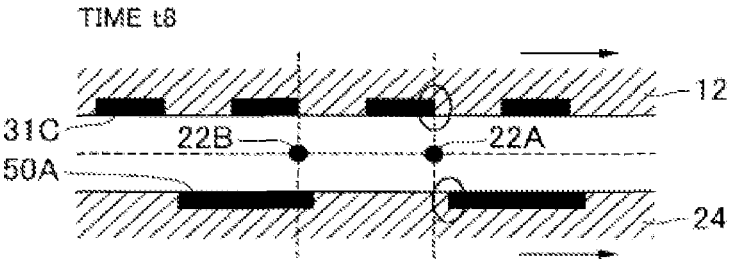
FIG. 29C is a schematic diagram, similar to FIG. 29A, illustrating the positional relation at time t8.

As shown in FIG. 29C, time t8 is a time when the second one of the latent image graduation 31C has arrived at the signal detecting portion 22A and a third one of the latent image graduation 31C has arrived at the signal detecting portion 22B. As indicated at time t8 in FIG. 30, a signal is outputted on the plus side in the mark detection signal A and a signal is outputted on the plus side also in the mark detection signal B. Because the mark detection signal A is a plus signal and the mark detection signal B is also a plus signal, a plus signal is outputted in the second mark detection signal, and the mark detection signals A and B are canceled and no signal is outputted in the first mark detection signal. Because the second mark detection signal is outputted on the plus side, this time t8 is recorded as a time when the second one of the second mark is detected. Because the second ones of both the first and second marks are detected, the control portion 48A compares the two times (t7 and t8). Here, because the passage time t8 of the second mark is later than the passage time t7 of the first mark, the speed Veb+ΔVe which is faster than the speed Veb of the intermediate transfer belt 24 by ΔVe is successively outputted as the speed command signal of the photoconductive drum 12.

Figure 29D:
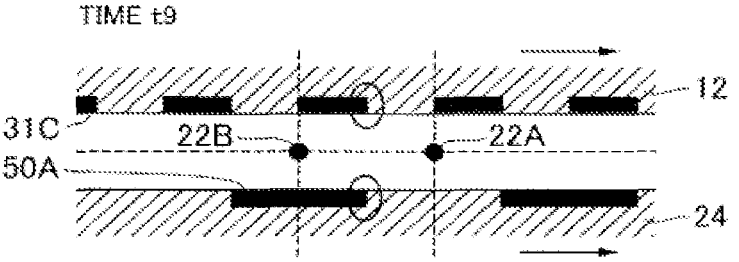
FIG. 29D is a schematic diagram, similar to FIG. 29A, illustrating the positional relation at time t9.

As shown in FIG. 29D, time t9 is a time when the second one of the latent image graduation 31C has passed through the signal detecting portion 22A and the third one of the latent image graduation 31C has passed through the signal detecting portion 22B. As indicated at time t9 in FIG. 30, a signal is outputted on the minus side in the mark detection signal A and a signal is outputted on the minus side also in the mark detection signal B. Because the mark detection signal A is a minus signal and the mark detection signal B is also a minus signal, a minus signal is outputted as the second mark detection signal and the mark detection signals A and B are canceled and no signal is outputted as the first mark detection signal. The minus side of the second mark detection signal is neglected because there is no position to be matched with the first mark side. Because nothing is detected in the first mark detection signal, the speed Veb+ΔVe is successively outputted as the speed command signal of the photoconductive drum 12.

Figure 29E:
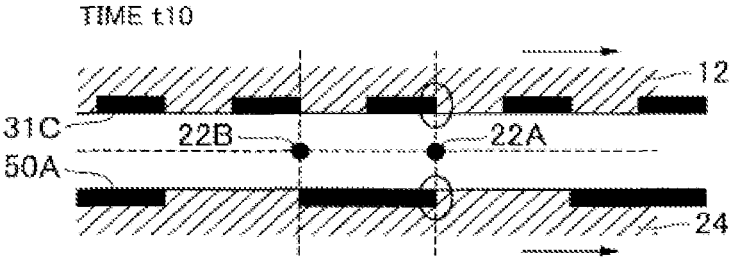
FIG. 29E is a schematic diagram, similar to FIG. 29A, illustrating the positional relation at time t10.

As shown in FIG. 29E, time t10 is a time when the third one of the latent image graduation 31C and the second one of the latent image graduation 50A have arrived at the signal detecting portion 22A in the same time. It is also a time when a fourth one of the latent image graduation 31C has arrived at the signal detecting portion 22B and the second one of the latent image graduation 50A has passed through the signal detecting portion 22B. As indicated at time t10 in FIG. 30, a signal is outputted on the plus side in the mark detection signal A, and no signal is outputted as the mark detection signal B because the mark detection signals A and B are canceled. Because the mark detection signal A is a plus signal and the mark detection signal B is zero, the second mark detection signal outputs a plus signal and the first mark detection signal also outputs a plus signal. Because the second mark detection signal is outputted to the plus side, this time t10 is recorded as a time when the third one of the second mark is detected. Still further, because the first mark detection signal is also outputted to the plus side, this time t10 is also recorded when the third ones of first mark is detected. Because both the third one of the marks are detected at this time, the control portion 48A compares the two times. Then, because the first mark passage times t10 and the second mark passage time t10 are the same time, the speed Veb of the intermediate transfer belt 24 is outputted as the speed command signal of the photoconductive drum 12. That is, because the photoconductive drum 12 has caught up the intermediate transfer belt 24, the speed of the photoconductive drum 12 is returned to the speed equal to that of the intermediate transfer belt 24. Thus, the correction of the color shift is made by matching the phases as described above.

The present embodiment as described above also makes it possible to obtain a high quality image because a color shift can be reduced. It is also possible to detect the two marks on the photoconductive drum 12 side and on the intermediate transfer belt 24 side by the latent image sensor 34F integrally holding the two signal detecting portions 22A and 22B and provided one each in each image forming portion. Therefore, maintainability is improved by requiring no works of adjustment of positions in the sub-scan direction and of readjustment required due to elapsed changes otherwise carried out in mounting two sensors when the two sensors are installed to detect the respective marks.

Still further, because the layer structure composing the sensor can be realized by the mono-layer structure in the same manner with a sensor having only one detecting portion in the manufacturing process of the latent image sensor 34F, it is possible to manufacture the latent image sensor 34F in which the two signal detecting portions are integrated without changing a manufacturing process. Due to that, it is possible to suppress an increase of a manufacturing cost of the latent image sensor 34 itself. The circuits for extracting the two signals can be also realized at a low cost because they can be realized by a combination of the simple and inexpensive arithmetic circuits of addition and subtraction of the two signals. The other configurations and operations are the same with those of the first embodiment described above.

Seventh Embodiment

A seventh embodiment of the present invention will be described below by using FIGS. 31 through 42. The two mark detection signals are extracted from the signals of the two signal detecting portions in the sixth embodiment described above. Whereas, the present embodiment is arranged such that two mark detection signals are extracted from signals of four signal detecting portions 22A, 22B, 22C and 22D. That is, the present embodiment is characterized in that it becomes possible to remove external noise, which has been difficult to remove in the sixth embodiment, by extracting the mark detection signals from the signals of the four signal detecting portions.

The external noise will be explained at first. The charging roller, the developing unit, the primary transfer roller, the cleaning unit and the like to which high voltage is applied are disposed around the photoconductive drum 12. A part of the voltage may be AC or a polarity of the voltage may be inversed between consecutive images. This high voltage fluctuation may mix into a plurality of signal detecting portions as noises of identical waveforms by transmitting through the photoconductive drum. This noise is the external noise.

Figures 31A, 31B, 31C:
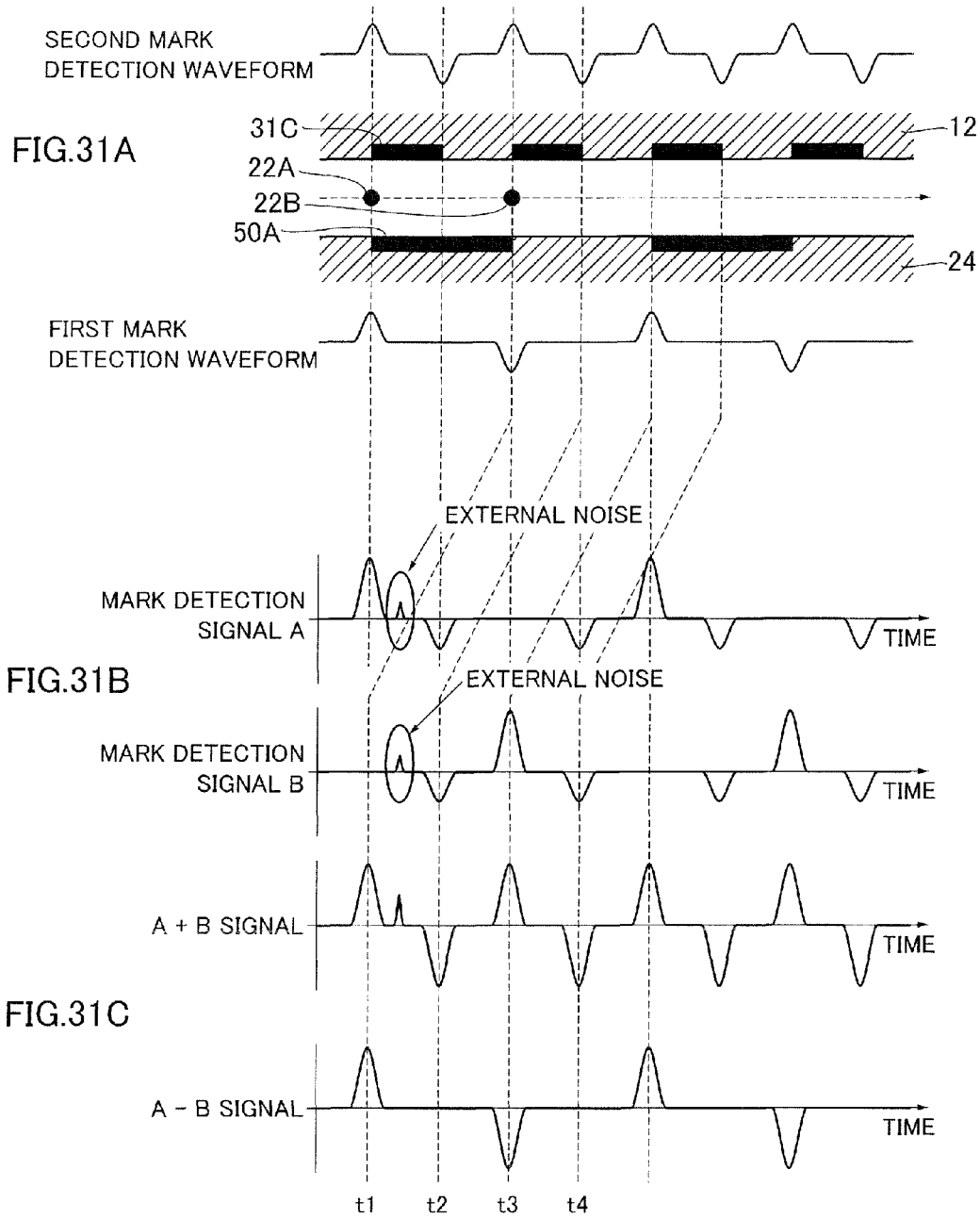
FIG. 31A is a schematic diagram showing detected waveforms of the first and second marks when the two signal detecting portions of the latent image sensor are moved to the right hand side in FIG. 31A.
FIG. 31B is a chart showing waveforms of the respective detecting portions when an external noise is mixed in the case in FIG. 31A by matching time bases.
FIG. 31C is a chart represented by adding and subtracting those waveforms.

FIGS. 31A through 31C are charts showing exemplary waveforms in the chart in FIG. 22, shown in connection with the sixth embodiment described above, into which the external noises are mixed. Waveforms circled in FIG. 31 are the external noises, and the noises of the identical waveforms mix into two mark detection signals at the same time. Because the A+B signal is formed by adding two signals, the external noises are also added in the same manner. Because the A−B signal is formed by subtracting the two signals, the external noises can be removed. Thus, the external noises amplified by two times mix into the extracted second mark detection signal (A+B) in the sixth embodiment. The external noise causes an error in the passage time of the second mark and drops accuracy of the phase matching control.

Then, in order to include a subtraction in extracting the second mark detection signal, the present embodiment is arranged such the extraction of the second mark detection signal is executed by providing the four signal detecting portions and by combining the subtraction and addition of the four signals. It is noted that because the external noise can be removed from the first mark detection signal also in the sixth embodiment, the extraction of the first mark detection signal is executed from signals of the two signal detecting portions also in the present embodiment.

Figure 32:
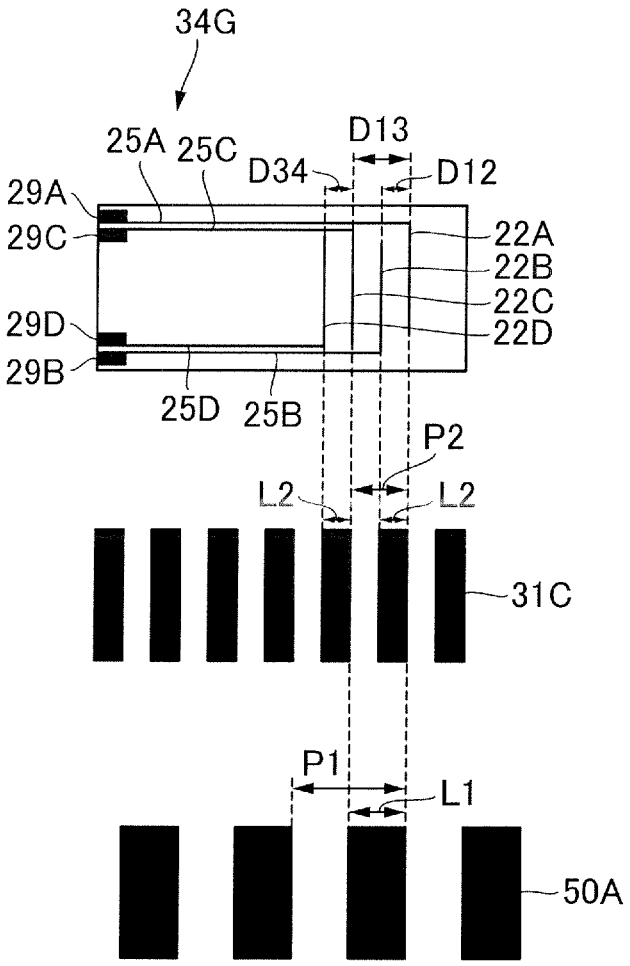
FIG. 32 is a schematic diagram illustrating one exemplary relationship between four signal detecting portions of a latent image sensor and pitches of first and second marks according to a seventh embodiment of the invention.
Figure 33:
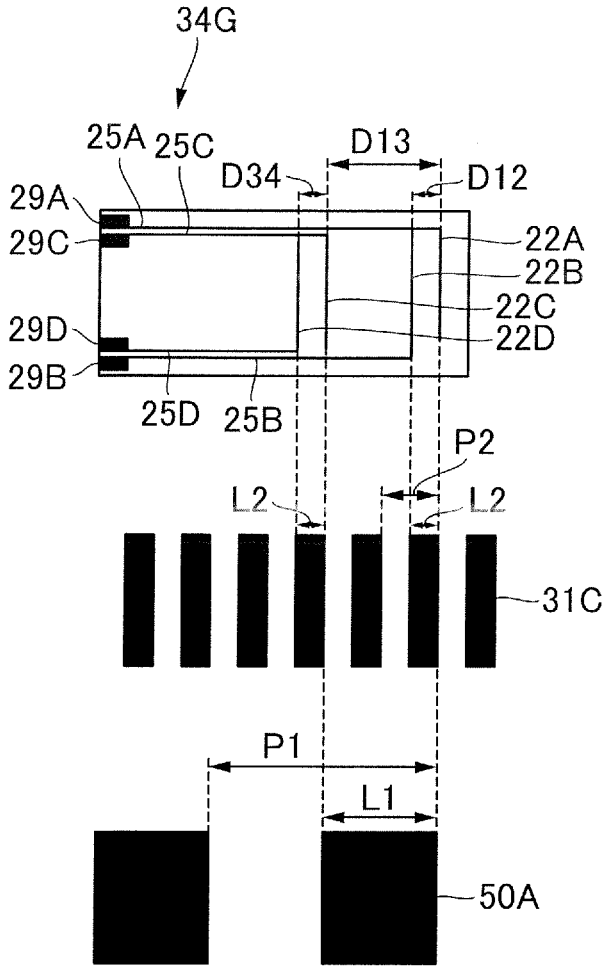
FIG. 33 is a schematic diagram illustrating another exemplary relationship between the four signal detecting portions of the latent image sensor and the pitches of the first and second marks.

Similarly to the sixth embodiment described above, a latent image sensor 34G of the present embodiment is also composed of a mono-layer flexible printed board. As shown in FIGS. 32 and 33, the latent image sensor 34G includes the four signal detecting portions 22A, 22B, 22C and 22D juxtaposed in the sub-scan direction, and four signal transmitting portions 25A, 25B, 25C, and 25D. The signal detecting portions 22A through 22D have thin and long shapes arrayed in the main scan direction, respectively. These four signal detecting portions are juxtaposed sequentially from the downstream in the sub-scan direction as the signal detecting portion 22A, i.e., a first signal detecting portion, the signal detecting portion 22B, i.e., a second signal detecting portion, the signal detecting portion 22C, i.e., a third signal detecting portion, and the signal detecting portion 22D, i.e., a fourth signal detecting portion. Then, a distance in the sub-scan direction between the signal detecting portions 22A and 22B is defined as D12, a distance in the sub-scan direction between the signal detecting portions 22C and 22D is defined as D34, and a distance in the sub-scan direction between the signal detecting portions 22A and 22C is defined as D13, respectively. These signal detecting portions 22A through 22D correspond to the probes 330 shown in FIG. 2 described above and detect the latent image graduations 31C and 50A as shown in FIGS. 32, 33 and others, respectively.

The signal transmitting portions 25A through 25D are detection signal leading lines for leading out signals from the signal detecting portions 22A through 22D and are led in the sub-scan direction so as not to detect potential fluctuation of the latent image graduations. Provided at end portions of the signal transmitting portions 25A through 25D are connecting terminals 29A through 29D for taking the signals to the outside. These signal detecting portions 22A through 22D and the signal transmitting portions 25A through 25D are composed of conductors, respectively, and are formed of copper patterns on a board in the present embodiment.

Similarly to the sixth embodiment, the latent image graduation 50A is formed such that two types of signals are formed consecutively at equal intervals with a duty ratio of 50% in terms of the sub-scan direction as first position information on the intermediate transfer belt 24, i.e., the conveyance body, also in the present embodiment. The latent image graduation 31C is also formed such that two types of signals are formed consecutively at equal intervals with a duty ratio of 50% in terms of the sub-scan direction as second position information on the photoconductive drum 12, i.e., the second image carrier.

Here, the latent image graduations 50A and 31C have a relationship satisfying $P1=P2/(2\times n)$ or $P1=P2\times 2\times m$, where P1 is a distance between the signals of the latent image graduation 50A, P2 is a distance between the signals of the latent image graduation 31C, and n and m are natural numbers. It is noted that FIG. 32 shows a case where a pitch of the latent image graduation 50A is twice a pitch of the latent image graduation 31C. Meanwhile, FIG. 33 shows a case where a pitch of the latent image graduation 50A is four times of the pitch of the latent image graduation 31C.

The four signal detecting portions 22A through 22D are disposed so as to satisfy the following conditions: when P1<P2, D12=P1/2, D34=P1/2, and D13=P2/2, and when P1>P2, D12=P2/2, D34=P2/2, and D13=P1/2. The latent image sensor 34G having these signal detecting portions 22A through 22D is mounted within a transfer section between the photoconductive drum 12 and the intermediate transfer belt 24 similarly to the sixth embodiment (see FIGS. 21 and 22).

In short, the pitch of the latent image graduation 50A (first mark) is denoted as P1, a width of the latent image graduation 50A in the sub-scan direction as L1, the pitch of the latent image graduation 31C (second mark) as P2, a width of the latent image graduation 31C in the sub-scan direction as L2, and the distances between the four signal detecting portions 22A through 22D as D12, D34, and D13 as described above.

In this case, the duty ratio of the latent image graduation 50A is 50% as represented as P1=2×L1, and the duty ratio of the latent image graduation 31C is also 50% as represented by P2=2×L2. It is noted that if the potential of the latent image graduation is not a potential like a rectangular wave, the latent image graduation may be also of a potential in which a potential difference of maximum and minimum values of the potential to a midpoint potential is inverted to plus and minus per ½ period. Still further, the relationship between the latent image graduations 50A and 31C is set such that a half period of a latent image graduation whose pitch is long is an integer multiple of a pitch of a latent image graduation whose pitch is short as represented as P1=P2/(2×n) (n is a positive integer) or P1=P2×2×m (m is a positive integer).

The relationship between the signal detecting portions 22A through 22D and the latent image graduations 50A and 31C is set such that the distances D12 and D34 between the signal detecting portions are a half period of the mark whose pitch is short, and the distance D13 between the signal detecting portions is a half period of the mark whose pitch is long. That is, such relationship is represented as: D12=P1/2, D34=P1/2, and D13=P2/2, when P1<P2, and D12=P2/2, D34=P2/2, and D13=P1/2 when, P1>P2.

[Extraction of Detection Signal]

Next, an extraction of the detection signals of the latent image graduations 50A and 31C in the latent image sensor 34G will be explained by using FIGS. 34 through 37. In the present embodiment, the detection signals of the latent image graduation 50A and the latent image graduation 31C are extracted from four types of detection signals outputted by synthesizing detection signals of the four signal detecting portions 22A through 22D. Suppose here that the detection signals of the four signal detecting portions 22A through 22D as S1, S2, S3, and S4, the detection signal related to the latent image graduation 50A as M1, and the detection signal related to the latent image graduation 31C as M2. In this case, the detection signal extraction circuit 30A (see FIG. 37) processes the detection signals such that the following conditions are met: when P1<P2, M1=(S1−S2)+(S3−S4) and M2=S1−S3, and when P1>P2, M1=S1−S3 and M2=(S1−S2)+(S3−S4). This process will be now explained in detail.

Figure 34A:
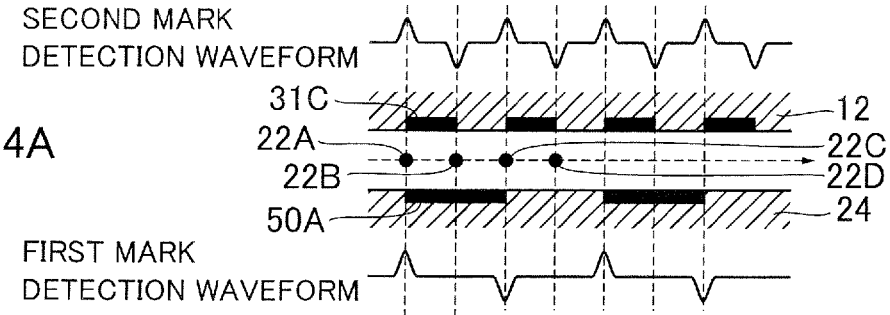
FIG. 34A is a schematic diagram showing detected waveforms of the first and second marks when the four signal detecting portions of the latent image sensor of the seventh embodiment are moved to the right hand side in FIG. 34A.

In FIG. 34A, the photoconductive drum 12 is disposed at an upper part of the diagram and the intermediate transfer belt 24 is disposed at a lower part, and the latent image sensor 34G not shown is interposed between them. In the latent image sensor 34G, the four signal detecting portions 22A through 22D are juxtaposed in the sub-scan direction, respectively. Here, the signal detecting portions 22A through 22D are disposed sequentially from the downstream in the sub-scan direction, respectively. Still further, the latent image graduation 31C, i.e., the second mark, is formed on the photoconductive drum 12 and the latent image graduation 50A, i.e., the first mark, is formed on the intermediate transfer belt 24, respectively. A ratio of the pitch P2 of the latent image graduation 31C and the pitch P1 of the latent image graduation 50A is 1:2 (P1>P2), and their surface potentials are supposed to be equal.

Because a waveform of a signal detected by the signal detecting portion from the latent image graduation is inversely proportional to a distance between the signal detecting portion and the latent image graduation, the further the distance, the smaller the waveform becomes. Accordingly, it is preferable to equalize a distance between the signal detecting portion 22A and the photoconductive drum 12 with a distance between the signal detecting portion 22B and the photoconductive drum 12. It is because it is preferable to equalize sizes of amplitudes of detected waveforms of the latent image graduation 50A in order to cancel the detected waveform of the latent image graduation 50A in extracting a detection signal of the latent image graduation 31C from a synthesized waveform of signals detected by the signal detecting portions 22A and 22B. For the same reason, it is preferable to equalize a distance between the signal detecting portion 22C and the photoconductive drum 12 with a distance between the signal detecting portion 22D and the photoconductive drum 12.

As for the intermediate transfer belt 24, it is preferable to equalize a distance between the signal detecting portion 22A and the intermediate transfer belt 24 with a distance between the signal detecting portion 22C and the intermediate transfer belt 24. It is because it is preferable to equalize sizes of amplitudes of detected waveforms of the latent image graduation 31C in order to cancel the detected waveform of the latent image graduation 31C in extracting the latent image graduation 50A from a synthesized waveform of signals detected by the signal detecting portions 22A and 22C.

However, the distance between the signal detecting portion 22A and the photoconductive drum 12 may be different from the distance between the signal detecting portion 22A and the intermediate transfer belt 24 as long as the abovementioned relationship of distance is held. In the same manner, the distance between the signal detecting portion 22C and the photoconductive drum 12 may be different from the distance between the signal detecting portion 22C and the intermediate transfer belt 24. It is noted that if the amplitudes of the detected waveforms are equalized by using the amplifier as described in the sixth embodiment, the amplitudes of the external noises are differentiated in contrary and cannot be canceled. Accordingly, it is preferable to hold the abovementioned relationship of distance in the present embodiment.

The extraction of the detection signal will be explained under a supposition that the photoconductive drum 12 and the intermediate transfer belt 24 are fixed and the latent image sensor 34G is moved at constant velocity to a right hand side in FIG. 34A for convenience of explanation. It is the same with a case where the photoconductive drum 12 and the intermediate transfer belt 24 are moved to a left hand side (the sub-scan direction) in FIG. 34A while fixing the latent image sensor 34G. Therefore, the signal detecting portions 22A through 22D are located sequentially from the downstream in the sub-scan direction, respectively, as described above.

A first mark detection waveform shown in FIG. 34A is a waveform of a detection signal of the latent image graduation 50A, i.e., the first mark, to be extracted and obtained by the latent image sensor 34G. A second mark detection waveform is a waveform of a detection signal of the latent image graduation 31C, i.e., a second mark, to be extracted and obtained by the latent image sensor 34G. A mark detection signal A is a waveform of a detection signal (S1) actually detected by the signal detecting portion 22A. A mark detection signal B is a waveform of a detection signal (S2) actually detected by the signal detecting portion 22B. A mark detection signal C is a waveform of a detection signal (S3) actually detected by the signal detecting portion 22C. A mark detection signal D is a waveform of a detection signal (S4) actually detected by the signal detecting portion 22D. A waveform of an A−B signal is obtained by subtracting the mark detection signal B from the mark detection signal A (S1−S2). A waveform of a C−D signal is obtained by subtracting the mark detection signal D from the mark detection signal C (S3−S4). A waveform of an (A−B)+(C−D) signal is obtained by adding a waveform obtained by subtracting the mark detection signal B from the mark detection signal A and a waveform obtained by subtracting the mark detection signal D from the mark detection signal C ((S1−S2)+(S3−S4)). A waveform of an A−C signal is obtained by subtracting the mark detection signal C from the mark detection signal A (S1−S3).

Because the relationship between the pitch P2 of the latent image graduation 31C and the pitch P1 of the latent image graduation 50A is P1>P2 here, the detection signal extraction circuit 30 processes the detection signals such that the following conditions are met: M1=S1−S3 and M2=(S1−S2)+(S3−S4). Accordingly, the (A−B)+(C−D) signal ((S1 S2)+(S3−S4)) corresponds to the detection signal M2 and the A−C signal (S1−S3) corresponds to the detection signal M1.

Figure 34B:
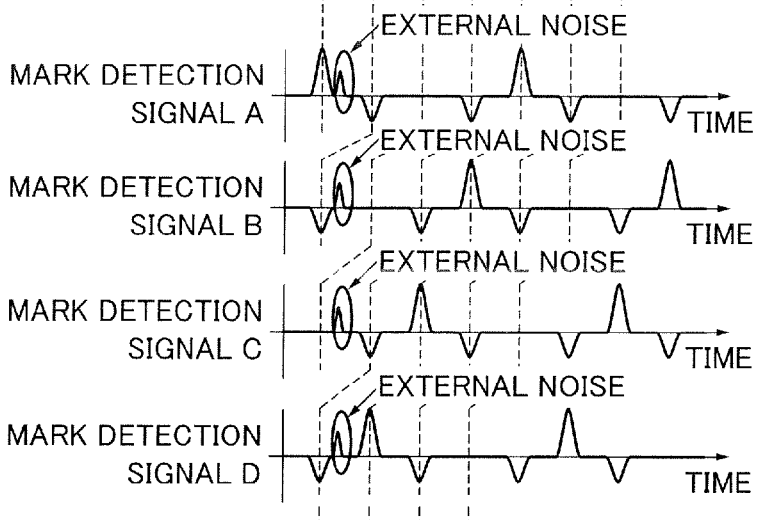
FIG. 34B is a chart showing waveforms of the respective detecting portions in the case in FIG. 34A by matching time bases.
Figure 34C:
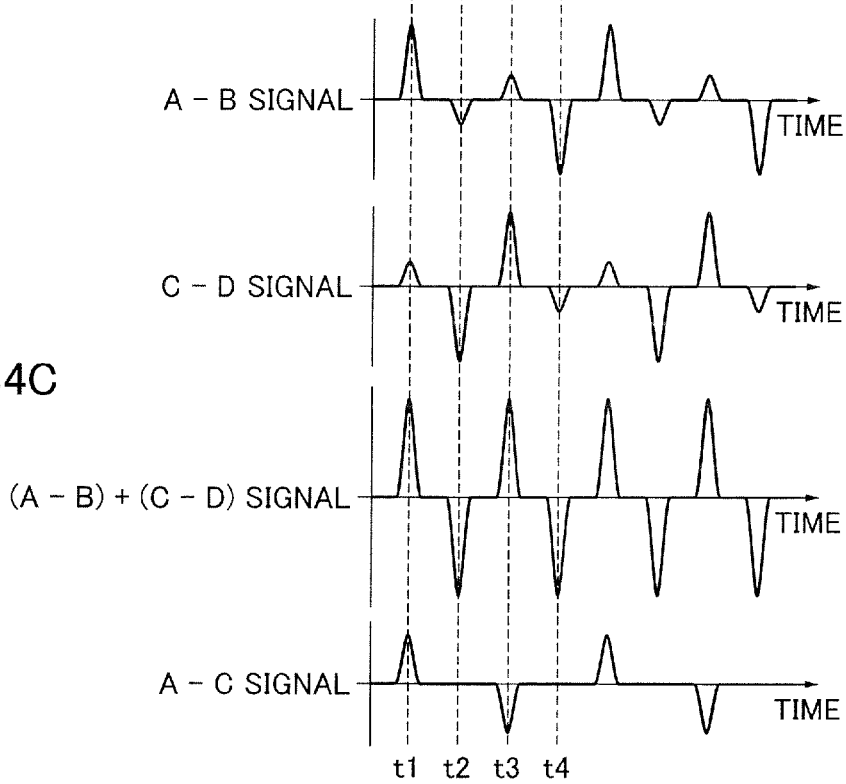
FIG. 34C is a chart represented by adding and subtracting the waveforms.

It is noted that while an axis of abscissa of each waveform shown in FIG. 34A through and 34C represents time, the position of the signal detecting portion 22A is arranged to coincide with the time. FIGS. 34A through 34C also show the positions of the signal detecting portions 22A through 22D when the time is t1. The principle of detection of the latent image graduations (marks) described below has been already explained in connection with FIG. 2.

[Time t1]

At time t1, because the signal detecting portion 22A detects mark starting portions (front edges in the conveying direction of the marks) of both the latent image graduations 50A and 31C, a double voltage is outputted on the plus side as a mark detection signal A. Meanwhile, because the signal detecting portion 22B detects a mark ending portion (rear edge in the conveying direction of the mark) of the latent image graduation 31C, a minus side voltage is outputted as a mark detection signal B. The signal detecting portion 22C detects a mark starting portion of the latent image graduation 31C and a mark ending portion of the latent image graduation 50A. Therefore, because potentials of the two marks are equal and are canceled with each other, 0 (V) is outputted as a mark detection signal C. Because the signal detecting portion 22D detects a mark ending portion of the latent image graduation 31C, a minus side voltage is outputted as a mark detection signal D.

A triple voltage is outputted on the plus side as an A−B signal because the mark detection signal A is a double voltage on the plus side and the mark detection signal B is a minus side voltage. A plus side voltage is outputted as a C−D signal because the mark detection signal C is a voltage of 0 (V) and the mark detection signal D is a minus side voltage. A quadruple voltage is outputted on the plus side as an (A−B)+(C−D) signal by adding the A−B signal of the triple voltage on the plus side with the C−D signal of the voltage on the plus side. A double voltage is outputted on the plus side as an A−C signal because the mark detection signal A is a double voltage on the plus side and the mark detection signal C is a voltage of 0 (V).

While the external noises of the identical waveform are mixed in the four mark detection signals, they are removed by being canceled in the A−B signal, the C−D signal, and the A−C signal. Accordingly, the external noise is removed also out of the (A−B)+(C−D) signal.

[Time t2]

At time t2, because the signal detecting portion 22A detects the mark ending portion of the latent image graduation 31C, a minus side voltage is outputted as the mark detection signal A. The signal detecting portion 22B detects the mark ending portion of the latent image graduation 50A and a mark starting portion of the latent image graduation 31C, so that their voltages are canceled with each other and 0 (V) is outputted as the mark detection signal B. The signal detecting portion 22C detects a mark ending portion of the latent image graduation 31C, so that a voltage on the minus side is outputted as the mark detection signal C. The signal detecting portion 22D detects both mark starting portions of the latent image graduations 31C and 50A, a double voltage is outputted on the plus side as the mark detection signal D.

A minus side voltage is outputted as the A−B signal because the mark detection signal A is a minus side voltage and mark detection signal B is 0 (V). A triple voltage is outputted on the minus side as the C−D signal because the mark detection signal C is a minus side voltage and the mark detection signal D is a double voltage on the plus side. A quadruple voltage is outputted on the minus side as the (A−B)+(C−D) signal by adding the A−B signal of the minus side voltage with the C−D signal of the triple voltage on the minus side. 0 (V) is outputted as the A−C signal because the mark detection signal A is a minus side voltage and the mark detection signal C is a minus side voltage, canceling with each other.

[Time t3]

At time t3, the signal detecting portion 22A detects the mark starting portion of the latent image graduation 31C and the mark ending portion of the latent image graduation 50A, so that their voltages are canceled with each other and 0 (V) is outputted as the mark detection signal A. The signal detecting portion 22B detects the mark ending portion of the latent image graduation 31C, so that a minus side voltage is outputted as the mark detection signal B. The signal detecting portion 22C detects both mark starting portions of the latent image graduation 31C and the latent image graduation 50A, so that a double voltage is outputted on the plus side as the mark detection signal C. The signal detecting portion 22D detects the mark ending portion of the latent image graduation 31C, a minus side voltage is outputted as the mark detection signal D.

A plus side voltage is outputted as the A−B signal because the mark detection signal A is 0 (V) and the mark detection signal B is a minus side voltage. A triple voltage is outputted on the plus side as the C−D signal because the mark detection signal C is a double voltage on the plus side and the mark detection signal D is a minus side voltage. A quadruple voltage is outputted on the plus side as the (A−B)+(C−D) signal by adding the A−B signal of the voltage on the plus side with the C−D signal of the triple voltage on the plus side. A double voltage is outputted on the minus side as the A−C signal because the mark detection signal A is 0 (V) and the mark detection signal C is a double voltage on the plus side.

[Time t4]

At time t4, because the signal detecting portion 22A detects the mark ending portion of the latent image graduation 31C, a minus side voltage is outputted as the mark detection signal A. Meanwhile, because the signal detecting portion 22B detects the mark starting portions of the latent image graduations 31C and 50A, a double voltage is outputted on the plus side as the mark detection signal B. The signal detecting portion 22C detects the mark ending portion of the latent image graduation 31C, so that a minus side voltage is outputted as the mark detection signal C. The signal detecting portion 22D detects a mark starting portion of the latent image graduation 31C and a mark ending portion of the latent image graduation 50A, so that their voltages are canceled with each other and 0 (V) is outputted as the mark detection signal D.

A triple voltage is outputted on the minus side as the A−B signal because the mark detection signal A is a minus side voltage and mark detection signal B is a double voltage on the plus side. A minus side voltage is outputted as the C−D signal because the mark detection signal C is a minus side voltage and the mark detection signal D is 0 (V). A quadruple voltage is outputted on the minus side as the (A−B)+(C−D) signal by adding the A−B signal of the triple voltage on the minus side with the C−D signal of the minus side voltage. 0 (V) is outputted as the A−C signal because the mark detection signal A is a minus side voltage and the mark detection signal C is a minus side voltage, canceling with each other.

The (A−B)+(C−D) signal and the A−C signal are outputted as described above. At this time, the (A−B)+(C−D) signal has a waveform similar to the second mark detection waveform. Similarly to that, the A−C signal has a waveform similar to the first mark detection waveform. That is, the second mark detection signal is extracted by adding the signal obtained by subtracting the mark detection signal B from the mark detection signal A and the signal obtained by subtracting the mark detection signal D from the mark detection signal C. In the same manner, the first mark detection signal is extracted by subtracting the mark detection signal C from the mark detection signal A. Accordingly, because the (A−B)+(C−D) signal corresponds to the detection signal M2 and the A−C signal corresponds to the detection signal M1 as described above, the second mark detection signal turns out to be the detection signal M2 and the first mark detection signal to be the detection signal M1.

Figure 35A:
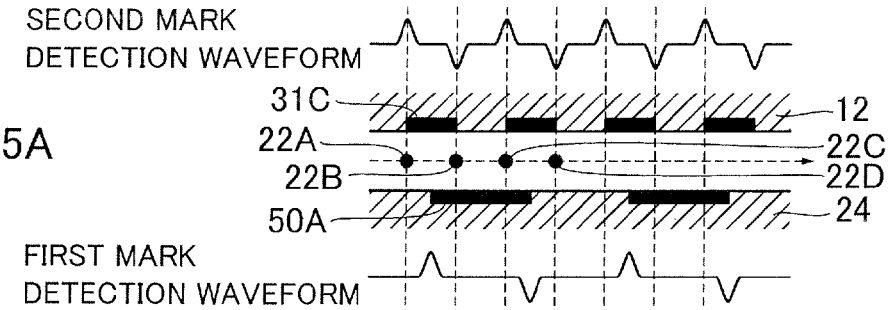
FIG. 35A is a schematic diagram, similar to FIG. 34A, showing a case where phases of the first and second marks are shifted.
Figure 35B:
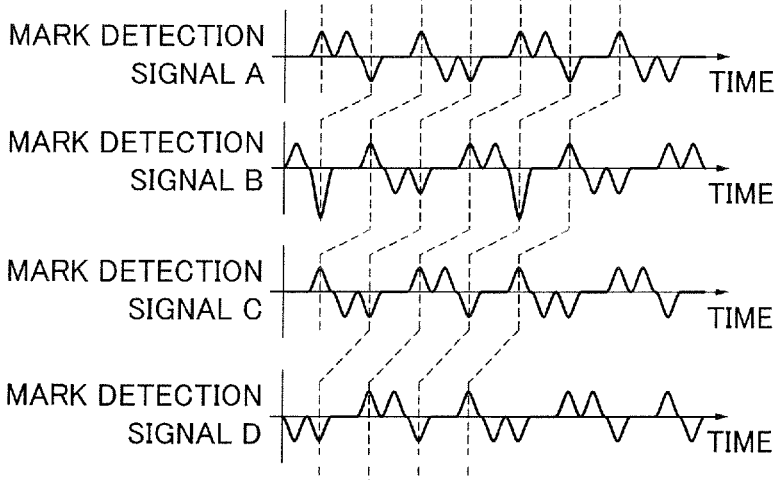
FIG. 35B is a chart, similar to FIG. 34B, showing waveforms of the respective detecting portions by matching time bases.
Figure 35C:
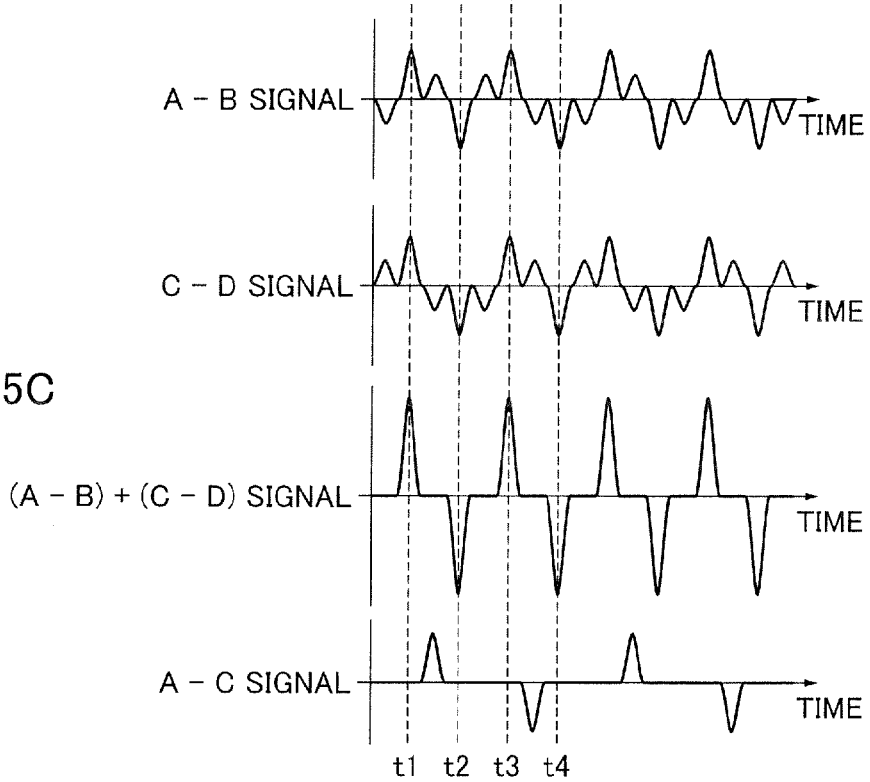
FIG. 35C is a chart, similar to FIG. 34C, represented by adding and subtracting the waveforms.

FIGS. 35 through 35C are charts in which phases of the latent image graduation 50A (first mark) and the latent image graduation 31C (second mark) are different from those in FIGS. 34A through 34C. Because the phases of the two marks are shifted and mark starting portions and mark ending portions of all the marks are detected, waveforms of mark detection signals A through D are more complicated than those in FIG. 34B. However, extracted first and second mark detection signals have waveforms identical to those of the first and second mark detection waveforms, respectively. Accordingly, it can be seen that the extraction can be made regardless of the phases of the two marks.

Figures 36A, 36B, 36C:
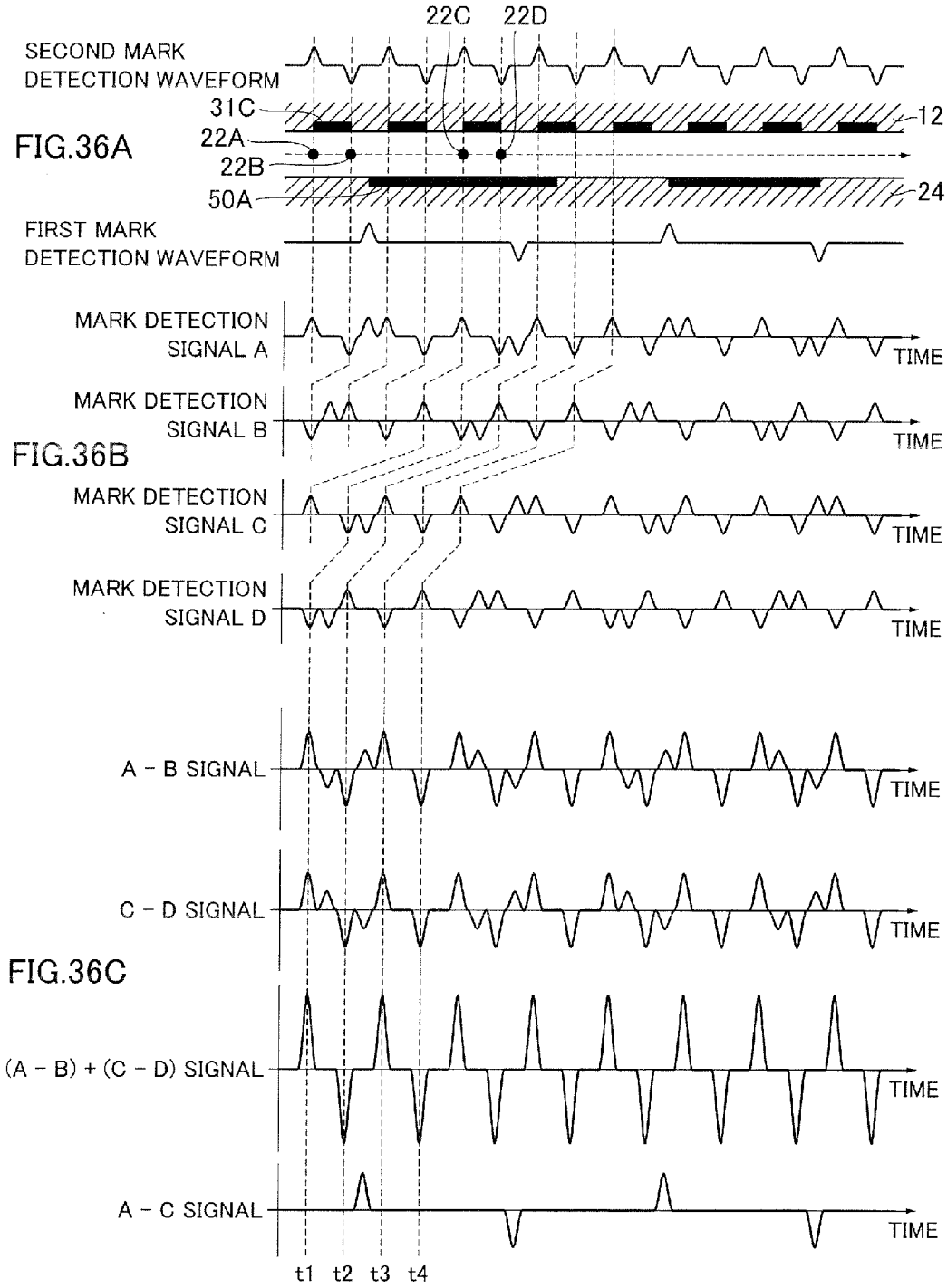
FIG. 36A is a schematic diagram, similar to FIG. 34A, showing the case where the phases of the first and second marks are shifted and the pitch of the second mark is twice the pitch of the first mark.
FIG. 36B is a chart, also similar to FIG. 34B, showing the waveforms in the case in FIG. 34A.
FIG. 36C is a chart, also similar to FIG. 34C, represented by adding and subtracting the waveforms.

FIGS. 36A through 36C are charts showing a case where the pitch of the latent image graduation 50A (first mark) is doubled further. It can be seen that the extraction of the two marks can be made even in this case, though its detailed explanation is omitted here.

Figure 37:
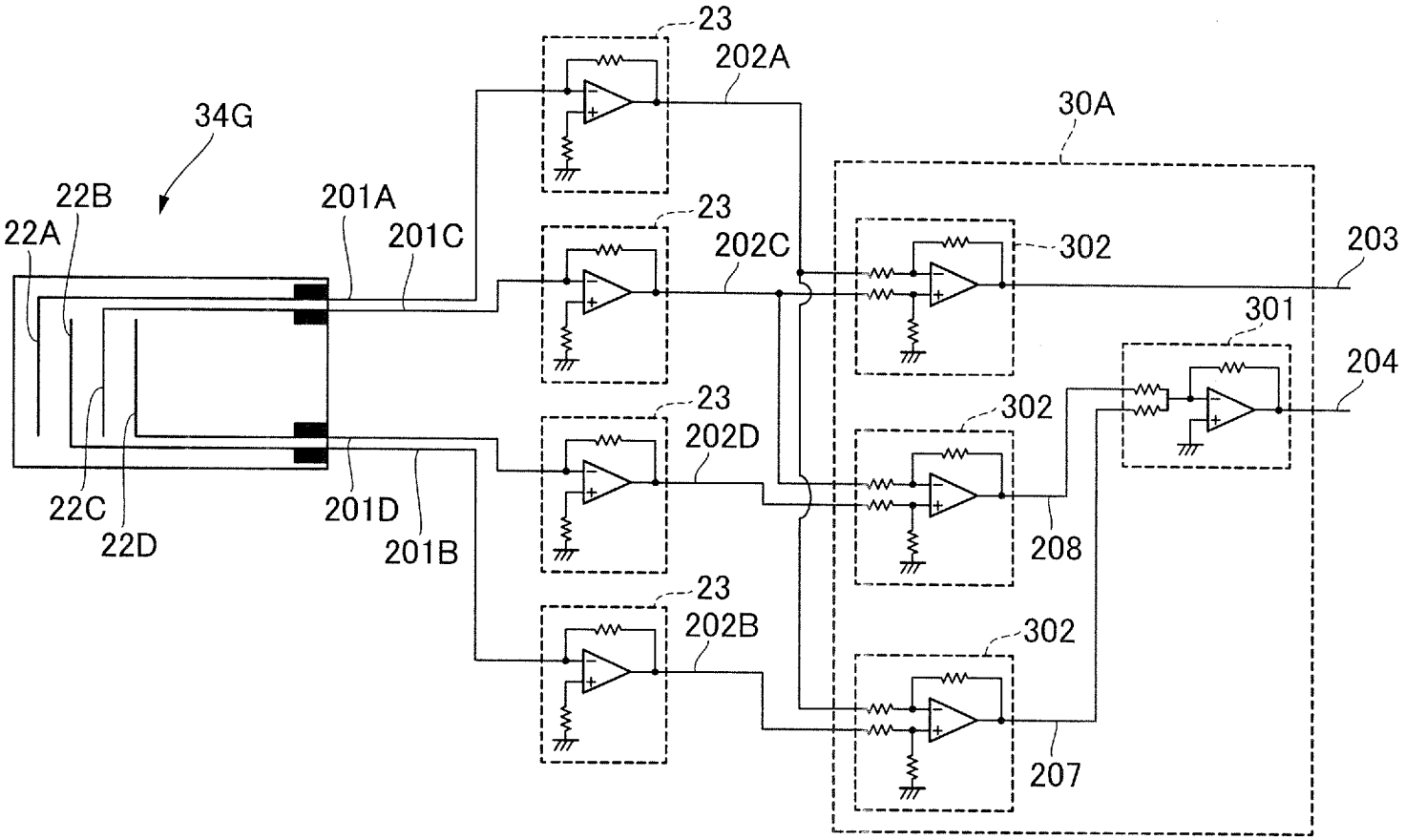
FIG. 37 is a circuit diagram for extracting a detection signal of the latent image sensor of the seventh embodiment.
Figure 38:
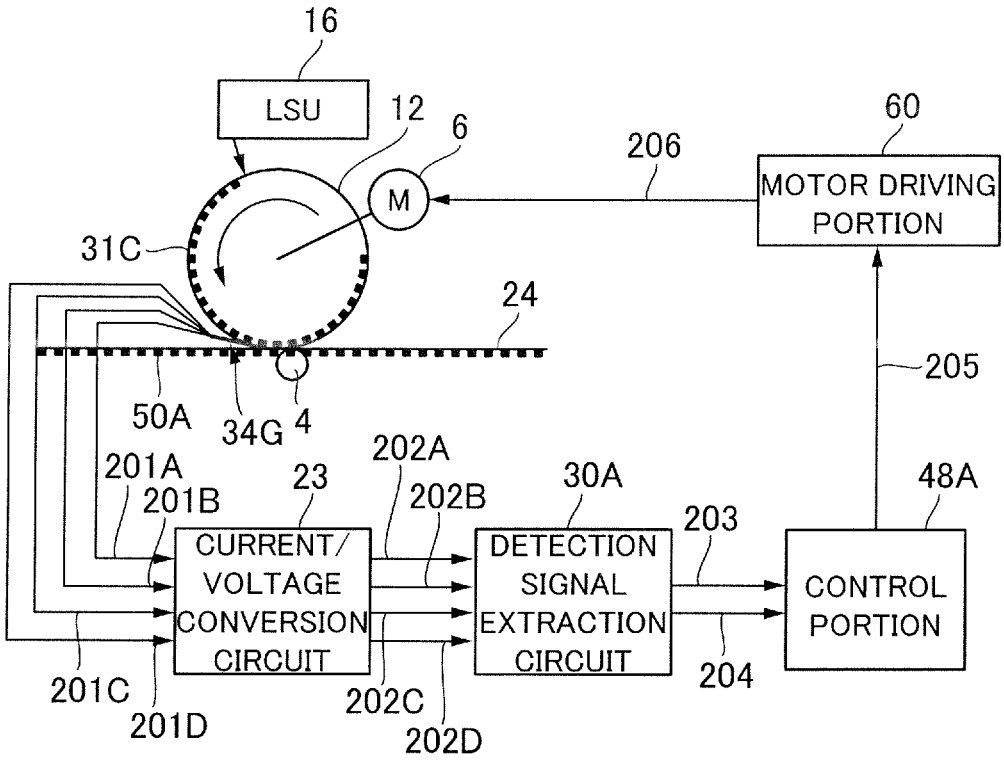
FIG. 38 is a block diagram illustrating a control in correcting a color shift according to the seventh embodiment.

FIG. 37 is a circuit diagram configured to extract the detection signals detected as described above. The signals detected by the signal detecting portions 22A through 22D will be referred to as mark detection current signals 201A through 201D, respectively. The mark detection current signals 201A through 201D are converted from current signals to voltage signals by the current/voltage conversion circuit 23, respectively. Then, the detection signal of the signal detecting portion 22A is converted into the voltage signal and is outputted as a mark detection signal 202A. The detection signal of the signal detecting portion 22B is converted into the voltage signal and is outputted as a mark detection signal 202B. The detection signal of the signal detecting portion 22C is converted into the voltage signal and is outputted as a mark detection signal 202C. the detection signal of the signal detecting portion 22D is converted into the voltage signal and is outputted as a mark detection signal 202D.

These mark detection signals 202A through 202D are processed by the detection signal extraction circuit 30A, i.e., an information processing portion. The detection signal extraction circuit 30A includes an adding circuit 301 and a subtracting circuit 302. The mark detection signals 202A and 202C are processed by the subtracting circuit 302 and are outputted as a first mark detection signal 203. The mark detection signals 202A and 202B are processed by the subtracting circuit 302 and are outputted as an A−B signal 207. The mark detection signals 202C and 202D are processed by the subtraction circuit 302 and are outputted as a C−D signal 208. The external noise is removed from the every signals by the subtraction circuit 302. Then, the A−B signal 207 is added with the C−D signal 208 by the addition circuit 301 to extract a second mark detection signal 204. It is noted that parts such as a register and a capacitor which need not to be explained in the explanation here are omitted in the circuit diagram. For the same reason, a value of the resistor is also omitted.

[Correction of Color Shift]

Next, a method for correcting a color shift by the two mark detection signals extracted as described above will be explained by using FIG. 38. The latent image sensor 34G is nipped between the photoconductive drum 12 and the intermediate transfer belt 24. The mark detection current signals 201A through 201D detected by the signal detecting portions 22A through 22D (not shown in FIG. 38) of the latent image sensor 34G are converted from the current signals into the voltage signals by the current/voltage conversion circuits 23 and are outputted as the mark detection signals 202A through 202D. At this time, amplification is carried out such that sizes of the converted voltage signals are equalized. The mark detection signals 202A through 202D are extracted by the detection signal extraction circuit 30A as first and second mark detection signals 203 and 204. The other points are the same with those in FIG. 26 explained in connection with the first embodiment.

[Specific Example of Control of Correction of Color Shift]

Next, such control will be explained specifically by using FIGS. 39 through 42. FIGS. 39 and 41 are charts showing positional relations between the latent image graduations 50A and 31C, i.e., the two marks, and the four signal detecting portions 22A through 22D at times t1 through t14. It is noted that FIGS. 39 through 41 show a case where the signal detecting portions 22A through 22D are fixed and the photoconductive drum 12 and the intermediate transfer belt 24 move in the right hand side in FIGS. 39 and 41. Parts surrounded by circles in FIGS. 39 and 41 indicate positions where phases of the first and second mark detection signals are to be matched by the control portion 48A.

Figures 42A, 42B, 42C:
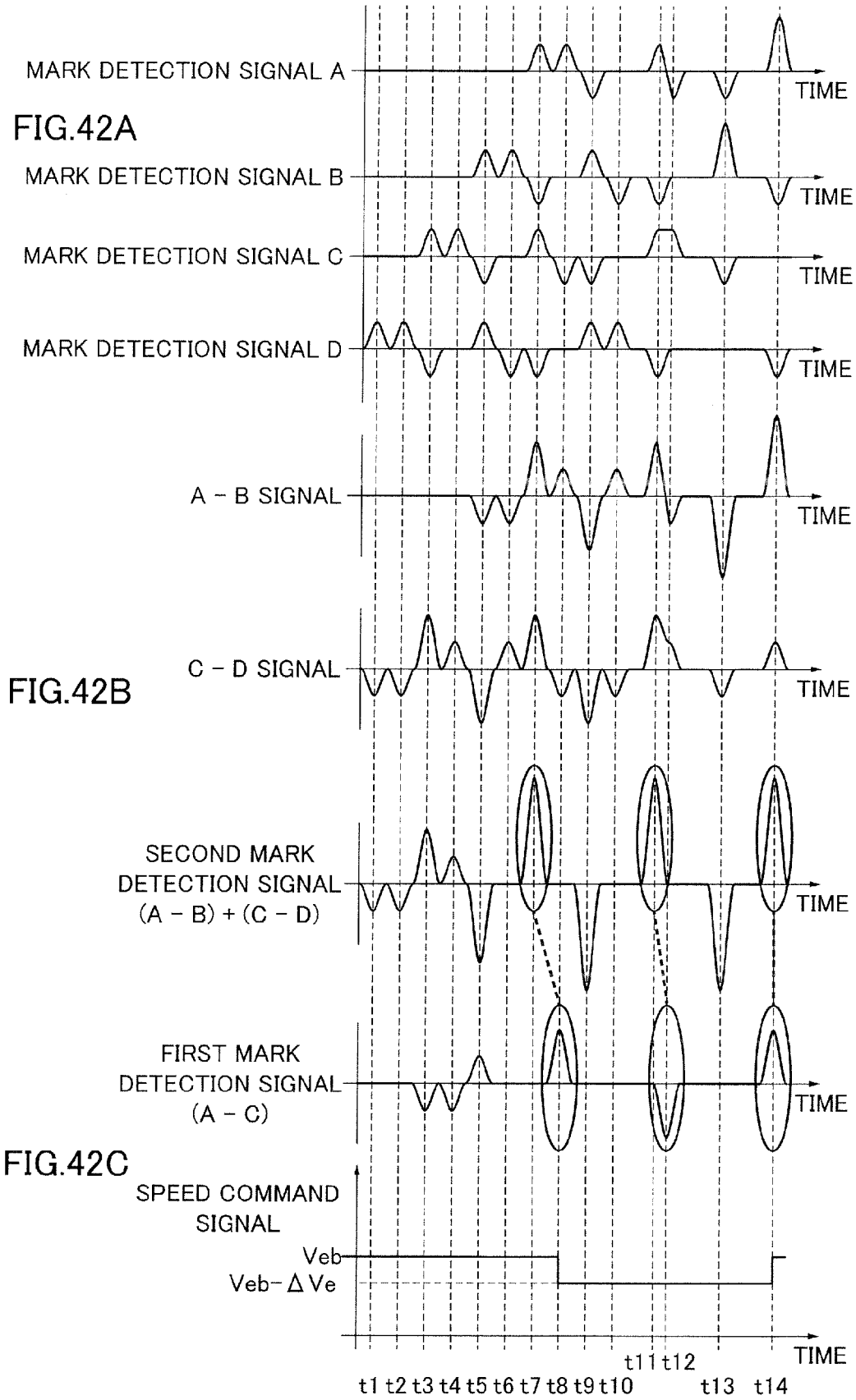
FIG. 42A is a chart showing the waveforms of the four signal detecting portions in FIGS. 39 through 41 by matching time bases.
FIG. 42B is a chart represented by adding and subtracting these waveforms.
FIG. 42C is a chart showing a speed command signal to the photoconductive drum in the case of FIG. 42B.

FIGS. 42A through 42C are charts showing waveforms of the respective signals, wherein FIG. 42A shows the waveforms of the mark detection signal A detected by the signal detecting portion 22A, the mark detection signal B detected by the signal detecting portion 22B, the mark detection signal C detected by the signal detecting portion 22C, and the mark detection signal D detected by the signal detecting portion 22D. FIG. 42B shows the waveforms of the A−B signal obtained by subtracting the mark detection signal B from the mark detection signal A, the C−D signal obtained by subtracting the mark detection signal D from the mark detection signal C. FIG. 42B also shows a second mark detection signal extracted by adding the A−B signal and the C−D signal, and a first mark detection signal extracted by subtracting the mark detection signal C from the mark detection signal A. FIG. 42C shows a speed command signal applied to the photoconductive drum 12 to correct a color shift.

Figure 39A:
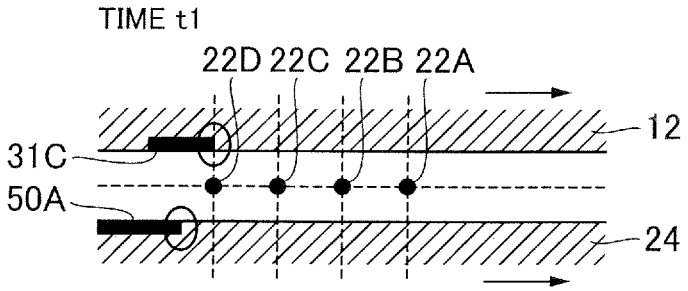
FIG. 39A is a schematic diagram illustrating a positional relation between four signal detecting portions and first and second marks at time t1 when the photoconductive drum and the intermediate transfer belt are moved to the right hand side in FIG. 39A in a control in correcting a color shift according to the seventh embodiment.

As shown in FIG. 39A, time t1 is a time when a first one of the latent image graduation 31C has arrived at the signal detecting portion 22D. As indicated at time t1 in FIG. 42, a signal is outputted on the plus side only in the mark detection signal D. Because the detection signal extraction circuit 30A extracts signals by executing simple addition and subtraction, the detection signal extraction circuit 30A cannot accurately extract the signals unless the four detecting portions do not detect the marks. Because the signal detecting portion 22A does not detect a first one of the mark yet, the control portion 48A does not execute a phase matching control. Accordingly, the speed Veb of the intermediate transfer belt 24 is outputted as a speed command signal of the photoconductive drum 12.

Figure 39B:
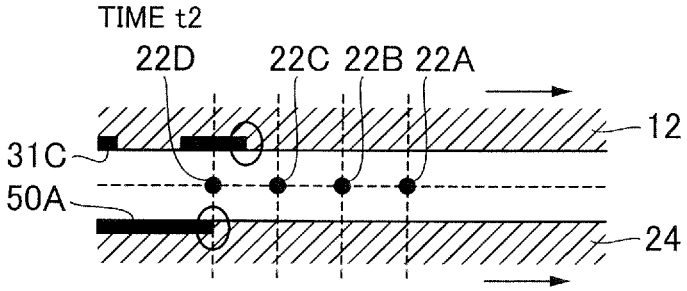
FIG. 39B is a schematic diagram, similar to FIG. 39A, illustrating the positional relation at time t2.

As shown in FIG. 39B, time t2 is a time when a first one of the latent image graduation 50A has arrived at the signal detecting portion 22D. As indicated at time t2 in FIG. 42, a signal is outputted on the plus side only in the mark detection signal D. Because the signal detecting portion 22A does not detect a first one of the mark yet, the control portion 48A does not execute the phase matching control. Accordingly, the speed Veb of the intermediate transfer belt 24 is successively outputted as the speed command signal of the photoconductive drum 12.

Figure 39C:
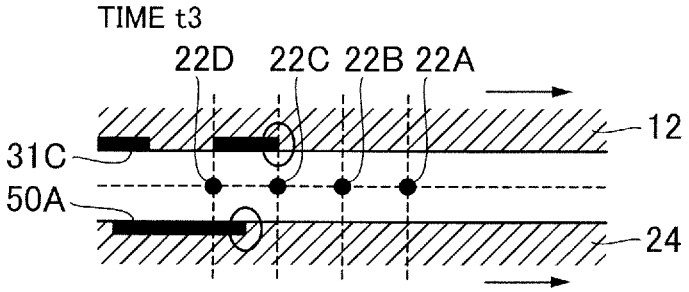
FIG. 39C is a schematic diagram, similar to FIG. 39A, illustrating the positional relation at time t3.

As shown in FIG. 39C, time t3 is a time when the first one of the latent image graduation 31C has arrived at the signal detecting portion 22C and the first one of the latent image graduation 31C has passed through the signal detecting portion 22D. As indicated at time t3 in FIG. 42, a signal is outputted on the plus side in the mark detection signal C and a minus side signal is outputted in the mark detection signal D. Because the signal detecting portion 22A does not detect a first one of the mark yet, the control portion 48A does not execute the phase matching control. Accordingly, the speed Veb of the intermediate transfer belt 24 is successively outputted as the speed command signal of the photoconductive drum 12.

Figure 39D:
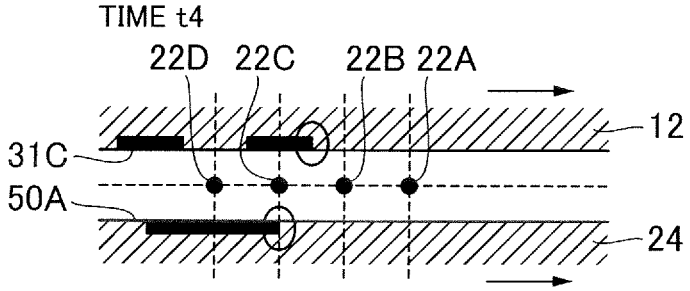
FIG. 39D is a schematic diagram, similar to FIG. 39A, illustrating the positional relation at time t4.

As shown in FIG. 39D, time t4 is a time when the first one of the latent image graduation 50A has arrived at the signal detecting portion 22C. As indicated at time t4 in FIG. 42, a signal is outputted on the plus side in the mark detection signal C. Because the signal detecting portion 22A does not detect a first one of the mark yet, the control portion 48A does not execute the phase matching control. Accordingly, the speed Veb of the intermediate transfer belt 24 is successively outputted as the speed command signal of the photoconductive drum 12.

Figure 39E:
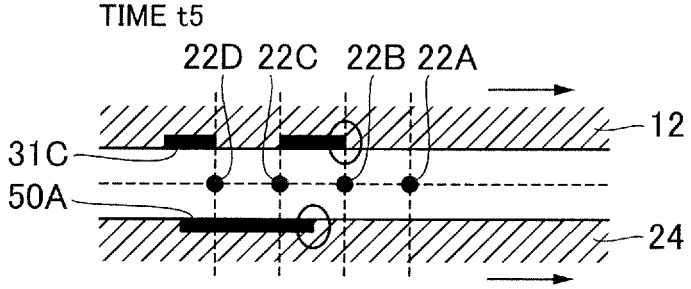
FIG. 39E is a schematic diagram, similar to FIG. 39A, illustrating the positional relation at time t5.

As shown in FIG. 39E, time t5 is a time when the first one of the latent image graduation 31C has arrived at the signal detecting portion 22B, the first one of the latent image graduation 31C has passed through the signal detecting portion 22C, and a second one of the latent image graduation 31C has arrived at the signal detecting portion 22D. As indicated at time t5 in FIG. 42, a signal is outputted on the plus side in the mark detection signal B, a signal is outputted on the minus side in the mark detection signal C, and a signal is outputted on the plus side in the mark detection signal D. Because the signal detecting portion 22A does not detect a first one of the mark yet, the control portion 48A does not execute the phase matching control. Accordingly, the speed Veb of the intermediate transfer belt 24 is outputted as the speed command signal of the photoconductive drum 12.

Figure 40A:
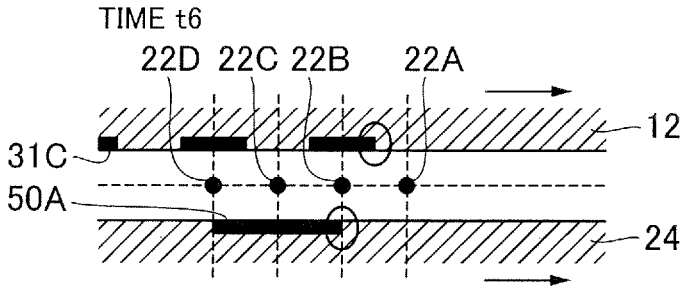
FIG. 40A is a schematic diagram, similar to FIG. 39A, illustrating the positional relation between the four signal detecting portions and the first and second marks at time t6.

As shown in FIG. 40A, time t6 is a time when the first one of the latent image graduation 50A has arrived at the signal detecting portion 22B and the first one of the latent image graduation 50A has passed through the signal detecting portion 22D. As indicated at time t6 in FIG. 42, a signal is outputted on the plus side in the mark detection signal B and a signal is outputted on the minus side in the mark detection signal D. Because the signal detecting portion 22A does not detect a first one of the mark yet, the control portion 48A does not execute the phase matching control. Accordingly, the speed Veb of the intermediate transfer belt 24 is successively outputted as the speed command signal of the photoconductive drum 12.

Figure 40B:
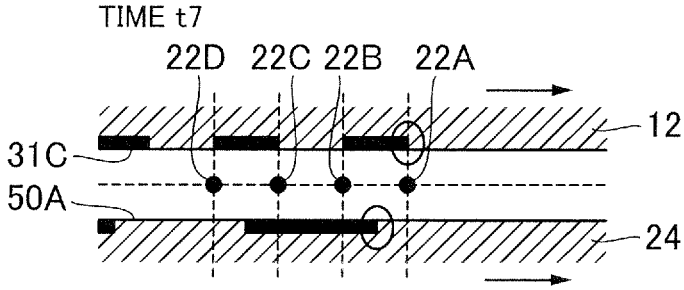
FIG. 40B is a schematic diagram, similar to FIG. 39A, illustrating the positional relation at time t7.

As shown in FIG. 40B, time t7 is a time when the first one of the latent image graduation 31C has arrived at the signal detecting portion 22A and the first one of the latent image graduation 31C has passed through the signal detecting portion 22B. Still further, it is the time when the second one of the latent image graduation 31C has arrived at the signal detecting portion 22C and the second one of the latent image graduation 31C has passed through the signal detecting portion 22D. As indicated at time t7 in FIG. 42, a signal is outputted on the plus side in the mark detection signal A, a signal is outputted on the minus side in the mark detection signal B, a signal is outputted on the plus side in the mark detection signal C, and a signal is outputted on the minus side in the mark detection signal D. Here, because the signal detecting portion 22A detects the signal, the phase matching control is executed.

Because the A−B signal turns out to be a double signal on the plus side and the C−D signal also turns out to be a double signal on the plus side, a quadruple signal is outputted on the plus side as the second mark detection signal extracted by adding those signals. This time t7 is recorded as a detection time of the first one of the latent image graduation 31C (second mark). No signal is outputted as the first mark detection signal extracted by subtracting the mark detection signal C from the mark detection signal A because those mark detection signals cancel with each other. Because only the second mark is detected at this time, the speed Veb of the intermediate transfer belt 24 is outputted as the speed command signal of the photoconductive drum 12.

Figure 40C:
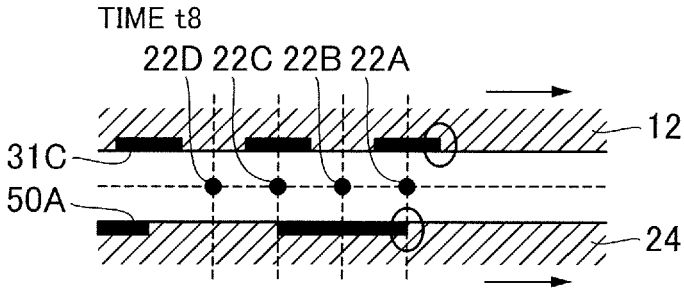
FIG. 40C is a schematic diagram, similar to FIG. 39A, illustrating the positional relation at time t8.

As shown in FIG. 40C, time t8 is a time when the first one of the latent image graduation 50A has arrived at the signal detecting portion 22A and the first one of the latent image graduation 50A has passed through the signal detecting portion 22C. As indicated at time t8 in FIG. 42, a signal is outputted on the plus side in the mark detection signal A, no signal is outputted in the mark detection signal B, a signal is outputted on the minus side in the mark detection signal C, and no signal is outputted in the mark detection signal D. Because a signal is outputted on the plus side in the A−B signal and a signal is output on the minus side in the C−D signal, no signal is outputted as the second mark detection signal because those signals are canceled from each other when they are added. A double signal is outputted on the plus side as the first mark detection signal extracted by subtracting the mark detection signal C from the mark detection signal A, this time t8 is recorded as a detection time of the first one of the latent image graduation 50A (first mark).

Because both the first and second marks are detected, the control portion 48A compares the two times (t7 and t8). Here, because the passage time t7 of the second mark is earlier than the passage time t8 of the first mark, the speed Veb−ΔVe which is slower than the speed Veb of the intermediate transfer belt 24 by ΔVe is outputted as the speed command signal of the photoconductive drum 12. ΔVe is a speed set in advance or a speed calculated corresponding to a time difference.

Figure 40D:
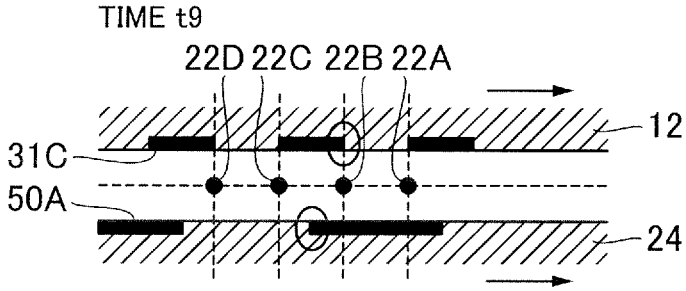
FIG. 40D is a schematic diagram, similar to FIG. 39A, illustrating the positional relation at time t9.

As shown in FIG. 40D, time t9 is a time when the first one of the latent image graduation 31C has passed through the signal detecting portion 22A and the second one of the latent image graduation 31C has arrived at the signal detecting portion 22B. It is also a time when the second one of the latent image graduation 31C has passed through the signal detecting portion 22C and a third one of the latent image graduation 31C has arrived at the signal detecting portion 22D. As indicated at time t9 in FIG. 42, a signal is outputted on the minus side in the mark detection signal A, a signal is outputted on the plus side in the mark detection signal B, a signal is outputted on the minus side in the mark detection signal C, and a signal is outputted on the plus side in the mark detection signal D.

Because a double signal is outputted on the minus side in the A−B signal and a double signal is outputted on the minus side in the C−D signal, a quadruple signal is outputted on the minus side as the second mark detection signal extracted by adding those signals. Because there is no corresponding signal of the first mark at the minus side position of the second mark, the minus side signal of the second mark detection signal is neglected. No signal is outputted in the first mark detection signal extracted by subtracting the mark detection signal C from the mark detection signal A because those signals cancel from each other. At this time, the speed Veb−ΔVe determined at the time t8 is successively outputted as the speed command signal of the photoconductive drum 12.

Figure 40E:
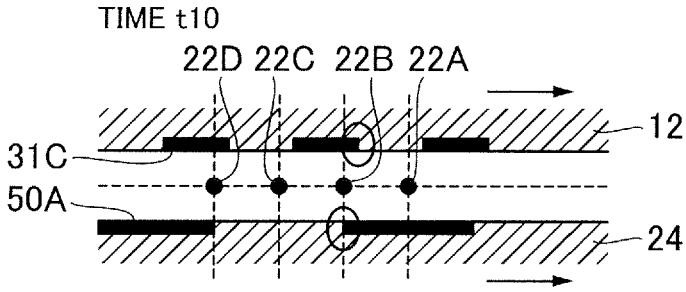
FIG. 40E is a schematic diagram, similar to FIG. 39A, illustrating the positional relation at time t10.

As shown in FIG. 40E, time t10 is a time when the first one of the latent image graduation 50A has passed through the signal detecting portion 22B and a second one of the latent image graduation 50A has arrived at the signal detecting portion 22D. As indicated at time t10 in FIG. 42, no signal is outputted in the mark detection signal A, a minus side signal is outputted in the mark detection signal B, no signal is outputted in the mark detection signal C, and a minus side signal is outputted in the mark detection signal D. Because a signal is outputted on the plus side in the A−B signal and a signal is outputted on the minus side in the C−D signal, no signal is outputted as the second mark detection signal because those signals are canceled from each other when they are added. No signal is outputted in the first mark detection signal extracted by subtracting the mark detection signal C from the mark detection signal A. Because both the first and second marks are not detected, the speed Veb−ΔVe is successively outputted as the speed command signal of the photoconductive drum 12.

Figure 41A:
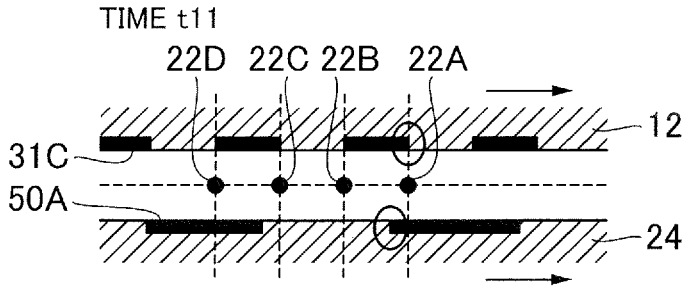
FIG. 41A is a schematic diagram similar to FIG. 39A, illustrating the positional relation between the four signal detecting portions and the first and second marks at time t11.

As shown in FIG. 41A, time t11 is a time when the second one of the latent image graduation 31C has arrived at the signal detecting portion 22A and the second one of the latent image graduation 31C has passed through the signal detecting portion 22B. It is also a time when the third one of the latent image graduation 31C has arrived at the signal detecting portion 22C and the third one of the latent image graduation 31C has passed through the signal detecting portion 22D. As indicated at time t11 in FIG. 42, a signal is outputted on the plus side in the mark detection signal A, a minus side signal is outputted in the mark detection signal B, a signal is outputted on the plus side in the mark detection signal C, and a minus side signal is outputted in the mark detection signal D.

Because a double signal is outputted on the plus side in the A−B signal and a double signal is also outputted on the plus side in the C−D signal, a quadruple signal is outputted on the plus side as the second mark detection signal extracted by adding those signals. This time t11 is recorded as a detection time of the second one of the second mark. No signal is outputted in the first mark detection signal extracted by subtracting the mark detection signal C from the mark detection signal A because those signals cancel from each other. Because only the second mark is detected at this time, the speed Veb−ΔVe is successively outputted as the speed command signal of the photoconductive drum 12.

Figure 41B:
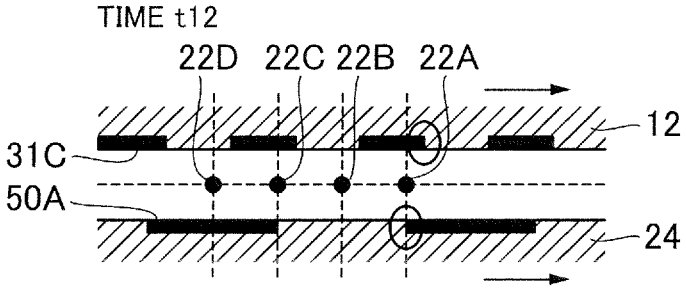
FIG. 41B is a schematic diagram, similar to FIG. 39A, illustrating the positional relation at time t12.

As shown in FIG. 41B, time t12 is a time when the first one of the latent image graduation 50A has passed through the signal detecting portion 22A and a second one of the latent image graduation 50A has arrived at the signal detecting portion 22C. As indicated at time t12 in FIG. 42, a signal is outputted on the minus side in the mark detection signal A, no signal is outputted in the mark detection signal B, a signal is outputted on the plus side in the mark detection signal C, and no signal is outputted in the mark detection signal D.

Because the A−B signal is a minus signal and the C−D signal is a plus signal, they are canceled when those signals are added and no signal is outputted as the second mark detection signal. A double signal is outputted on the minus side as the first mark detection signal extracted by subtracting the mark detection signal C from the mark detection signal A, so that this time t12 is recorded as a time when the second one of the first mark is detected. Because the both first and second marks are detected, the control portion 48A compares the two times (t11 and t12). Because the second mark passage time t11 is earlier than the first mark passage time t12 here, the speed Veb−ΔVe which is slower than the speed Veb of the intermediate transfer belt 24 by ΔVe is successively outputted as the speed command signal of the photoconductive drum 12.

Figure 41C:
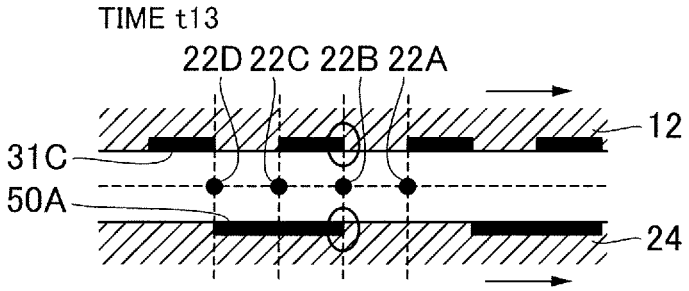
FIG. 41C is a schematic diagram, similar to FIG. 39A, illustrating the positional relation at time t13.

As shown in FIG. 41C, time t13 is a time when the second one of the latent image graduation 31C has passed through the signal detecting portion 22A and the third one of the latent image graduation 31C and the second one of the latent image graduation 50A have arrived at the signal detecting portion 22B. It is also a time when the third one of the latent image graduation 31C has passed through the signal detecting portion 22C, a fourth one of the latent image graduation 31C has arrived at the signal detecting portion 22D, and the second one of the latent image graduation 50A has passed through the signal detecting portion 22D. As indicated at time t13 in FIG. 42, a signal is outputted on the minus side in the mark detection signal A, a double signal is outputted on the plus side in the mark detection signal B, a signal is outputted on the minus side in the mark detection signal C, and no signal is outputted, by being canceled from each other, in the mark detection signal D.

Because a triple signal is outputted on the minus side in the A−B signal and a signal is also outputted on the minus side in the C−D signal, a quadruple signal is outputted on the minus side as the second mark detection signal extracted by adding those signals. Because there is no corresponding signal of the first mark at the minus side position of the second mark, the minus side signal of the second mark detection signal is neglected. No signal is outputted in the first mark detection signal extracted by subtracting the mark detection signal C from the mark detection signal A because those signals cancel from each other. At this time, the speed Veb−ΔVe is successively outputted as the speed command signal of the photoconductive drum 12.

Figure 41D:
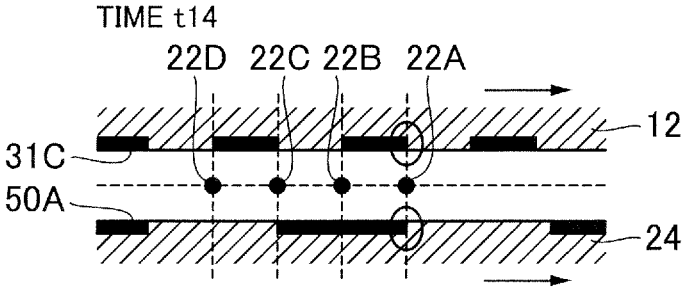
FIG. 41D is a schematic diagram, similar to FIG. 39A, illustrating the positional relation at time t14.

As shown in FIG. 41D, time t14 is a time when the third one of the latent image graduation 31C and the second one of the latent image graduation 50A have arrived at the signal detecting portion 22A in the same time and the third one of the latent image graduation 31C has passed through the signal detecting portion 22B. It is also a time when the fourth one of the latent image graduation 31C has arrived at the signal detecting portion 22C, the second one of the latent image graduation 50A has passed through the signal detecting portion 22C, and the fourth one of the latent image graduation 31C has passed through the signal detecting portion 22D in the same time. As indicated at time t14 in FIG. 42, a double signal is outputted on the plus side in the mark detection signal A, a minus side signal is outputted in the mark detection signal B, no signal is outputted, by canceling from each other, in the mark detection signal C, and a minus side signal is outputted in the mark detection signal D.

Because a triple signal is outputted on the plus side in the A−B signal and a plus side signal is also outputted in the C−D signal, a quadruple signal is outputted on the plus side as the second mark detection signal extracted by adding those signals. This time t14 is recorded as a detection time of the third one of the second mark. A double signal is outputted on the plus side in the first mark detection signal extracted by subtracting the mark detection signal C from the mark detection signal A. This time t14 is recorded as a detection time of the third one of the first mark.

Because both the first and second marks are detected at this time, the control portion 48A compares the two times. Then, because the first mark passage time t14 and the second mark passage time t14 are the same time, the speed Veb of the intermediate transfer belt 24 is outputted as the speed command signal of the photoconductive drum 12. That is, because the intermediate transfer belt 24 has caught up the photoconductive drum 12, the speed of the photoconductive drum 12 is returned to the speed equal to that of the intermediate transfer belt 24. Thus, the correction of the color shift is made by matching the phases without being affected by external noises as described above. The other configurations and operations of the present embodiment are the same with those of the sixth embodiment described above.

Eighth Embodiment

An eighth embodiment of the present invention will be described below by using FIGS. 43 through 50. While the configuration in which the information detecting portion is composed of the plurality of signal detecting portions has been explained in the respective embodiments described above. Whereas, the present embodiment is configured such that one signal detecting portion detects latent image graduations, i.e., first and second position information, formed respectively on the photoconductive drum and intermediate transfer belt sides, to correct a color shift. This configuration will be explained below in detail.

Figure 43:
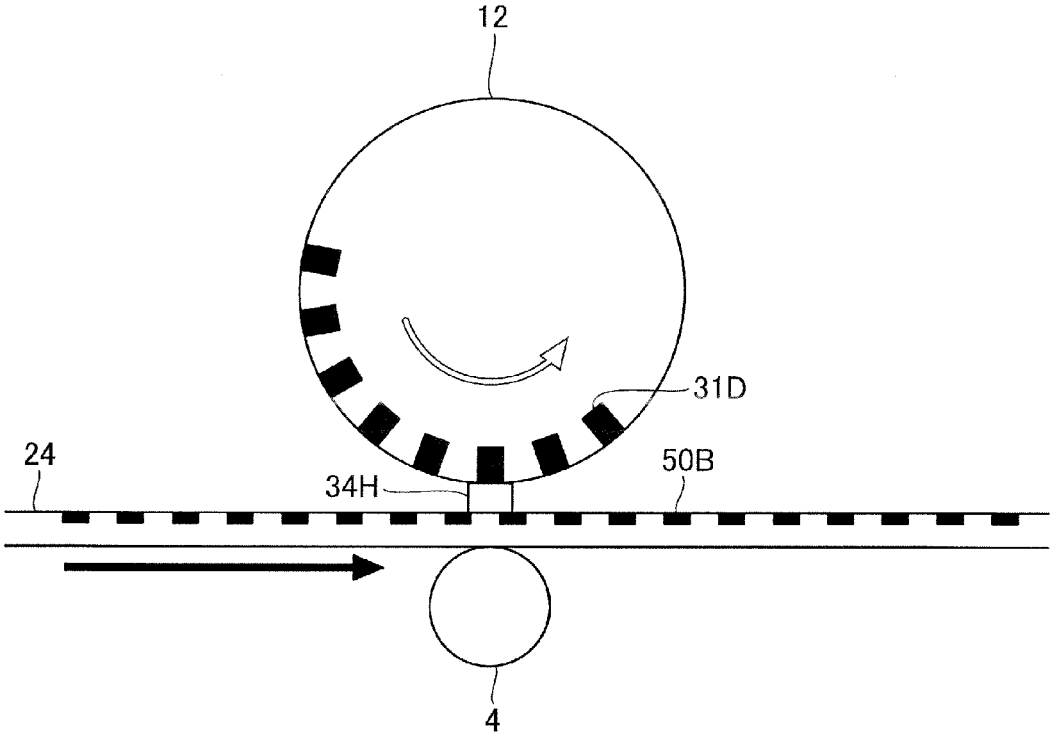
FIG. 43 is a schematic installation diagram of a latent image sensor of an eighth embodiment of the invention viewed from the sub-scanning direction.

As shown in FIG. 43, a latent image sensor 34H is disposed such that it is nipped between (nip position) the photoconductive drum 12, i.e., a second image carrier, and the intermediate transfer belt 24, i.e., a conveyance body, also in the present embodiment. Then, a latent image graduation 31D, i.e., second positional information, formed on the photoconductive drum 12 and a latent image graduation 50B, i.e., first positional information, formed on the intermediate transfer belt 24 are detected respectively by the latent image sensor 34H. It is noted that the latent image sensor 34H may be also positioned between the back surface of the belt right under the nip position and the primary transfer roller 4. That is, it is also possible to read the latent image graduation 31D on the photoconductive drum 12 and the latent image graduation 50B on the intermediate transfer belt 24 from the back side of the intermediate transfer belt 24.

Figure 44A:
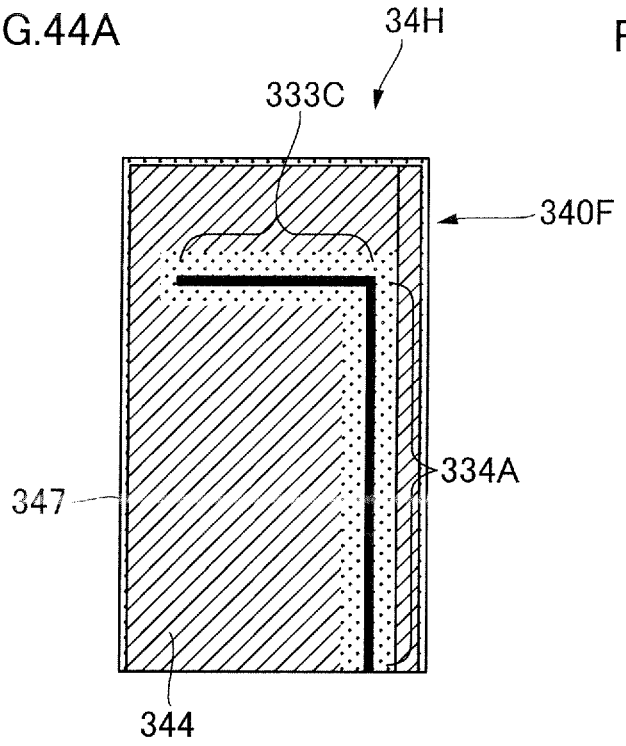
FIG. 44A is a plan view schematically showing a configuration of the latent image sensor of the eighth embodiment.
Figure 44B:
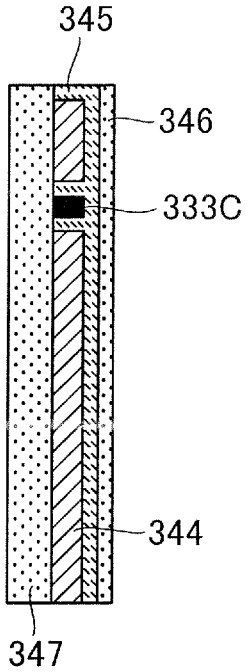
FIG. 44B is a section view of the latent image sensor of the eighth embodiment.
Figure 44C:
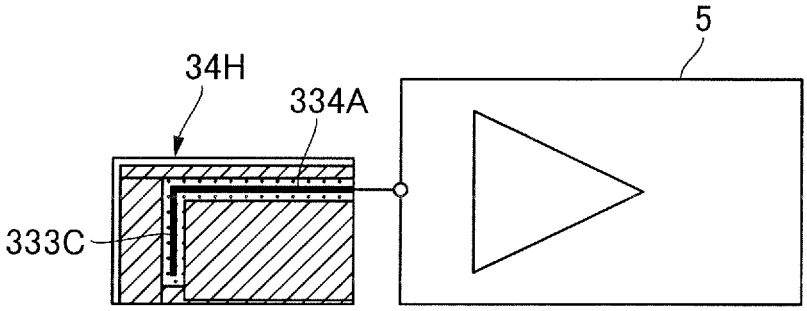
FIG. 44C is an amplifying electrical circuit connection diagram of the latent image sensor of the eighth embodiment.

The latent image sensor 34H of the present embodiment is formed of a flexible print board as shown FIGS. 44A through 44C, and copper patterns thereof form parts detecting latent images as position information. It is noted that although the flexible print board will be exemplified in the following explanation, any material may be used as long as a similar structure (insulative from a conductor) can be realized.

As shown in FIG. 44A, the latent image sensor 34H has a signal detecting portion 333C as one signal detecting portion and a signal transmitting portion 334A. The signal detecting portion 333C has a thin and long shape arrayed in the width direction (main scan direction) intersecting the conveying direction on the surface of the intermediate transfer belt 24. This signal detecting portion 333C corresponds to the probe 330 described in connection with FIG. 2 and detects the latent image graduations 31D and 50B. In the case of the present embodiment, the one signal detecting portion 333 composes the information detecting portion. The signal transmitting portion 334A is a part transmitting a detected signal and is led in the sub-scan direction so as not to detect potential fluctuation of the latent image graduations. These signal detecting portion 333C and the signal transmitting portion 334A are composed of conductors and are composed of copper patterns, respectively, in the present embodiment.

As shown in FIG. 44B, the latent image sensor 34H is layered and is configured to integrally hold the signal detecting portion 333C and others by a hold member 340F. The hold member 340F has a board 347 on which the signal detecting portion 333C and the signal transmitting portion 334A are printed on a surface thereof, a film-like cover 346 covering the surface of the board 347, and an adhesive 345 adhering the board 347 with the cover 346. The board 347 is provided with an earth 344 formed around the signal detecting portion 333C and the signal transmitting portion 334A.

Such latent image sensor 34H is manufactured by using a flexible printed board used in general in internal wiring of electronic products for example. Specifically, an electrode layer is formed on the polyimide flexible printed board 347 and a L-shaped pattern is formed by wet etching to form the signal detecting portion 333C and the signal transmitting portion 334A described above. Then, this board is covered by the cover 346 (15 μm thick for example) formed of a polyimide film through the adhesive 345 (15 μm thick for example) to prevent wear. As shown in FIG. 44C, an end of the signal transmitting portion 334A is connected to a connector not shown and is then connected to an amplifying electric circuit 5.

Figure 45A:
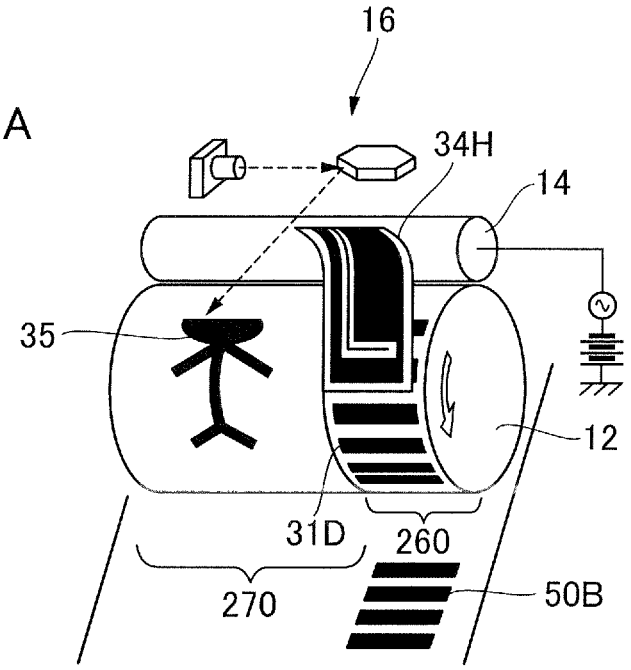
FIG. 45A is a schematic view showing how to detect graduations on the photoconductive drum by the latent image sensor of the eighth embodiment.
Figure 45B:
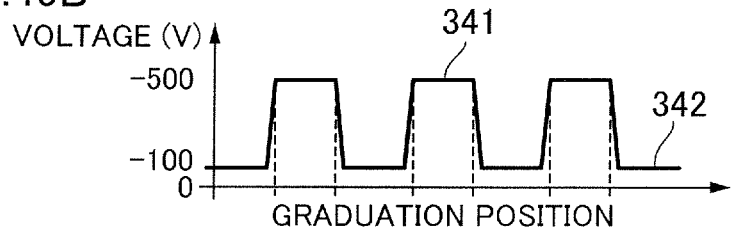
FIG. 45B is a chart showing a potential state of the graduation in the case in FIG. 45A.
Figure 45C:
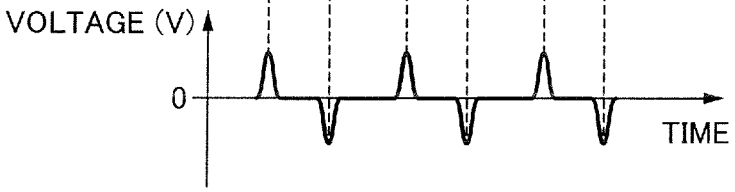
FIG. 45C is a chart showing an output signal when the graduation is detected by the latent image sensor.

Next, the operation for detecting the latent image graduation 31D on the photoconductive drum 12 will be explained in detail with reference to FIGS. 45A through 45C. The surface of the photoconductive drum 12 is charged to a predetermined potential by the charging roller 14 and is then exposed by the exposure unit 16. Then, an electrostatic latent image 35 based on image information is formed in an image region 270 of the photoconductive drum 12 and the latent image graduation 31D is formed in a non-image region 260, respectively. The electrostatic latent image 35 is developed to be a toner image by a developing unit not shown.

A surface potential of the non-image region 260 of the photoconductive drum 12 is of a same level of potential value with that of the image region 270. That is, in the latent image graduation 31D, the potential value comes out as a square wave as shown in FIG. 45B whose low potential portion 342 is −500V and whose high potential portion 341 is −100V for example. When the surface potential of this square wave is detected by the latent image sensor 34H, the surface potential is detected as a differential waveform having an amplitude centering on 0 (V) as shown in FIG. 45C. Similarly to that, the latent image graduation 50B transferred to the intermediate transfer belt 24 also has a shape of distribution of surface potential conforming to that shown in FIG. 45B and a shape of output waveform conforming to that shown in FIG. 45C.

It is noted that an optimal size of the latent image graduation 31D is determined depending on a resolution of an electro-photographic process to be used by an exposure laser, a rotational speed of the photoconductive drum, a speed of the intermediate transfer belt, a width of the latent image sensor, and the like. An exposure portion and a non-exposure portion of the photoconductive drum 12, i.e., a region where a potential is high and a region where a potential is low, will be represented as values of lines and spaces as the size of the latent image graduation 31D in the following explanation.

[Latent Image Graduation]

In the present embodiment, the one signal detecting portion 333C serially reads the latent image graduations 31D and 50B of the photoconductive drum 12 and the intermediate transfer belt 24. This arrangement requires that the signals do not overlap from each other and are separable. In the present embodiment, signals that form the latent image graduation 50B, i.e., the first positional information, and the latent image graduation 31D, i.e., the second positional information, respectively are composed of the exposure portions and the non-exposure portions, i.e., of the lines and spaces. Then, the latent image graduations 50B and 31D are formed respectively such that there exists a region where such signals do not overlap by viewing from a thickness direction orthogonal to the surface of the intermediate transfer belt 24. That is, there exists the region where the lines composing the latent image graduation 50B do not overlap with the lines composing the latent image graduation 31D when viewed from the thickness direction.

To that end, the latent image graduations 50B and 31D are formed, respectively, such that signals forming the latent image graduations 50B and 31D, respectively, are shifted in the conveying direction (the sub-scan direction) of the intermediate transfer belt 24. That is, the lines composing the latent image graduation 50B and the lines composing the latent image graduation 31D are formed by shifting in the sub-scan direction. In writing the latent image graduations 31D and 50B of the photoconductive drum 12 and the intermediate transfer belt by shifting from each other, it is necessary to adequately understand a relationship with an actual color shift and to set size of the latent image graduation and a writing shift amount. One exemplary method for setting the size of the latent image graduation will be explained with reference to FIG. 46. An axis of abscissa of the chart is a length in the sub-scan direction.

Figures 46A, 46B, 46C:
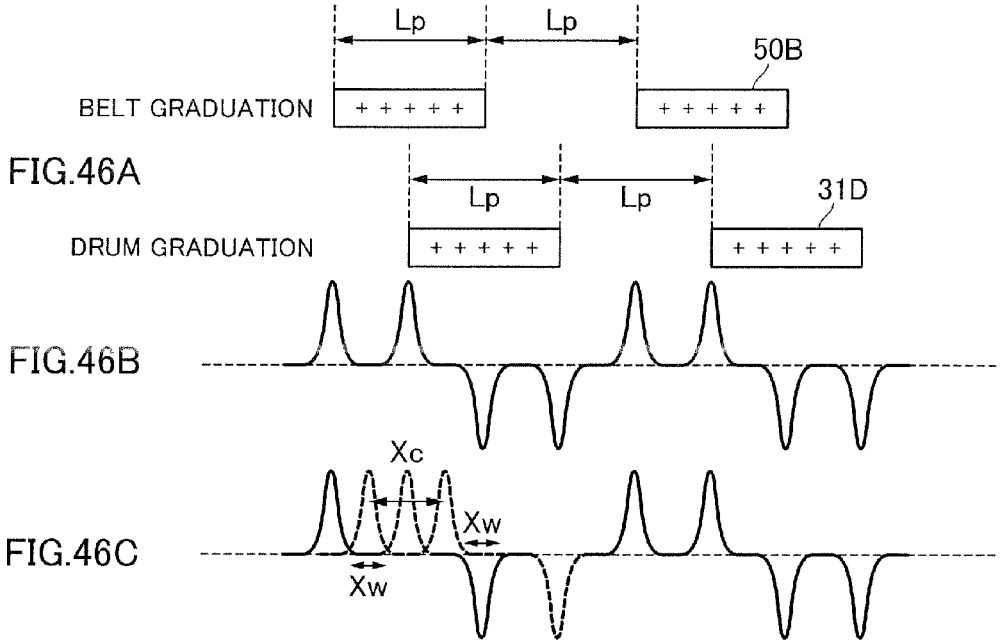
FIG. 46A is a schematic diagram showing a positional relationship of the graduations formed on the intermediate transfer belt and the photoconductive drum.
FIG. 46B is a chart showing an output waveform in a case where there exists no color shift when these graduations are detected by the latent image sensor.

In the example in FIG. 46, the sizes of the latent image graduations 50B and 31D of the intermediate transfer belt 24 and the photoconductive drum 12 are equal lines and spaces, and their ratio is 1:1. The latent image graduation 31D of the photoconductive drum 12 (drum graduation) is written by shifting by a quarter period in terms of the latent image graduation 50B (belt graduation) of the intermediate transfer belt 24.

The size of the region where the potential is high in the belt graduation, i.e., the size of the line, is denoted as Lp (μm), a shift amount of the respective color toner is denoted as ±Xc/2 (μm), and a width of a differential waveform of an output of the latent image sensor 34H is denoted as Xw. In this case, the size of the latent image graduation is determined such that the following equation is fulfilled:

$$Lp > Xc + 2Xw \qquad \text{eq. 1}$$

Next, one exemplary size of the latent image graduation will be explained when the present embodiment is applied in an image forming apparatus whose color shift of the respective color toners is 140 μm. If the resolution of this image forming apparatus is 600 dpi, a width of a minimum graduation is 25,400 μm÷600=about 42 μm. For instance, if four lines/four spaces, i.e., four lines of the exposure portions and four lines of the non-exposure portions are repeated, in the size of the latent image graduation 31D, the line size is four times of 42 μm, i.e., 168 μm, and a pitch size is eight times of 42 μm, i.e., 336 μm. The width of the differential waveform of the output of the latent image sensor 34H is supposed to be 10 μm.

This graduation size is adequate as a size for detecting a color shift because the line size of 168 μm> the color shift of 140 μm+ the width of the differential waveform of the sensor output of 20 μm, i.e., the abovementioned equation 1 is fulfilled.

[Principle for Detecting Latent Image Graduation by One Signal Detecting Portion]

Next, a method for detecting the latent image graduation 31D of the photoconductive drum 12*b* (drum graduation) and the latent image graduation 50B of the intermediate transfer belt 24 (belt graduation) by one signal detecting portion 333C of the latent image sensor 34H will be explained with reference to FIGS. 47 and 48. Because the latent image graduations 50B and 31D are read by one and same signal detecting portion 333C (antenna) as described above, the graduations are written by shifting by a predetermined degree so that the both signals do not overlap and may be discriminated. The sizes of the latent image graduation are defined as the 'line' and 'space' by the regions where the potential is high and is low.

If the graduation size is four lines and four spaces for example, the drum graduation is set by delaying two lines equivalent to a quarter period in terms of the belt graduation in the following explanation. It is supposed here that an order of outputs of the drum graduation and belt graduation is stored in advance in a memory unit or the like and an order of waveforms is accurately recognized.

Figures 47A, 47B:
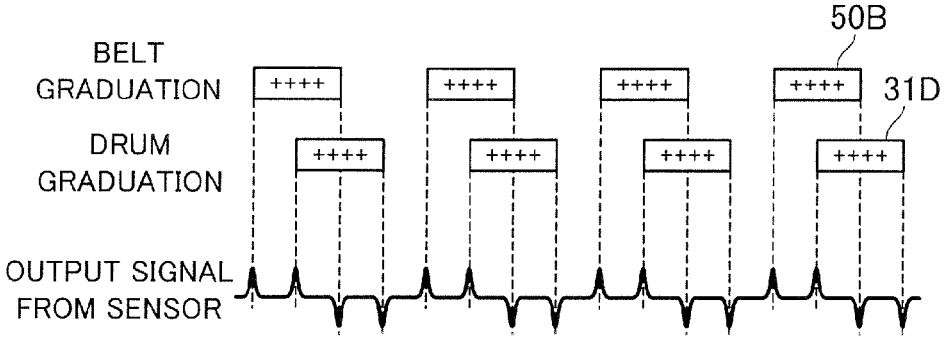

In the graduation shown in FIG. 47A, a '+' part is a region where a potential is low, e.g., −500V, and a region other than that region is a region where a potential is high, e.g., −100 V, in a case of the drum graduation. The same applies also to the belt graduation and a '+' part is a region where a potential is low, e.g., −500V, and a region other than that region is a region where a potential is high, e.g., −310 V. However, these values of the potentials vary depending on thicknesses of a photosensitive layer and a belt high resistant layer and their dielectric constants. The signal detecting portion 333C receives output signals from the belt graduation and the drum graduation sequentially as shown in FIG. 47B.

Figures 48A, 48B, 48C, 48D, 48E:
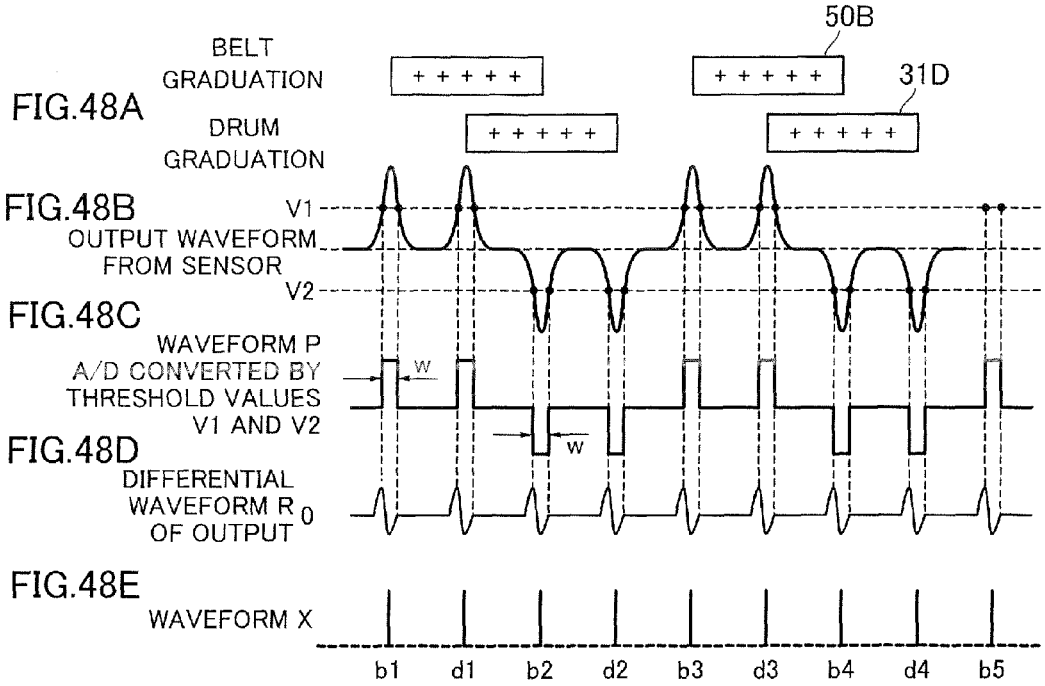

Here, a method for reading the position information of the drum graduation and the belt graduation from an output waveform of the latent image sensor 34H will be explained. As shown in FIG. 48E, peak values of the output waveform of the signal detecting portion 333C are read sequentially as positions b1, b2, b3, and so on of the belt graduation and as positions d1, d2, d3, and so on of the drum graduation as the positional information of the graduations. An axis of abscissa of the chart in FIG. 48 is time.

The output waveform of the latent image sensor 34H is A/D converted by setting threshold values V1 and V2 as shown in FIG. 48B to obtain a waveform P having a time width window W as shown in FIG. 48C. Next, a differential waveform R of this waveform P is obtained as shown in FIG. 48D. Then, AND calculation of the window W and a point (zero cross point) where the differential waveform R is 0 (V) is executed to detect a peak position as shown in FIG. 48E. The signal of the detected peak position will be referred to as a waveform X. Each peak position corresponds to each position of the belt graduation and the drum graduation. Then, the order of the outputs of the belt graduation and the drum graduation is read from the memory unit and the peak positions are denoted sequentially as b1, d1, b2, d2, b3, d3, and so on. Thus, the positional information of the drum graduation and the belt graduation can be read from the output waveform of the latent image sensor 34H.

The abovementioned example is a case where it is anticipated that the belt graduation and the drum graduation are outputted orderly with regularity. However, there is a case where the order of the signals is misunderstood by skipping one signal due to an error during the operation or by an erroneous signal caused by noise. To that end, one exemplary method for confirming whether or not the signal position of the belt graduation is orderly perceived will be explained with reference to FIG. 49. An axis of abscissa of the chart is time, and a point of time when an output bi is received from the latent image sensor 34H is represented as t_bi.

A time tlb (tlb=Lb/Veb) when the signal detecting portion 333C passes through the line of the belt graduation is found from the region of the belt graduation where the potential is low, i.e., the size Lb of the line, and the belt travel speed Veb. The tlb is also an output distance of a portion of the graduation from the latent image sensor 34H. A time tld when the signal detecting portion 333C passes through the line of the drum graduation is also found in the same manner.

Figures 49A, 49B, 49C, 49D:
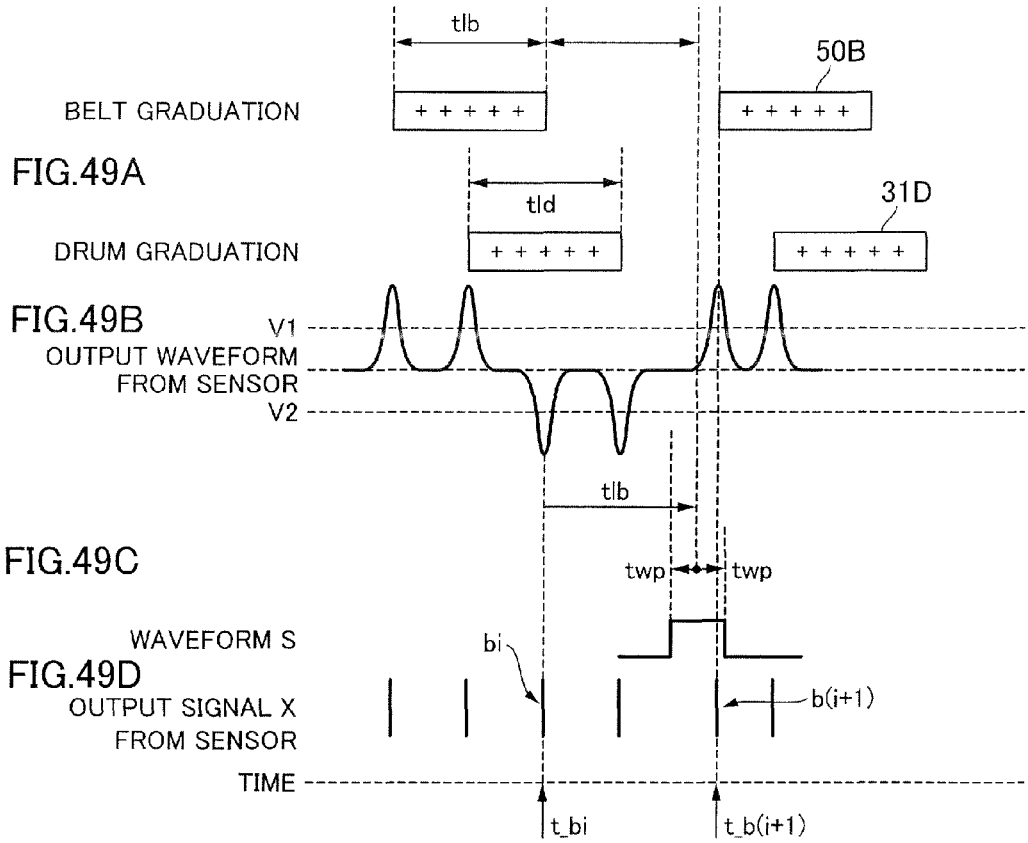

As shown in FIG. 49D, an anticipated position t_b(i+1) of an ideal output b(i+1) from the belt graduation arriving at the signal detecting portion 333C after an output bi turns out as follows. That is, because the line and space of the belt graduation is 1:1 as shown in FIG. 49A, t_b(i+1)=t_bi+tlb.

Actually, there is a slight error in writing and reading in the pitch of the belt graduation, and a maximum value of the error will be represented as ±twp. Then, with respect to the graduation position bi (i=1, 2, 3, and so on) of the belt, an anticipated position t_b(i+1) of the belt graduation b(i+1) arriving at the signal detecting portion 333C next can be expressed as t_b(i+1)=t_bi+tlb±twp.

Here, as shown in FIG. 49C, a waveform S that becomes 'H' level from a time (t_bi+tlb−twp) to a time (t_bi+tlb+twp) of the time width 2twp is generated at a point of time when the position bi of the belt graduation is detected. Then, AND calculation of the output signal X from the latent image sensor 34H and the waveform S is executed to determine b(i+1).

In a case where the signal b(i+1) is skipped due to some error and is not outputted, the signal b(i+1) cannot be obtained by the AND calculation of the signal X and the waveform S. If the skip of the signal is a transitory phenomenon, it is possible to continue the control by using a dummy signal of the signal b(i+1). If the signals of the belt graduation cannot be detected continuously by some reason, the control may be stopped at that point of time.

Meanwhile, in a case where a noise is suddenly mixed in and two or more signals corresponding to the signal b(i+1) are detected by the AND calculation of the signal X and the waveform S, only one signal closest to the time t (bi+tlb) is assumed to be the signal b(i+1) and the control at that point of time is made. In the same manner, the perception of the order of the signal positions of the drum graduation may be carried out conforming the abovementioned method by using the line size lb of the drum graduation and the rotational speed Ved of the intermediate transfer belt 24.

[Estimation of Equivalent to Color Shift Amount]

Two exemplary methods for estimating an equivalent of a color shift amount of toner images transferred among the different image forming portions (stations) from the respective positions of the drum graduation and belt graduation obtained as described above will be explained with reference to FIG. 50.

FIG. 50A shows the first example. The belt graduation and the drum graduation are written by being shifted by an amount set in advance. They are written by shifting by two lines equivalent to a quarter period in the present embodiment. Due to that, it is possible to calculate an anticipated position to which the drum graduation is to arrive by using the size of the quarter period of the graduation and the belt speed by reading a position of the belt graduation. The anticipate positions will be denoted as s1, s2, s3, and so on.

In an ideal case where the color shift of the toner images is zero among the different stations, the actual measured positions of the drum graduation d1, d2, d3, and so on should coincide with the anticipated positions s1, s2, s3, and so on. For instance, s2=d2 in FIG. 50A, and the color shift is zero at that point of time. Meanwhile, in a case where there exist deviations in the toner images among the stations, an amount equivalent to that is a difference Δt1=(d1−s1), Δt3=(d3−s3), and Δt5=(d5−s5).

It is possible to estimate the equivalent of the color shift amount by calculating the position to which the drum graduation is to arrive and by estimating the deviation from the actual measured value as described above. This method is effective when the speed of the intermediate transfer belt 24 is constant.

However, the actual belt speed fluctuates and an influence thereof given to the color shift amount is not often negligible. Then, FIG. 50B shows the second exemplary method, for estimating the equivalent of the color shift amount, in which the fluctuation of the belt speed is taken into consideration.

While the measured positions of the belt graduation are b1, b2, and so on, measured positions of the drum graduation are d1, d2, and so on. In an ideal case where the drum graduation is written by being shifted just by a quarter period as designed in advance and there exists no color shift, an average position (b1+b2)/2 between two adjacent points of the belt graduation should coincide with the drum graduation d1. Meanwhile where there exists a color shift, its difference Δt1=d1−{(b1+b2)/2} is equivalent to the deviation from the ideal position. The same applies also to the difference Δt2 from an average position (b2+b3)/2 between two adjacent points of the belt graduation and the drum graduation d2, and to the difference Δt3 from an average position (b3+b4)/2 between two adjacent points of the belt graduation and the drum graduation d3.

It is possible to estimate the equivalent of the color shift amount, even if the belt speed fluctuates, by estimating the deviation from the actual measured value by anticipating that the average position between two adjacent points of the belt graduation as the position where the drum graduation is to arrive. It is noted that it is possible to estimate the equivalent of the color shift amount in the same manner even if an average position between two adjacent points of the drum graduation is anticipated as a position where the belt graduation arrives.

Thus, in the present embodiment, the color matching control of the toner images is carried out as described in connection with FIGS. 6 and 7 for example. That is, the speed of the photoconductive drum 12 with respect to that of the intermediate transfer belt 24 is changed such that the corresponding positions of the drum graduation and the belt graduation are matched to the equivalent of the color shift amount calculated as described above. This makes it possible to accurately correct the positional shift of the toner images caused by expansion and contraction of the intermediate transfer belt 24 generated when the toner images are transferred to the intermediate transfer belt 24. As a result of the control of the color shift made based on the present embodiment, the color shift amount among four colors of toners could be suppressed from 150 μm in the past to 40 μm. The other configurations and operations are the same with those of the first embodiment described above.

Ninth Embodiment

A ninth embodiment of the present invention will be described below by using FIGS. 51 and 52. In the case of the eighth embodiment described above, because the drum graduation and the belt graduation have similar shapes, there is a possibility that it is misjudged whether the belt graduation is advanced or is retarded if it is unable to discriminate the graduations even if the color shift amount is calculated. Then, in order to be able to reliably discriminate the drum graduation from the belt graduation, latent image graduations 50C and 31E are formed, respectively, such that shapes of the drum graduation and the belt graduation are different from each other in the present embodiment. In particular, lengths of the drum graduation and belt graduation in the main scan direction are differentiated from each other in the present embodiment. This arrangement will be explained in detail below.

As shown in FIG. 51A, the latent image graduation 31E (drum graduation) and the latent image graduation 50C (belt graduation) have the equal pitch and the drum graduation is written by being delayed by a quarter period for example. In the present embodiment, a width in the main scan direction of the drum graduation is wider than that of the belt graduation. Due to that, a more induced current flows and an amplitude of an output signal becomes large because the drum graduation has more static charges as shown in FIG. 51C even if they are detected by the same signal detecting portion 333C (see FIG. 44).

Here, a method for reading position information of the drum graduation and the belt graduation from the output waveform of the latent image sensor 34H (see FIG. 44) will be explained. As shown in FIG. 52E, peak values of the output waveform of the signal detecting portion 333C are read sequentially as positions b1, b2, b3, and so on of the belt graduation and as positions d1, d2, d3, and so on of the drum graduation as the positional information of the graduations. An axis of abscissa of the chart in FIG. 52E is time.

The output waveform of the latent image sensor 34H is A/D converted by setting threshold values V2 and V3 whose potential is lower than an output amplitude of the belt graduation as shown in FIG. 52B to obtain a waveform P having a time width window W1 as shown in FIG. 52C. Next, threshold values V1 and V4 which are potentials higher than an output amplitude of the belt graduation and lower than an output amplitude of the drum graduation are set for the output waveform of the latent image sensor 34H as shown in FIG. 52B. Then, they are A/D converted to obtain a waveform Q having a time width window W2 as shown in FIG. 52C.

Then, a differential waveform R of these waveforms P and Q is obtained as shown in FIG. 52D. Next, AND calculation of the window W2 and a point (zero cross point) where the differential waveform R is 0 (V) is executed to detect a peak position as shown in FIG. 52E. The signal of the detected peak position will be referred to as a waveform Y. Each peak position corresponds to each position of the drum graduation. The peak positions are denoted sequentially as d1, d2, d3, and so on.

Still further, AND calculation of a region of the window W1 and not the window W2 and a point where the differential waveform R becomes 0 (V) is executed to detect peak positions as shown in FIG. 52E. This detected signal of the peak position will be referred to as a waveform Z. The respective peak positions correspond to the positions of the belt graduation. The peak positions are denoted sequentially as b1, b2, b3, and so on.

Thus, the positional information of the drum graduation and the belt graduation can be read from the output waveform of the latent image sensor 34H. A shift amount is calculated and a color shift is corrected in the same manner with the eighth embodiment from the obtained positions of the drum graduation and belt graduation.

While the unit for storing the order of the outputs is necessary in the eighth embodiment so that the belt graduation and the drum graduation having the same shapes are not mixed, such memory unit is not required in the present embodiment. As a result of the control of the color shift made based on the present embodiment, the color shift amount among four colors of toners could be suppressed from 150 μm in the past to 39 μm. The other configurations and operations are the same with those of the eight embodiment described above.

Tenth Embodiment

A tenth embodiment of the present invention will be described below by using FIGS. 53 and 54. In the present embodiment, latent image graduations 50D and 31F are formed respectively such that shapes of the drum graduation and belt graduation are different from each other so that the drum graduation and the belt graduation can be reliably discriminated. This arrangement will be explained below in detail.

In the present embodiment, the latent image graduation 50D (belt graduation) of the intermediate transfer belt 24 and the latent image graduation 31F (drum graduation) of the photoconductive drum 12 are formed into the shapes as shown in FIG. 53. That is, one side of the graduation has an acute shape with respect to an opposite side in a direction (sub-scan direction) in which the signal detecting portion 333C of the latent image sensor 34H detects. That is, one side of the graduation is inclined in the sub-scan direction as the graduation advances in the main scan direction. A region p1 of the inclined one side is made by providing gradient in a dot pattern of the latent image or in voltage. It is noted that the latent image sensor 34H is illustrated with respect to the latent image graduations 31F and 50D in FIG. 53 for convenience of explanation, the latent image graduations 31F and 50D are detected by one signal detecting portion 333C also in the present embodiment.

When the inclined one side region p1 passes through the signal detecting portion 333C in the case of the present embodiment configured as described above, an induced current I=dQ/dt is reduced because the signal detecting portion 333C crosses a boundary line of static charge aslant by taking a time t. That is, an output amplitude is not fully detected. Meanwhile, an induced current is observed as a differential waveform in the same manner with the embodiments described above in an opposite non-inclined region p2.

That is, the latent image graduation formed into such shape is detected by the signal detecting portion 333C, differential waveforms as shown below the respective graduations in FIG. 53 are detected. That is, in the case where a left hand side of the graduation is formed into the acute shape (the upper chart in FIG. 53), almost no differential waveform 'projecting upward' is detected as an output of the region p1 and a differential waveform 'projecting downward' of the region p2 is detected. In contrary to that, in a case where the right hand side of the graduation is formed into the acute shape (the lower chart in FIG. 53), a differential waveform 'projecting upward' of the region p2 is detected and almost no differential waveform 'projecting downward' of the region p1 is detected.

Utilizing such characteristics of the shapes of the latent images, the shapes of the drum graduation and the belt graduation are formed such that their right and left are reversed as shown in FIG. 54A. That is, a downstream in a detection direction (the right hand side in the chart) of the latent image sensor 34H of the belt graduation is inclined to be able to obtain a differential waveform projecting upward detected upstream in the detection direction of the latent image sensor 34H as shown in FIG. 54B. Meanwhile, an upstream in the detection direction (on the left hand side of the chart) of the latent image sensor 34H of the drum graduation is inclined to be able to obtain a differential waveform projecting downward detected downstream in the detection direction as shown in FIG. 54B. This arrangement makes it easy to discriminate both the drum graduation and the belt graduation in the outputs of the drum graduation and belt graduation serially arrayed.

Here, a threshold value V1 (>0) is set for the belt graduation and a threshold value V2 (<0) is set for the drum graduation as shown in FIG. 54B. Then, as shown in FIG. 54C, positions of the belt graduation b1, b2, and so on and positions of the drum graduation d1, d2, and so on are recognized from the peak values of the output waveform. A shift amount may be calculated by the method conforming to the eight embodiment.

Specifically, in the case where the size of the belt graduation and drum graduation is four lines/four spaces, an average (b1+b2)/2 between two adjacent points, i.e., position information of the belt graduation, is compared with position information d1 of the drum graduation. Their difference d1−{(b1+b2)/2} is an amount corresponding to a color shift at the output point of time of d1. In an ideal case where there is no color shift, d1=(b1+b2)/2. The next points d2, d3, and son can be calculated in the same manner.

The present embodiment also requires no memory unit for discriminating the drum graduation and belt graduation as described in the eighth embodiment. The present embodiment also enables to reduce the types of the threshold values set to detect peak values of the drum graduation and belt graduation from four types in the ninth embodiment to two types. The present embodiment does not also require the drum graduation and belt graduation to be formed by shifting their phases as described in the eighth and ninth embodiments. As a result of the control of the color shift made based on the present embodiment, the color shift amount among four colors of toners could be suppressed from 150 μm in the past to 42 μm. The other configurations and operations are the same with those of the eighth embodiment described above.

Eleventh Embodiment

An eleventh embodiment of the present invention will be described below by using FIG. 55. In the present embodiment, latent image graduations 50E and 31G are formed respectively such that shapes of the drum graduation and belt graduation are different from each other to be able to reliably discriminate the drum graduation from the belt graduation. In a case of the present embodiment in particular, the latent image graduation 50E (belt graduation) of the intermediate transfer belt 24 and the latent image graduation 31G (drum graduation) of the photoconductive drum 12 are formed such that lengths thereof in the sub-scan direction are different from each other and periods of their signals are equal. This arrangement will be explained in detail below.

As shown in FIG. 55A, different duties of graduations are used in the drum graduation and the belt graduation, and a graduation size of such condition that a low potential region (region indicated by '+') of the drum graduation is included in a low potential region of the belt graduation is set. The graduation size is set such that a color shift is kept in a level not collapsing this inclusion relation.

For instance, in an image forming apparatus which causes a color shift of 150 μm in a case where the present embodiment is not carried out, 12 lines (about 504 μm) of the low potential regions and 12 spaces (about 504 μm) of the high potential regions are set when a size of the belt graduation is equivalent to 600 dpi. However, it is possible to contract this size within a range not overlapping with a next output signal.

The size of the low potential region '+' of the drum graduation is two lines by delaying the edge of the low potential region of the drum graduation by five lines from the edge of the low potential region of the belt graduation in the present embodiment. The periods of the drum graduation and belt graduation are set to be equal.

FIG. 55B shows an output waveform when the drum graduation and belt graduation formed as described above are detected by one signal detecting portion 333C (see FIG. 44). Positions of the drum graduation and belt graduation are detected as shown in FIG. 55C from peak values of this waveform. Then, positions d1, d2, d3, and so on of the drum graduation and positions b1, b2, b3, and so on of the belt graduation are obtained by the method conforming to the eighth embodiment.

Then, an average (d1+d2)/2 between two adjacent points is calculated for the position of the drum graduation and an average (b1+b2)/2 between two adjacent points is calculated for the position of the belt graduation to compare a difference between them. In an ideal case where there exists no color shift, the difference between them, i.e., {(d1+d2)/2}−{(b1+b2)/2} is zeroed. If the difference is not zero in contrary, the difference corresponds to a color shift amount around graduations d1, d2, b1 and b2.

In the same manner, a difference between an average (d3+d4)/2 between two adjacent points of a next drum graduation and an average (b3+b4)/2 between two adjacent points of a belt graduation corresponds to a color shift amount at the next point of time. The inclusion relation between the drum graduation and the belt graduation may be inversed from that described above.

The present embodiment required no memory unit for discriminating the drum graduation from the belt graduation like that described in the eighth embodiment. The present embodiment also enables to reduce the types of the threshold values set to detect peak values of the drum graduation and belt graduation from four types in the ninth embodiment to two types. Still further, the present embodiment does not require to incline the shape of the graduation unlike the tenth embodiment. As a result of the control of the color shift made based on the present embodiment, the color shift amount among four colors of toners could be suppressed from 150 μm in the past to 40 μm. The other configurations and operations are the same with those of the eighth embodiment described above.

Twelfth Embodiment

A twelfth embodiment of the present invention will be described below by using FIGS. 56 through 67. When the latent image sensor that detects the latent image graduations of the photoconductive drum and the intermediate transfer belt is integrated and is disposed at the transfer position as described above in the respective embodiments, there is a possibility that the latent image graduations are disturbed by an electric discharge caused by a potential difference. Electric potential distributions may be enumerated, depending on the transfer positions, from the photoconductive drum side as the photoconductive drum (−500V and −100 V), the latent image sensor (earth), the intermediate transfer belt (−400 and −200), and the primary transfer roller (+1200 V for transferring toner) for example. Apparent voltages appearing on the intermediate transfer belt are +1000 V and +800 V, and a potential difference with the photoconductive drum is 900 V to 1500V, so that there is a possibility of generating an electric discharge due to the potential difference. If a discharge occurs, the latent image graduations are disturbed and it becomes difficult to accurately register the images as a result. Then, the present embodiment is arranged to suppress such discharge and to apply a voltage on a conductor portion of the latent image sensor in order to be able to normally and stably detect the latent image graduations. This arrangement will be described in detail below.

As shown in FIG. 56A, the tandem-type image forming apparatus as shown in FIG. 1 is applied also in the present embodiment. It is noted that while a subscript is appended to each reference numeral denoting each component of each image forming portion in FIG. 56A to indicate that a very component belongs to a very image forming portion, the specific structure of the image forming portion is the same with those described above, so that their detailed explanation will be omitted here. Still further, while the same reference numerals with those of the first embodiment will be typically used for the latent image graduation and the latent image graduations formed on the photoconductive drum and the intermediate transfer belt, latent image graduations corresponding to a structure of the latent image sensor will be used as these latent image graduations. That is, the structures of the embodiments described above are applicable as the structure of the latent image sensor and a latent image graduation corresponding to the structure of the latent image sensor will be formed in the present embodiment.

FIG. 56A also shows a cassette 80 configured to store recording mediums Pa, a conveying roller 81 that conveys the recording medium from the cassette 80, a fixing apparatus 82, and others as components omitted in FIG. 1. The fixing apparatus 82 fixes a toner image on the recording medium Pa by heating and pressing the recording medium Pa on which the toner image has been transferred. The recording medium Pa on which the toner image has been fixed is discharged to a discharge cassette 83.

Primary transfer power sources 84*a* through 84*d* apply plus voltage from 1000 to 2000V for example to the primary transfer rollers 4*a* through 4*d*, respectively, as the primary transfer bias. A latent image graduation 50 is formed as first position information on the intermediate transfer belt 24 as shown in FIGS. 56B and 57A and 57B also in the present embodiment. The present embodiment is also arranged to detect the latent image graduation 50 by latent image sensors 34*b* through 34*d* disposed respectively so as to be nipped between the photoconductive drums 12*b* through 12*d* and the intermediate transfer belt 24 (vicinity including the primary transfer position) of the image forming portions 43*b* through 43*d*. An erasing roller 53, i.e., an erasing portion, configured to erase the latent image graduation 50 formed on the intermediate transfer belt 24 and a counter electrode 52 are disposed upstream the photoconductive drum 12*a* with respect to the conveying direction of the intermediate transfer belt 24. The erasing roller 53 and the counter electrode 52 are disposed upstream the driving roller 36, and a pre-charging portion 85 to be explained in a thirteenth embodiment is disposed between the driving roller 36 and the photoconductive drum 12*a* in the present embodiment. It is noted that the pre-charge portion 85 is omitted when the pre-charger to be used in the thirteenth embodiment is not used, the present embodiment shows the pre-charge portion 85 for convenience of explanation.

Similarly to the embodiments described above, a latent image graduation 31*a* is exposed out of a normal image region (non-image region) in exposing in the image forming portion 43*a* by using the exposure unit 16*a* also in the present embodiment as shown in FIG. 57A. Then, the latent image graduation 31*a* on the photoconductive drum 12*a* is transferred to the intermediate transfer belt 24 to be the latent image graduation 50 by the primary transfer roller 4*a* to which high voltage is applied by the primary transfer power source 84*a*.

As shown in FIG. 57B, the latent image graduation 31*b* is formed on the photoconductive drum 12*b* in the same manner also in the image forming portion 43*b*. As shown in FIG. 57B, the latent image graduation 31*b* may be formed and disposed on both ends of the photoconductive drum 12*b* as long as the both ends are out of the image region. The latent image graduation 50 transferred to the intermediate transfer belt 24 is detected by the latent image sensors 34*b* through 34*d* of the respective image forming portions 43*b* through 43*d* and is then erased by the erasing roller 53 and the counter electrode 52 after passing through the secondary transfer portion T2. There is a case where the latent image graduation 50 receives a predetermined voltage at the pre-charge portion 85 as necessary. It is noted that instead of transferring the latent image graduation 31*a* of the photoconductive drum 12*a* to the intermediate transfer belt 24, the present embodiment may be arranged such that a detection portion that detects the latent image graduation 31*a* is provided and a writing portion provided on the intermediate transfer belt 24 writes corresponding to a detected result of the detection portion. That is, the latent image graduation 31*a* on the photoconductive drum 12 may be transcribed on the intermediate transfer belt 24 as the latent image graduation 50 by using the detection portion and the writing portion.

The latent image sensor 34*b* detects the latent image graduation 50 (belt graduation) of the intermediate transfer belt 24 and the latent image graduation 31*b* (drum graduation) of the photoconductive drum 12*b*, respectively. Signals of the latent image sensor 34*b* are A/D converted by an A/D conversion portion 86 and are then sent to the control portion 48 that executes phase matching. This electrical circuit will be described later. The control portion 48 sends an increment or decrement signal to a motor driving portion 87 corresponding to a degree of the drum graduation advancing or delaying with respect to the belt graduation. Receiving a signal of the motor driving portion 87, the drum driving motor 6 increases or decreases a rotational speed of the photoconductive drum 12*b* to execute the phase matching. This operation is commonly carried out in the image forming portions 43*b* through 43*d*.

Because the latent image sensor is installed to be nipped at the primary transfer position and detects a deviation between the latent image graduation (image position) on the drum and the latent image graduation (image position) on the belt at the transfer position, there exists no temporal delay. Accordingly, the present embodiment enables various color shifts from a long period to a shirt period to be corrected in real-time.

FIGS. 58A and 58B show a specific example of the latent image sensors 34*b* through 34*d* as described above. It is noted that the structure of the latent image sensor of the present embodiment is the same with that of the latent image sensor 34E of the fifth embodiment shown in FIGS. 15 and 16. Accordingly, because the latent image sensors 34*b* through 34*d* of the respective image forming portions have the same structure, these latent image sensors 34*b* through 34*d* will be explained as the latent image sensor 34E in the following explanation. Still further, the subscripts indicating components of each image forming portion will be omitted here. Still further, while FIG. 58A shows a half of the latent image sensor 34E in a thickness direction of the intermediate transfer belt 24 side, the latent image sensor 34E has a similar structure also on the photoconductive drum 12 side as described later. Earths disposed around the signal detecting portion and the signal transmitting portion are denoted as an earth 3441 on the intermediate transfer belt 24 side and an earth 3442 on the photoconductive drum 12 side to discriminate as those on the intermediate transfer belt 24 side and the photoconductive drum 12 side.

The latent image sensor 34E has the signal detecting portion 333 as a conductor portion, the signal transmitting portion 334 and the earth 3441, and a hold member 340D holds integrally them also in the present embodiment. Specifically, an electrode layer is formed on a board 347 (polyimide flexible printed board) used in general in internal wiring of electronic products for example and a L-shaped pattern is formed by wet etching to form the signal detecting portion 333 and the signal transmitting portion 334 described above. The earth 3441, i.e., a conductor portion, is disposed around the signal detecting portion 333 and the signal transmitting portion 334 and is earthed. Then, this board is covered by the cover 346 (15 μm thick for example) formed of a polyimide film through the adhesive 345 (15 μm thick for example) to prevent wear.

As shown in FIG. 59, an end of the signal transmitting portion 334 is connected to a connector not shown and is then connected to an amplifying electric circuit 5. The amplifying electric circuit 5 is an amplifying circuit using a FET (field effective transistor). An electric current flowing through the signal detecting portion 333 enters from an input side of the FET and changes a gate voltage G. At this time, a current between a source S–drain D changes in accordance to the gate voltage G. When the current between the source and the drain increases for example, the drain voltage drops accordingly. Thus, the current between the source and the drain sensitively change in accordance to the gate voltage and as a result, a drain voltage, i.e., an output voltage, changes. An amplification factor of this structure is, i.e., Vout/Vin=about 18 times (actually measure value) for example. Still further, a low pass filter F of a cut-off frequency, e.g., 4420 Hz, is provided on an output side to reduce a noise.

A specific configuration of the latent image sensor 34E of the present embodiment constructed as described above will be explained with reference to FIGS. 60A through 60C. The latent image sensor 34A is disposed so as to be nipped at a position (vicinity including the primary transfer position) where the photoconductive drum comes in contact with the intermediate transfer belt, and its conductor portion is three-layered to be able to concurrently read the latent image graduations of the photoconductive drum and intermediate transfer belt as shown in FIG. 60C. That is, the latent image sensor 34 has first and second sensor portions 331A and 332A. The first sensor portion 331A has the signal detecting portion 333 as a first information detecting portion and the signal transmitting portion 334. The second sensor portion 332A has a signal detecting portion 335 as a second information detecting portion and a signal transmitting portion 336.

The second sensor portion 332A is disposed at a position different from the first sensor portion 331A in a thickness direction orthogonal to a surface of the intermediate transfer belt 24. An earth 344A is disposed as a guard conductor (conductor portion) at a position where the first and second sensor portions 331A and 332A superimpose viewing from the thickness direction between the first and second sensor portions 331A and 332A. Still further, an earth 3441 is disposed around the first sensor portion 331A and at almost a same position with that in the thickness direction and an earth 3442 is disposed around the second sensor portion 332A and at almost a same position with that in the thickness direction, respectively.

Here, the signal detecting portion 333, the signal transmitting portion 334 and the earth 3441 are conductor portions on the intermediate transfer belt 24 side, and the signal detecting portion 335, the signal transmitting portion 336 and the earth 3442 are the conductor portions on the photoconductive drum 12 side. The earth 344A is provided to prevent one (belt or drum) latent image graduation from being detected by the other (drum or belt) latent image sensor. Gaps between the three layers of the conductor portions are isolated so as not to short by the boards 347 as an interlayer insulating material. Both front and back surfaces of the three layers of the conductor portions are coated by covers 346 to prevent shorting.

In a case of the present embodiment in particular, the signal detecting portion 333, the signal transmitting portion 334 and the earth 3441 around them, the signal detecting portion 335, the signal transmitting portion 336 and the earth 3442 around them, and the earth 344A are connected to high voltage power sources 90, 91 and 92, respectively. These high voltage power sources 90 through 92 correspond to conductor portion voltage applying portions that apply voltage to the respective conductor portions.

A detail in installing the high voltage power source will be described below by exemplifying the signal detecting portion 335 on the photoconductive drum 12 side. FIG. 61 is an electric circuit diagram showing a configuration in which the high voltage power source is connected to the electric circuit described above in connection with FIG. 59. The high voltage power source 92 is connected to the signal detecting portion 335, the signal transmitting portion 336 and the earth 3442 in order to keep the whole circuit in high voltage with respect to a FET driving power source that drives the FET. Because a detection output is outputted while being superimposed with the high voltage in this configuration, a capacitor is connected to an output portion and a power source of 5 V is inputted such that the detection output is outputted centering on 5 V. The high voltage power source 90 is connected also to the signal detecting portion 333, the signal transmitting portion 334 and the earth 3441 on the intermediate transfer belt 24 side through a similar electrical circuit. The high voltage power source 91 is connected directly to the earth 344A, i.e., the guard conductor.

Next, an electric discharge between the latent image graduations and the latent image sensor 34E will be explained with reference to FIGS. 62 through 64. The surface of the photoconductive drum is charged homogeneously by about −500 V for example by the charging unit in forming an electrostatic latent image on the surface of the photoconductive drum. Then, a laser beam is scanned by the exposure unit in accordance to an image signal to form a latent image by changing a surface potential of a laser beam irradiated part on the surface of the photoconductive drum around to −100V. That is, a potential of the exposed part (Vlight) is −100V and a potential of the part not exposed (Vdark) is −500V. These voltages are modified depending on an image forming apparatus and on a temperature and humidity environment, the voltages do not always take the values described above.

FIG. 62 is a chart showing a temporal transition of a voltage Vd on the drum when a latent image graduation is written on the photoconductive drum. An axis of abscissa represents time and an axis of ordinate represents voltage. FIG. 62 shows as a rectangular voltage waveform. A time of Vlight is different from a time of Vdark depending on a target value of reduction of a color shift, frequencies of a color shift control, processing speeds, and the like. In order to suppress a color shift to be less than 50 μm for example, a four lines/four spaces latent image graduation that repeats exposure and non-exposure per four lines is formed if the image forming apparatus has an image resolution of 600 dpi. In this case, a graduation of a pitch of 25.4 (mm)÷600 (dpi)×(4+4)=339 μm is suitable because it will satisfy the frequency of the color shift control and because its detection accuracy is stable. Accordingly, the time of Vlight and the time of Vdark are calculated respectively by 169 μm÷(rotational speed of drum).

FIGS. 63A and 63B are charts showing a potential Vb of the latent image graduation 50 on the intermediate transfer belt 24 transferred from the photoconductive drum 12*a* to the intermediate transfer belt 24 in the image forming portion 43*a*. Vlight is assumed to be −200 V and Vdark is assumed to be −380 V. When the primary transfer bias Vt (1200 V) is applied to the primary transfer roller 4*b* in the image forming portion 43*b* by the primary transfer power source 84*b*, these voltages turn out to be −200+1200=1000 (V) and −380+1200=820 (V), respectively.

FIG. 64 is a chart showing a potential difference in detecting the latent image graduation of the photoconductive drum and the latent image graduation of the intermediate transfer belt 24 by interposing the latent image sensor at the primary transfer position on and after the image forming portion 43*b*. It can be seen that the potential difference between the latent image graduation of the photoconductive drum and the latent image graduation of the intermediate transfer belt (Vb−Vd) is 1000−(−500)=1500 V in maximum.

Here, a discharge starting voltage will be explained. The discharge starting voltage E0 is proportional to Vd (Vb+Vt), where Vd is a drum surface potential, Vb is a belt surface potential, and Vt is a primary transfer voltage. In the image forming apparatus studied by the inventor, the latent image graduation of the drum is transferred to the intermediate transfer belt by discharge when the primary transfer voltage is set at 800 V. It can be seen that a charge moving condition (transfer) from the photoconductive drum to the intermediate transfer belt is −100−(0+800)=−900 V.

The latent image graduation on the intermediate transfer belt was also erased by 1500 Vp−p (±750 V). From this fact, a charge moving condition (de-electrification) to the erasing roller that erases the graduation from the belt is 0−(−200−750)=950 V. It can be seen from these studies that discharge occurs in a vicinity of 900 V.

Because the discharge phenomenon varies depending on a structure of an image forming apparatus and a temperature and humidity condition, the abovementioned discharge cannot be said to occur indiscriminately, but may be a standard. Because the potential difference between the latent image graduation of the photoconductive drum and the latent image graduation of the intermediate transfer belt can be 1500 V in maximum as described above, there is a possibility that such a discharge occurs and the latent image graduation is disturbed or is dissipated. Then, in order to alleviate such a potential difference between the latent image graduation of the photoconductive drum and the latent image graduation of the intermediate transfer belt, the present embodiment tries to avoid such a discharge by applying a voltage to the conductor portion of the latent image sensor such that the potential difference is lowered to be less than the discharge starting voltage.

[Basic Process in Applying Voltage]

Next, a basic process in applying a voltage to the conductor portion of the latent image sensor of the present embodiment will be explained with reference to FIG. 65. At first, in order to calculate a maximum potential difference, set values of a charge potential Vd of the photoconductive drum and a primary transfer voltage (primary transfer bias) Vt are read in Step 201. Next, Vt−Vd=ΔV is calculated to judge whether or not ΔV is greater than a discharge starting voltage Vdis in Step 202. Vdis is assumed to be 900 V obtained as a result of the study described above in the present embodiment. If the result of the judgment is No, no voltage is applied to the conductor portion and an earth condition (0V) is kept in Step 203. If the result of the judgment is Yes in contrary, the step advances to a voltage application determining process in Step 204. The voltage application determining process will be described later in detail with reference to FIG. 66. Then, the voltage determined by the voltage application determining process is applied to each conductor portion of the latent image sensor in Step 205. That is, the determined voltage is applied to the signal detecting portion 333, the signal transmitting portion 334 and the earth 3441 on the intermediate transfer belt 24 side by the high voltage power source 90. Still further, the determined voltage is applied to the signal detecting portion 335, the signal transmitting portion 336 and the earth 3442 on the photoconductive drum 12 side by the high voltage power source 92. Further, the determined voltage is applied to the earth 344A, i.e., the guard conductor, by the high voltage power source 91. In this condition, the latent image graduations formed respectively on the intermediate transfer belt 24 and the photoconductive drum 12 are detected by the latent image sensor 34E in Step 206.

[Voltage Application Determining Process]

Next, the voltage application determining process described above will be explained with reference to FIG. 66. In the present embodiment, the maximum potential difference ΔV between the latent image graduation of the photoconductive drum and the latent image graduation of the intermediate transfer belt is separated into a plurality of stages to carry out a discharge check. While the case where the conductor portions of the latent image sensor 34E are three-layered has been explained above, the explanation will be made such that it is possible to deal with this process even when a number of layers is expanded to other numbers of layers such as two layers and mono-layer.

When a number of layers of the conductor portions is n, a number of potential differences by which ΔV can be separated is 2~(n+1) stages. That is, while up to 2~3+1 (=4) stages of potential differences can be assured when the conductor portions are three-layered, the number of stages is only two when the conductor portion is one-layered. The configuration in which the conductor portions are three-layered and the potential difference can be separated up to four stages will be explained below. The similar process can be executed even if a number of layers of the conductor portions is another number as long a number of separable stages is different.

At first, the potential difference ΔV is separated into two stages. In this case, the equal voltage is applied to all of the conductor portions of the latent image sensor 34E, i.e., the signal detecting portion 333, the signal transmitting portion 334 and the earth 3441 on the intermediate transfer belt 24 side, the signal detecting portion 335, the signal transmitting portion 336 and the earth 3442 on the photoconductive drum 12 side, and the earth 344A. When the charge potential (drum potential) of the photoconductive drum 12 is Vd, e.g., −500 v, and ΔV described above is 1000−(−500)=1500 V for example, this voltage is set to be Vd+ΔV/2, e.g., −500+1500/2=250 V, in Step 301. It is noted that this voltage may be set at an arbitrary value other than that. Next, it is checked whether or not a discharge occurs in Step 302. A specific method for checking a discharge will be described later. If no discharge occurs as a result of the discharge check, i.e., No in Step 2, this process is finished.

Meanwhile if a discharge occurs, i.e., Yes, in the discharge check step, the potential difference is separated into three stages. In this case, two types of voltages are applied to the three layers of conductor portions in Step 303. These voltages are Vd+ΔV/3, e.g., −500+1500/3=0 V, and Vd+2×ΔV/3, e.g., −500+2×(1500/3)=500 V. It is noted that there voltages may be set at arbitrary values other than those as long as the following conditions are met. Still further, the drum potential Vd is minus and the belt potential (surface potential of the intermediate transfer belt 24 to which the primary transfer voltage is applied) Vb is plus in the present embodiment. That is, a magnitude relationship between Vd and Vb is Vd<Vb. Due to that, the voltage to be applied is set to meet the following relationship, where HV(d) is a voltage to be applied to the conductor portions on the photoconductive drum 12 side, HV(M) is a voltage to be applied to the intermediate conductor portion, and HV(b) is a voltage to be applied to the conductor portions on the intermediate transfer belt 24 side:

$$HV(d) \leq HV(M) \leq HV(b)$$

Here, the conductor portions on the photoconductive drum 12 side are the signal detecting portion 335, the signal transmitting portion 336, and the earth 3442, the intermediate conductor portion is the earth 344A, and the conductor portions on the intermediate transfer belt 24 side are the signal detecting portion 333, the signal transmitting portion 334, and the earth 3441. Further, if the magnitude relationship of Vd and Vb is reversed, a direction of the inequality sign of the abovementioned relational expression is also reversed. Still further, because there are two types of voltages to be applied, the voltage HV(M) to be applied to the intermediate conductor portion is equalized with the voltage HV(d) to be applied to the conductor portions on the photoconductive drum 12 side or the voltage HV(b) to be applied to the conductor portions on the intermediate transfer belt 24 side. Further, the lower voltage among the two types of voltages is referred to as HV(d) and the higher voltage as HV(b).

Next, it is checked whether or not a discharge occurs in Step 304. If no discharge occurs after carrying out the discharge check, i.e., No in Step 304, this process is finished. Meanwhile, if a discharge occurs as a result of the discharge check, i.e., Yes in Step 304, the potential difference is separated into four stages. In this case, three types of voltages are applied to the three layers of conductor portions in Step 305. These voltages are Vd+ΔV/4, e.g., −500+1500/4=−125 V, Vd+2×ΔV/4, e.g., −500+2×(1500/4)=250 V, and Vd+3×ΔV/4, e.g., −500+3×(1500/4)=625 V. It is noted that there voltages may be set at arbitrary values other than those as long as the following conditions are met.

Here, the magnitude relationship between Vd and Vb is Vd<Vb, so that HV(d)<HV(M)<HV(b) are met. To that end, HV(d)=Vd+ΔV/4, HV(M)=Vd+2×ΔV/4, and HV(b)=Vd+3×ΔV/4.

A discharge check is carried out again in Step 306. If no discharge occurs as a result of the discharge check similarly to the previous cases, i.e., No in Step 306, this process is finished. If a discharge occurs, i.e., Yes as a result of the discharge check, there is a possibility that the discharge is occurring by another factor, so that 'abnormal' is displayed on a display portion of the image forming apparatus for example in Step 307 and the process is finished.

[Discharge Check]

Next, the discharge check described above will be explained. Here, detection accuracy of the latent image graduation (drum graduation) of the photoconductive drum and the latent image graduation (belt graduation) of the intermediate transfer belt 24 during when no primary transfer voltage Vt is applied is measured in advance in each image forming portion, and a comparison with this detection accuracy is made. The explanation will be made below by exemplifying the image forming portion 43*b*.

For the drum graduation, if the image forming apparatus has a resolution of 600 dpi, the latent image graduation 31*b* of two lines/two spaces in which exposure and non-exposure are repeated per two lines is formed. A pitch of the drum graduation is 25.4 (mm)÷600 (dpi)×2+2=84 μm. Considering variation within one rotation of the photoconductive drum, a time of four rotations of the photoconductive drum was detected. (it was 3.5 seconds because a photoconductive drum of 84 mm in diameter was used and a belt conveying speed was 300 mm/sec. in the image forming apparatus studied by the inventor et. al.) A number of detected drum graduation was 300×3.5/0.084=12500. A standard deviation σ of the variation of the pitch was 2.0 μm.

In the same manner, as for the belt graduation, if the image forming apparatus has a resolution of 600 dpi, the latent image graduation 50 of four lines/four spaces in which exposure and non-exposure are repeated per four lines is formed. A pitch of the belt graduation is 25.4 (mm)÷600 (dpi)×(4+4)=168 μm. Considering variation within one rotation of the belt, a time of four rotations of the belt was detected. (it was 29.7 seconds because an intermediate transfer belt of 710 mm in diameter was used and a belt conveying speed was 300 mm/sec. in the image forming apparatus studied by the inventor et. al.) A number of detected belt graduation was 300×29.7/0.168=53000. A standard deviation σ of the variation of the pitch was 2.5 μm.

In short, the accuracy of the latent image graduation when no discharge occurs is as follows:

drum graduation: accuracy (standard deviation σ) 2.0 μm (detected for 3.5 seconds by 3570/sec. of number of detections)

belt graduation: accuracy (standard deviation σ) 2.5 μm (detected for 29.7 seconds by 1780/sec. of number of detections)

Next, when the accuracy when a discharge has occurred was measured, it was five times or more when the inventor et. al. were measured (11 μm of drum graduation accuracy σ, and 15 μm of belt graduation accuracy σ).

From the results described above, it is judged whether or not a discharge is occurring by the standard that the detection accuracy of the latent image graduation is twice or more. An actual discharge check is carried out by judging not after detecting the rotations of the drum and belt of 3.5 seconds and 29.7 seconds but by detecting 10 detection signals. That is, 10 each signals of the drum graduation and of the belt graduation are detected by the latent image sensor 34E and the control portion 48 finds their standard deviations (detected standard deviations). Next, they are compared with the standard deviation (criterion standard deviation) during which no primary transfer voltage described above is applied and stored in the graduation of the control portion 48 in advance. Then, it is judged that a discharge is occurring if any one of the detected standard deviation found as described above is twice or more of the corresponding criterion standard deviation.

Specific Examples

Next, a specific example for dividing the potential difference ΔV between the belt graduation potential and the drum graduation potential will be explained with reference to FIG. 67 following the flow in FIGS. 65 and 66 described above. FIG. 67 shows exemplary voltages applied by the high voltage power sources in cases where the drum graduation potential is −500V and the belt graduation potential is +1000 V. Conditions 1A through 1C are cases where the conductor portions are three-layered, conditions 1D and 1E are cases where the conductor portions are two-layered (a case where the earth 344, i.e., the intermediate guard conductor, is missing), and a condition 1F is a case where the conductor portion is mono-layered (a case where the drum graduation and belt graduation are detected by the conductor portion of mono-layer). The condition 1F is the latent image sensor shown in the sixth and eighth embodiments for example.

Arrows in the charts of each condition indicate that voltages described on the arrows are applied to the conductor portions pointed by the arrows. HV(d), HV(M), and HV(b) connected to the conductor portions of each condition schematically indicate the voltages applied to the respective conductor portions as described above. It is noted that those voltages are omitted for the conditions 1B, 1C and 1E in FIG. 67, the same ones shown on the left hand side of FIG. 67 also apply to those conditions. Still further, because the conductor portion is mono-layer in the condition 1F, the voltage connected to the conductor portion is expressed as HV(d) for convenience.

Table 1 shows the voltages applied to the respective conductor portions under each condition and whether or not a discharge has occurred at that time (results of discharge check). Table 1 also shows an example in which no voltage is applied to the respective conductor portions as a comparison example. A condition 1B' is a modified example of the condition 1B.

TABLE 1

| VALUE\ CONDITION | 1A | 1B | 1B' | 1C | 1D | 1E | 1F | COMPARISON EXAMPLE |
|---|---|---|---|---|---|---|---|---|
| HV (d) | 250 | 500 | 500 | 625 | 300 | 500 | 300 | 0 |
| HV (M) | 250 | 0 | 500 | 250 | — | — | — | 0 |
| HV (b) | 250 | 0 | 0 | −150 | 300 | 0 | — | 0 |
| DISCHARGE | No | No | No | No | No | No | No | Yes |

As it is apparent from Table 1, the result of the discharge check becomes Yes and a discharge has occurred in the case where no voltage is applied in the comparison example. Meanwhile, when the predetermined voltage is applied to the respective conductor portions like the present embodiment, the result of the discharge check becomes No and no discharge has occurred.

The voltage applying conditions and the results of the discharge check when the conductor portions are three-layered will be explained at first. An occurrence of a discharge could be suppressed in the condition 1A in which the potential difference is separated into two stage of the present embodiment. Similarly to that, an occurrence of discharge could be suppressed also in the conditions 1B, 1B' and 1C in which the potential difference is separated into three and four stages. While the conditions 1B and 1B' are what the equal voltage is applied to the two layers among the three layers, an occurrence of discharge could be suppressed in either cases.

Next, the case where the conductor portions are two-layered will be explained. Because ΔV/2=(1000−(−500))/2=750, while the voltage of −500+750=250 V was applied under the previous condition 1A, the voltage of −500+800=300 V was applied by increasing by 50V to 800 V under the condition 1D. A discharge could be suppressed also in this case. A discharge could be suppressed also in the condition 1E similarly to the condition 1B.

Finally, the case where the conductor portion is mono-layer will be explained. As described above, the potential difference can be separated only into the two stages. This configuration is the same with a case where the conductors of the condition 1D are integrated, and a discharge could be suppressed also in this case.

As described above, the present embodiment allows an occurrence of discharge to be suppressed by applying the voltage to the conductor portions of the latent image sensor. As a result, it is possible to detect the latent image graduations normally and stably and to accurately carry out the image position matching. The other configurations and operations are the same with those of the first embodiment described above.

Thirteenth Embodiment

A thirteenth embodiment of the present invention will be described below with reference to FIGS. 56 and 57 and by using FIGS. 68 and 69. In the present embodiment, the potential (belt potential) of the intermediate transfer belt 24 is lowered by pre-charging the intermediate transfer belt 24. Specifically, minus pre-charging is carried out on the intermediate transfer belt 24. This arrangement will be explained below in detail.

At first, pre-charging to the intermediate transfer belt 24 will be explained with reference to FIG. 56A. Pre-charging of a predetermined voltage, e.g., −240 V, is carried out to the intermediate transfer belt 24 by the pre-charge portion 85. This predetermined voltage is an optimal value for the image forming apparatus found by experiments and others in advance. The pre-charge portion 85 corresponds to a conveyance body voltage applying portion that applies a voltage to the intermediate transfer belt 24, i.e., a conveyance body. The control portion 48 transfers an image from the photoconductive drums 12*b* through 12*d*, i.e., the second image carriers, to the intermediate transfer belt 24 under the condition in which the predetermined voltage is applied by the pre-charge portion 85. That is, the control portion 48 transfers the toner images and latent image graduations from the photoconductive drums 12*b* through 12*d* to the intermediate transfer belt 24 by using the pre-charged intermediate transfer belt 24.

The relationship between the image forming portions 43*a* and 43*b* and the intermediate transfer belt 24 in FIG. 56A will be explained specifically. Here, the pre-charging predetermined voltage was set at −240 V. The latent image graduation of the photoconductive drum 12*a* was transferred to the intermediate transfer belt 24 at the image forming portion 43*a* by 1200 V as the primary transfer voltage. At this time Vdark=−500 V and Vlight=−310 V. When 1200 V was applied to the primary transfer power source 84*b* in the image forming portion 43*b*, the belt graduation potential was: Vdark=−500+1200=700 V and Vlight=−310+1200=890 V. A potential difference between the drum graduation and the belt graduation, i.e., ΔV=890−(−500)=1390 V. ΔV/2 was about 700 V.

Next, a voltage applying process of conducting such pre-charging will be explained with reference to FIG. 68. An overall flow is the same with the basic process flow (no pre-charging) described with reference to FIG. 65.

At first, in order to calculate a maximum potential difference ΔV, set values of a charge potential Vd of the photoconductive drum, a primary transfer voltage Vt, and a pre-charge voltage Vp (predetermined voltage) are read in Step 401. Next, it is judged whether or not ΔV (=Vt−Vd+Vp) is greater than a discharge starting voltage Vdis in Step 402. In this case, Vdis is assumed to be 900 V obtained as a result of the study described above. If the result of the judgment is No, no voltage is applied to the conductor portion and an earth condition (0 V) is kept in Step 403. If the result of the judgment is Yes in contrary, the step advances to a voltage application determining process in Step 404. The detail of the voltage application determining process is the same with what explained with reference to FIG. 66. Then, the voltage determined by the voltage application determining process is applied to each conductor portion of the latent image sensor 34E in Step 405. In this condition, the latent image graduations formed respectively on the intermediate transfer belt 24 and the photoconductive drum 12 are detected by the latent image sensor 34E in Step 406.

Specific Examples

Next, a specific example in dividing the potential difference ΔV between the belt graduation potential and the drum graduation potential will be explained with reference to FIG. 69 following the flow in FIG. 68 described above. FIG. 69 shows exemplary voltages applied by the high voltage power sources in a case where the drum graduation potential is −500 V, the belt graduation potential is +1000 V, and a predetermined voltage of pre-charging is −240 V. Conditions 2A through 2C are cases where the conductor portions are three-layered, conditions 2D and 2E are cases where the conductor portions are two-layered (a case where the earth 344, i.e., the intermediate guard conductor, is missing), and a condition 2F is a case where the conductor portion is mono-layered (a case where the drum graduation and belt graduation are detected by the conductor portion of mono-layer). The condition 2F is the latent image sensor shown in the sixth and eighth embodiments for example. The other contents shown in the charts are the same with those described in connection with FIG. 67.

Table 2 shows the voltages applied to the respective conductor portions under each condition and whether or not a discharge has occurred at that time (results of discharge check). Table 2 also shows an example in which no voltage is applied to the respective conductor portions as a comparison example. A condition 2B' is a modified example of the condition 2B.

TABLE 2

| VALUE\ CONDITION | 2A | 2B | 2B' | 2C | 2D | 2E | 2F | COMPARISON EXAMPLE |
|---|---|---|---|---|---|---|---|---|
| HV (d) | 200 | 450 | 450 | 600 | 200 | 450 | 200 | 0 |
| HV (M) | 200 | 0 | 450 | 250 | — | — | — | 0 |
| HV (b) | 200 | 0 | 0 | −150 | 200 | 0 | — | 0 |
| DISCHARGE | No | No | No | No | No | No | No | Yes |

As it is apparent from Table 2, the result of the discharge check becomes Yes and a discharge has occurred in the case where no voltage is applied in the comparison example. Meanwhile, when the predetermined voltage is applied to the respective conductor portions like the present embodiment, the result of the discharge check becomes No and no discharge has occurred.

The voltage applying conditions and the results of the discharge check when the conductor portions are three-layered will be explained at first. The applied voltage could be lowered by the amount of the pre-charge and an occurrence of a discharge could be suppressed in the condition 2A in which the potential difference is separated into two stage of the present embodiment. Similarly to that, the applied voltage could be lowered by the amount of the pre-charge and an occurrence of discharge could be suppressed also in the conditions 2B, 2B' and 2C in which the potential difference is separated into three and four stages. While the conditions 2B and 2B' are what the equal voltage is applied to the two layers among the three layers, an occurrence of discharge could be suppressed in either cases.

Next, the case where the conductor portions are two-layered will be explained. The conditions 2D and 2E are the same with a case where the earth as the intermediate guard conductor of the conditions 2A and 2B is integrated with the conductor portion on the intermediate transfer belt 24 side, and a discharge could be suppressed also in this case.

Finally, the case where the conductor portion is mono-layer will be explained. This case is also considered such that the conductor portions are integrated similarly to the conditions 2A and 2D, and a discharge could be suppressed also in this case.

As described above, the present embodiment allows a discharge to be suppressed while reducing the voltage to be applied to the conductor portions of the latent image sensor by carrying out the pre-charge, as compared to the case of not carrying out the pre-charge. The other configurations and operations are the same with those of the twelfth embodiment described above.

Fourteenth Embodiment

A fourteenth embodiment of the present invention will be described below with reference to FIG. 56 and by using FIG. 70. The charging voltage of the photoconductive drum is set based on an environment (temperature and humidity) in which the image forming apparatus is installed in the present embodiment. To that end, an environment sensor 88 that detects the environment (temperature and humidity) in which the image forming apparatus is installed is provided in the present embodiment as shown in FIG. 56A. It is noted that the environment sensor 88 may be provided inside or outside of the apparatus. In either cases, a relationship between a detected result of the environment sensor 88 and the charging voltage corresponding to that is stored in a memory provided within the control portion 48. The primary transfer voltage is also found by ATVC control (Active Transfer Voltage Control). Such ATVC control is executed at such timing of turning power ON of the image forming apparatus, of pre-rotation of a print operation, of an interrupt control during consecutive printing, and the like.

such a process flow in the image forming apparatus of the present embodiment will be explained with reference to FIG. 70. At first, temperature and humidity of the environment in which the image forming apparatus is installed are detected by the environment sensor 88 in Step 501. Based on the result, the charging voltage Vd of the photoconductive drum is determined from the relationship stored in the memory of the control portion 48 in Step 502.

Next, a plurality of different voltages is applied by the ATVC control and electric currents flowing through the primary transfer rollers at that time are measure respectively in Step 503. Then, the relationship between the current and the voltage is found, and the primary transfer voltage Vt corresponding to the adequate transfer current is set from the environment detected by the environment sensor 88 in Step 504. It is noted that Steps 503 and 504 may be carried out before Steps 501 and 502 or may be carried out concurrently. The flow on and after that is the same with that shown in FIG. 68.

That is, Vd, Vt and Vp are read in Step 505 to calculate ΔV=Vt−Vd+Vp. Then, it is judged whether or not ΔV>Vdis in Step 506. In this case, Vdis is 900 V obtained as a result of the previous study. If the result of the judgment is No, no voltage is applied to each conductor portion and the earth condition (0 V) is kept in Step 507. When the result of the judgment is Yes in contrary, the step advances to the voltage application determining process in Step 508. The voltage application determining process is the same as explained with reference to FIG. 66. The voltage determined by the voltage application determining process is applied to the respective conductor portions in Step 509. In this condition, the latent image graduations formed respectively on the intermediate transfer belt 24 and the photoconductive drum 12 are detected by the latent image sensor 34E in Step 510.

Specific Examples

Next, a specific example for dividing the potential difference ΔV between the belt graduation potential and the drum graduation potential will be explained with reference to Table 3 following the flow in FIG. 70 described above. Here, because it was found in the twelfth and thirteenth embodiments described above that the case where the conductor portions are two-layered and mono-layered has the similar relationship with the case where the conductor portions are three-layered, the case where the conductor portions are three-layered will be explained.

TABLE 3

| VALUE\ CONDITION | 3A | 3B | 3C | 3D | 3E | 3F | 3G |
|---|---|---|---|---|---|---|---|
| Vd | −500 | −500 | −500 | −500 | −700 | −700 | −700 |
| Vt | 1200 | 1200 | 1500 | 1500 | 1800 | 1800 | 1800 |
| Vp | −240 | −400 | −240 | −240 | 0 | 0 | 0 |
| ΔV | 1460 | 1300 | 1760 | 1760 | 2500 | 2500 | 2500 |
| HV (d) | 230 | 150 | 80 | 80 | 550 | 130 | −80 |
| HV (M) | 230 | 150 | 640 | 80 | 550 | 960 | 540 |
| HV (b) | 230 | 150 | 640 | 640 | 550 | 960 | 1160 |
| DISCHARGE | No | No | No | No | Yes | Yes | No |

A discharge was suppressed in the condition 3A by separating the potential difference into two stages by almost the same setting with the condition 2A in FIG. 69. A discharge was suppressed in the condition 3B by enhancing the precharging voltage. In the condition 3C, Vt increased and a discharge has occurred even the potential difference is separated into the two stages, so that a discharge was suppressed by separating the potential difference into three stages. In the condition 3D, there was no problem (discharge could be suppressed) even when 80 V was applied as HV(M) when the potential difference was separated into three stages.

In the conditions 3E, 3F and 3G, Vd was −700 V, Vt was 1800 V, and Vp=0 V in a normal temperature and low humidity environment (25° C. of temperature and 5% of relative humidity). A discharge has occurred in the condition 3E even when the potential difference is separated into two stages. Due to that, the potential difference was separated into three stages in the condition 3F, a discharge has occurred even under such condition. A discharge was suppressed by separating into four stages finally in the condition 3G.

The voltage application determining process of the present embodiment was effective even in the configuration in which Vt and Vd change as described above. The other configurations and operations are the same with those of the thirteenth embodiment described above.

Other Embodiment

While the configuration using the intermediate transfer belt as the conveyance body have been explained in each embodiment described above, the present invention is also applicable to a configuration in which a toner image is directly transferred from a photoconductive drum to a recording medium by using a recording medium conveying belt that conveys the recording medium as a conveyance body. While the toner image is transferred to the recording medium, a latent image graduation, i.e., first position information is transferred to the recording medium conveying belt in this case.

Still further, the rotation of the photoconductive drum 12, i.e., the second image carrier, is controlled to correct a color shift in the sub-scan direction in each embodiment described above. However, the correction of such color shift may be carried out by other methods such as control of exposure timing of the exposure unit of the second image forming portion, a conveying speed of the conveyance body such as the intermediate transfer belt and the recording medium conveying belt, and others. In short, the correction of the color shift may be made by controlling at least either one of the second image carrier, the second image forming portion, and the conveyance body.

The first position information formed on the intermediate transfer belt is what the latent image graduation 31*a* formed on the photoconductive drum 12*a*, i.e., the first image carrier, is transferred to the intermediate transfer belt 24 in each embodiment described above. However, such first position information may be formed directly on the intermediate transfer belt or the recording medium conveying belt. Still further, the first and second position information are not limited to be the latent image graduations formed by electrostatic latent images, and may be magnetic graduations formed by magnetism. In this case, first and second information detecting portions detect changes of magnetisms, respectively. Still further, the respective embodiments described above may be carried out by appropriately combining them.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-029572, filed on Feb. 19, 2013, which is hereby incorporated by reference herein in its entirety.

What is claimed is:

1. An image forming apparatus, comprising:

a conveyance body configured to carry and convey an image or recording medium;

first and second image carriers juxtaposed in a conveying direction of the conveyance body and each carrying and conveying an image;

a first image forming portion configured to form the image on the first image carrier;

a second image forming portion configured to form the image on the second image carrier;

a first transfer portion configured to transfer the image from the first image carrier to the conveyance body or to the recording medium conveyed by the conveyance body;

a second transfer portion disposed downstream of the first transfer portion in the conveying direction of the conveyance body and configured to transfer the image from the second image carrier to the conveyance body or to the recording medium conveyed by the conveyance body;

a first position information forming portion configured to form first position information concerning a position of the image formed on the conveyance body by the first image forming portion;

a second position information forming portion configured to form second position information concerning a position of the image formed on the second image carrier by the second image forming portion;

an information detecting portion configured to detect the first position information formed on the conveyance body and the second position information formed on the second image carrier;

a control portion configured to control at least one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body on a basis of the first and second position information detected by the information detecting portion in transferring the image from the second image carrier to the conveyance body or to the recording medium conveyed by the conveyance body; and a hold member configured to hold and to position the information detecting portion at a transfer region where the image is transferred from the second image carrier to the conveyance body or to the recording medium, wherein the information detecting portion includes a first information detecting portion configured to detect the first position information formed on the conveyance body and a second information detecting portion configured to detect the second position information formed on the second image carrier, wherein the hold member integrally holds the first and second information detecting portions, wherein the second position information forming portion forms the second position information at a position where at least parts of the second and first position information are overlapped with respect to the width direction intersecting the conveying direction of the second image carrier on the surface of the second image carrier, and wherein the first and second information detecting portions are disposed at positions different in a thickness direction orthogonal to the surface of the conveyance body.

2. The image forming apparatus according to claim 1, further comprising:

a first conductive portion disposed around the first information detecting portion at the same position as the first information detecting portion in the thickness direction and kept at a constant potential;

a second conductive portion disposed around the second information detecting portion at the same position as the second information detecting portion in the thickness direction and kept at a constant potential, wherein the first and second position information forming portions form the first and second position information by electrical signals, respectively, wherein the first information detecting portion being formed of a conductor detects the electrical signal and is disposed at a position superimposed with the second conductive portion when viewed from the thickness direction, and wherein the second information detecting portion being formed of a conductor detects the electrical signal and is disposed at a position superimposed with the first conductive portion when viewed from the thickness direction.

3. The image forming apparatus according to claim 1, wherein the first and second position information forming portions form the first and second position information by electrical signals, respectively, wherein the first information detecting portion is formed of a conductor and detects the electrical signal, wherein the second information detecting portion is formed of a conductor and detects the electrical signal, and wherein the information detecting portion has a conductor which is kept at a constant potential and disposed between the first and second information detecting portions at a position superimposed with the first and second information detecting portions when viewed from the thickness direction.

4. An image forming apparatus, comprising:

a conveyance body configured to carry and convey an image or recording medium;

first and second image carriers juxtaposed in a conveying direction of the conveyance body and each carrying and conveying an image;

a first image forming portion configured to form the image on the first image carrier;

a second image forming portion configured to form the image on the second image carrier;

a first transfer portion configured to transfer the image from the first image carrier to the conveyance body or to the recording medium conveyed by the conveyance body;

a second transfer portion disposed downstream of the first transfer portion in the conveying direction of the conveyance body and configured to transfer the image from the second image carrier to the conveyance body or to the recording medium conveyed by the conveyance body;

a first position information forming portion configured to form first position information concerning a position of the image formed on the conveyance body by the first image forming portion;

a second position information forming portion configured to form second position information concerning a position of the image formed on the second image carrier by the second image forming portion;

an information detecting portion configured to detect the first position information formed on the conveyance body and the second position information formed on the second image carrier;

a control portion configured to control at least one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body on a basis of the first and second position information detected by the information detecting portion in transferring the image from the second image carrier to the conveyance body or to the recording medium conveyed by the conveyance body; and a hold member configured to hold and to position the information detecting portion at a transfer region where the image is transferred from the second image carrier to the conveyance body or to the recording medium, wherein the first position information forming portion forms two types of signals consecutively at equal intervals with a duty ratio of 50% with respect to the conveying direction of the conveyance body as the first position information, wherein the second position information forming portion forms two types of signals consecutively at equal intervals with a duty ratio of 50% in terms of the conveying direction of the second image carrier as the second position information at a position where at least parts of the second and first position information are overlapped with respect to the width direction intersecting the conveying direction of the second image carrier on the surface of the second image carrier, wherein the information detecting portion includes two signal detecting portions disposed by being arrayed in the conveying direction of the conveyance body and an information processing portion configured to process detection signals of the two signal detecting portions, wherein the two signal detecting portions are disposed such that the following equations are met:

$$P1=P2/(2\times n) \text{ or } P1=P2\times 2\times m,$$

$$D=P2/2 \text{ when } P1<P2, \text{ and}$$

$$D=P1/2 \text{ when } P1>P2,$$

where, P1 is a distance between signals of the first position information, P2 is a distance between signals of the second position information, n and m are natural numbers, and D is a distance in the conveying direction of the two signal detecting portions, wherein the information processing portion processes the detection signals of the two signal detecting portions such that the following equations are met:

$$M1=S1+S2 \text{ and } M2=S1-S2, \text{ when } P1<P2, \text{ and}$$

$$M1=S1-S2 \text{ and } M2=S1+S2, \text{ when } P1>P2,$$

where S1 and S2 are the detection signals of the two signal detecting portions, M1 is a detection signal concerning the first position information, and M2 is a detection signal concerning the second position information, and wherein the control portion controls at least one of the second image carrier, the second image forming portion, and the conveyance body such that phases of M1 and M2 coincide.

5. An image forming apparatus, comprising:

a conveyance body configured to carry and convey an image or recording medium;

first and second image carriers juxtaposed in a conveying direction of the conveyance body and each carrying and conveying an image;

a first image forming portion configured to form the image on the first image carrier;

a second image forming portion configured to form the image on the second image carrier;

a first transfer portion configured to transfer the image from the first image carrier to the conveyance body or to the recording medium conveyed by the conveyance body;

a second transfer portion disposed downstream of the first transfer portion in the conveying direction of the conveyance body and configured to transfer the image from the second image carrier to the conveyance body or to the recording medium conveyed by the conveyance body;

a first position information forming portion configured to form first position information concerning a position of the image formed on the conveyance body by the first image forming portion;

a second position information forming portion configured to form second position information concerning a position of the image formed on the second image carrier by the second image forming portion;

an information detecting portion configured to detect the first position information formed on the conveyance body and the second position information formed on the second image carrier;

a control portion configured to control at least one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body on a basis of the first and second position information detected by the information detecting portion in transferring the image from the second image carrier to the conveyance body or to the recording medium conveyed by the conveyance body; and a hold member configured to hold and to position the information detecting portion at a transfer region where the image is transferred from the second image carrier to the conveyance body or to the recording medium, wherein the first position information forming portion forms two types of signals consecutively at equal intervals with a duty ratio of 50% in terms of the conveying direction of the conveyance body as the first position information, wherein the second position information forming portion forms two types of signals consecutively at equal intervals with a duty ratio of 50% in terms of the conveying direction of the second image carrier as the second position information at a position where at least parts of the second and first position information are overlapped with respect to the width direction intersecting the conveying direction of the second image carrier on the surface of the second image carrier, wherein the information detecting portion includes four signal detecting portions disposed by being arrayed in the conveying direction of the conveyance body and an information processing portion configured to process detection signals of the four signal detecting portions, wherein the four signal detecting portions are disposed such that the following equations are met:

$$P1=P2/(2\times n) \text{ or } P1=P2\times 2\times m,$$

$$D12=P1/2,\ D34=P1/2, \text{ and } D13=P2/2, \text{ when } P1<P2, \text{ and}$$

$$D12=P2/2,\ D34=P2/2, \text{ and } D13=P1/2, \text{ when } P1>P2,$$

where P1 is a distance between signals of the first position information, P2 is a distance between signals of the second position information, n and m are natural numbers, and when the four signal detecting portions are denoted from downstream in the conveying direction as a first signal detecting portion, a second signal detecting portion, a third signal detecting portion, and a fourth signal detecting portion, D12 is a distance in the conveying direction between the first and second signal detecting portions, D34 is a distance in the conveying direction between the third and fourth signal detecting portions, and D13 is a distance in the conveying direction between the first and third signal detecting portions, wherein the information processing portion processes the detection signals of the four signal detecting portions such that the following equations are met:

$$M1=(S1-S2)+(S3-S4) \text{ and } M2=S1-S3, \text{ when } P1<P2,$$

$$M1=S1-S3 \text{ and } M2=(S1-S2)+(S3-S4), \text{ when } P1>P2,$$

where S1, S2, S3 and S4 are the detection signals of the four signal detecting portions, M1 is a detection signal concerning the first position information, and M2 is a detection signal concerning the second position information, and wherein the control portion controls at least one of the second image carrier, the second image forming portion, and the conveyance body such that phases of M1 and M2 coincide.

6. An image forming apparatus, comprising:

a conveyance body configured to carry and convey an image or recording medium;

first and second image carriers juxtaposed in a conveying direction of the conveyance body and each carrying and conveying an image;

a first image forming portion configured to form the image on the first image carrier;

a second image forming portion configured to form the image on the second image carrier;

a first transfer portion configured to transfer the image from the first image carrier to the conveyance body or to the recording medium conveyed by the conveyance body;

a second transfer portion disposed downstream of the first transfer portion in the conveying direction of the conveyance body and configured to transfer the image from the second image carrier to the conveyance body or to the recording medium conveyed by the conveyance body;

a first position information forming portion configured to form first position information concerning a position of the image formed on the conveyance body by the first image forming portion;

a second position information forming portion configured to form second position information concerning a position of the image formed on the second image carrier by the second image forming portion;

an information detecting portion configured to detect the first position information formed on the conveyance body and the second position information formed on the second image carrier;

a control portion configured to control at least one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body on a basis of the first and second position information detected by the information detecting portion in transferring the image from the second image carrier to the conveyance body or to the recording medium conveyed by the conveyance body; and a hold member configured to hold and to position the information detecting portion at a transfer region where the image is transferred from the second image carrier to the conveyance body or to the recording medium, wherein the first and second position information forming portions form the first and second position information such that there exists a region in which signals forming the first and second position information, respectively, do not overlap when viewed from the thickness direction orthogonal to the surface of the conveyance body, wherein the information detecting portion detects the first position information formed on the conveyance body and the second position information formed on the second image carrier by one signal detecting portion, and wherein the first and second position information forming portions form the signals forming the first and second position information, respectively, such that shapes of the signals are different from each other.

7. An image forming apparatus, comprising:

a conveyance body configured to carry and convey an image or recording medium;

first and second image carriers juxtaposed in a conveying direction of the conveyance body and each carrying and conveying an image;

a first image forming portion configured to form the image on the first image carrier;

a second image forming portion configured to form the image on the second image carrier;

a first transfer portion configured to transfer the image from the first image carrier to the conveyance body or to the recording medium conveyed by the conveyance body;

a second transfer portion disposed downstream of the first transfer portion in the conveying direction of the conveyance body and configured to transfer the image from the second image carrier to the conveyance body or to the recording medium conveyed by the conveyance body;

a first position information forming portion configured to form first position information concerning a position of the portion;

a second position information forming portion configured to form second position information concerning a position of the image formed on the second image carrier by the second image forming portion;

an information detecting portion configured to detect the first position information formed on the conveyance body and the second position information formed on the second image carrier;

a control portion configured to control at least one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body on a basis of the first and second position information detected by the information detecting portion in transferring the image from the second image carrier to the conveyance body or to the recording medium conveyed by the conveyance body; and a hold member configured to hold and to position the information detecting portion at a transfer region where the image is transferred from the second image carrier to the conveyance body or to the recording medium, wherein the first and second position information forming portions form the first and second position information such that there exists a region in which signals forming the first and second position information, respectively, do not overlap when viewed from the thickness direction orthogonal to the surface of the conveyance body, wherein the information detecting portion detects the first position information formed on the conveyance body and the second position information formed on the second image carrier by one signal detecting portion, and wherein the first and second position information forming portions form the signals forming the first and second position information, respectively, such that widthwise lengths of the signals intersecting the conveying direction are different from each other.

8. An image forming apparatus, comprising:

a conveyance body configured to carry and convey an image or recording medium;

first and second image carriers juxtaposed in a conveying direction of the conveyance body and each carrying and conveying an image;

a first image forming portion configured to form the image on the first image carrier;

a second image forming portion configured to form the image on the second image carrier;

a first transfer portion configured to transfer the image from the first image carrier to the conveyance body or to the recording medium conveyed by the conveyance body;

a second transfer portion disposed downstream of the first transfer portion in the conveying direction of the conveyance body and configured to transfer the image from the second image carrier to the conveyance body or to the recording medium conveyed by the conveyance body;

a first position information forming portion configured to form first position information concerning a position of the image formed on the conveyance body by the first image forming portion;

a second position information forming portion configured to form second position information concerning a position of the image formed on the second image carrier by the second image forming portion;

an information detecting portion configured to detect the first position information formed on the conveyance body and the second position information formed on the second image carrier;

a control portion configured to control at least one of the second image carrier, the second image forming portion, and the conveyance body such that the position of the image carried on the second image carrier matches with the position of the image transferred from the first image carrier to the conveyance body or the position of the image transferred from the first image carrier to the recording medium conveyed by the conveyance body on a basis of the first and second position information detected by the information detecting portion in transferring the image from the second image carrier to the conveyance body or to the recording medium conveyed by the conveyance body; and a hold member configured to hold and to position the information detecting portion at a transfer region where the image is transferred from the second image carrier to the conveyance body or to the recording medium, wherein the first and second position information forming portions form the first and second position information such that there exists a region in which signals forming the first and second position information, respectively, do not overlap when viewed from the thickness direction orthogonal to the surface of the conveyance body, wherein the information detecting portion detects the first position information formed on the conveyance body and the second position information formed on the second image carrier by one signal detecting portion, and wherein the first and second position information forming portions form signals forming the first and second position information, respectively, such that lengths of the signals in the conveying direction of the conveyance body are different from each other and such that periods of the signals are equal.

* * * * *